US005640835A

United States Patent [19]

Muscoplat

[11] Patent Number: 5,640,835

[45] Date of Patent: Jun. 24, 1997

[54] MULTIPLE ENVELOPE WITH INTEGRALLY FORMED AND PRINTED CONTENTS AND RETURN ENVELOPE

[76] Inventor: Richard Muscoplat, 1890 Portland Ave., Ramsey County, Saint Paul, Minn. 55104

[21] Appl. No.: 411,411

[22] Filed: Mar. 27, 1995

Related U.S. Application Data

[63] Continuation-in-part of Ser. No. 39,588, Mar. 29, 1993, Pat. No. 5,409,441, which is a continuation-in-part of Ser. No. 780,087, Oct. 16, 1991, abandoned.

[51] Int. Cl.[6] ..... B65B 11/48; B31B 49/04

[52] U.S. Cl. ..... 53/569; 53/117; 53/520; 53/284.3

[58] Field of Search ..... 53/460, 520, 117, 53/569, 284.3, 389.3, 131.5, 131.4

[56] References Cited

U.S. PATENT DOCUMENTS

| | | | |
|---|---|---|---|
| 1,297,748 | 3/1919 | Streeper | 15/179 |
| 1,983,323 | 12/1934 | Stokes | 93/36 |
| 2,214,593 | 9/1940 | Mustin et al. | 164/65 |
| 2,512,382 | 6/1950 | Ringler | 93/51 |
| 2,706,944 | 4/1955 | Claff et al. | 101/227 |
| 2,985,990 | 5/1961 | Waite et al. | 93/51 |
| 3,185,046 | 5/1965 | Gross | 93/36.01 |
| 3,191,508 | 6/1965 | Beamish | 93/36 |
| 3,192,837 | 7/1965 | Hoyrup et al. | 93/51 |
| 3,626,819 | 12/1971 | Hoyrup | 93/51 |
| 3,635,129 | 1/1972 | Cobelo, Jr. | 93/51 R |
| 3,648,605 | 3/1972 | Hottendorf | 101/232 |
| 3,774,016 | 11/1973 | Sterns | 93/36 |
| 3,800,681 | 4/1974 | Corderoy | 93/51 R |
| 3,806,012 | 4/1974 | Roch | 93/51 |
| 3,897,720 | 8/1975 | Hiersteiner | 53/460 X |
| 3,899,946 | 8/1975 | Niepman | 93/51 |
| 3,941,309 | 3/1976 | Gendron | 93/51 |
| 3,998,138 | 12/1976 | Walters | 53/460 X |
| 4,011,985 | 3/1977 | Simson | 93/36.01 |
| 4,071,997 | 2/1978 | Gunther, Jr. et al. | 53/460 X |
| 4,081,127 | 3/1978 | Steidinger | 164/65 |
| 4,081,944 | 4/1978 | Sjostrand | 93/51 |
| 4,091,596 | 5/1978 | Jones | 53/460 |
| 4,148,430 | 4/1979 | Drake | 93/51 R |
| 4,157,759 | 6/1979 | Dicker | 93/36 |
| 4,214,524 | 7/1980 | Corse | 93/36.01 |
| 4,264,957 | 4/1981 | Corse | 101/227 |
| 4,316,566 | 2/1982 | Arleth | 164/65 |
| 4,318,176 | 3/1982 | Stratton | 93/36 |
| 4,351,461 | 9/1982 | Carlsson | 93/51 R |
| 4,361,260 | 11/1982 | Hanlan | 101/232 |
| 4,437,582 | 3/1984 | Volk, Jr. et al. | 101/232 |
| 4,440,341 | 4/1984 | Pennock | 93/51 R |
| 4,455,809 | 6/1984 | Dallaserra | 53/569 X |
| 4,484,522 | 11/1984 | Simeth | 93/51 R |
| 4,528,630 | 7/1985 | Sargent | 93/36 |
| 4,533,269 | 8/1985 | Pou | 93/51 |
| 4,541,335 | 9/1985 | Tokuno | 93/51 |

(List continued on next page.)

OTHER PUBLICATIONS

Flexography Principles and Practice, 3d ed., copyright 1980, pp. 28, 60 and 76 Indramat Sales Brochure No. IAE 74180 Rev A Sep. 1993.

*Primary Examiner*—Horace M. Culver
*Attorney, Agent, or Firm*—David George Johnson

[57] ABSTRACT

A gusseted envelope or box making apparatus and method including the use of a tractor feed unit (11) which perforates the web stock (5) prior to a subsequent printing step capable of printing on either side of the web (5). At least one thermal print head (61) precisely activates thermal ribbon (57) which is accurately registered with the web (5) by means of pin feed holes (16,17). A product conveyor (74) manipulates the product (75) so as to automatically load the box or envelope (69) thus manufactured and printed. A multipart form (141) is disclosed including a continuous envelope (167), return reply envelope (173) and enclosed coupon (166) which may all be imprinted with unique customer information (161). The complete form (141) is folded and inserted into a parent envelope (167) by a series of vacuum plates (376) and insertion rams (392).

9 Claims, 41 Drawing Sheets

U.S. PATENT DOCUMENTS

| | | | |
|---|---|---|---|
| 4,542,893 | 9/1985 | Clause et al. | 270/52.5 |
| 4,543,082 | 9/1985 | Stenner | 493/216 |
| 4,545,780 | 10/1985 | Martin | 493/11 |
| 4,552,608 | 11/1985 | Hoffmann | 156/351 |
| 4,575,666 | 3/1986 | Nakashira et al. | 318/661 |
| 4,586,651 | 5/1986 | Bradley | 229/68 R |
| 4,600,141 | 7/1986 | Bradley et al. | 229/92.7 |
| 4,621,224 | 11/1986 | Watabe et al. | 318/594 |
| 4,630,768 | 12/1986 | Bradley | 229/92.7 |
| 4,632,427 | 12/1986 | Angus | 282/11.5 R |
| 4,651,920 | 3/1987 | Stenner | 229/70 |
| 4,668,211 | 5/1987 | Lubotta et al. | 493/188 |
| 4,705,298 | 11/1987 | Van Malderghem et al. | 282/11.5 A |
| 4,711,530 | 12/1987 | Nakanowatari et al. | 350/339 R |
| 4,719,575 | 1/1988 | Gnuechtel | 364/469 |
| 4,726,804 | 2/1988 | Stitcher | 493/223 |
| 4,737,904 | 4/1988 | Ominato | 364/167.01 |
| 4,747,535 | 5/1988 | Haase et al. | 229/69 |
| 4,754,915 | 7/1988 | Steindinger | 229/92.7 |
| 4,770,337 | 9/1988 | Leibe | 229/69 |
| 4,776,510 | 10/1988 | Jenkins | 229/73 |
| 4,786,353 | 11/1988 | Templeton | 156/359 |
| 4,804,135 | 2/1989 | Borbeau | 229/69 |
| 4,821,644 | 4/1989 | Gawler | 101/486 |
| 4,830,269 | 5/1989 | Jenkins | 229/73 |
| 4,849,680 | 7/1989 | Miyamoto | 318/602 |
| 4,852,794 | 8/1989 | Bennett et al. | 229/73 |
| 4,852,795 | 8/1989 | Volk, Jr. | 229/92 |
| 4,860,945 | 8/1989 | Breen | 229/69 |
| 4,882,529 | 11/1989 | Kobari et al. | 318/602 |
| 4,883,220 | 11/1989 | Brown | 229/69 |
| 4,889,278 | 12/1989 | Steidinger | 229/92.1 |
| 4,892,426 | 1/1990 | Steele | 400/708 |
| 4,893,740 | 1/1990 | Hediger et al. | 226/23 |
| 4,896,605 | 1/1990 | Schroder | 101/486 |
| 4,898,322 | 2/1990 | Coffey et al. | 229/69 |
| 4,913,049 | 4/1990 | Sainio | 101/211 |
| 4,915,287 | 4/1990 | Volk et al. | 229/70 |
| 4,915,679 | 4/1990 | Geton | 493/381 |
| 4,917,010 | 4/1990 | Gilham | 400/120 |
| 4,934,536 | 6/1990 | Mills | 206/610 |
| 4,944,449 | 7/1990 | Schmidt | 229/73 |
| 4,944,450 | 7/1990 | Schmidt | 229/73 |
| 4,949,891 | 8/1990 | Yamashita | 226/30 |
| 4,955,265 | 9/1990 | Nakagawa et al. | 83/74 |
| 4,970,423 | 11/1990 | Tamae et al. | 310/162 |
| 4,984,458 | 1/1991 | Montgomery et al. | 73/159 |
| 4,984,733 | 1/1991 | Dunn, Jr. | 229/72 |
| 5,005,337 | 4/1991 | Kluth | 53/460 |
| 5,013,988 | 5/1991 | Sakano | 318/602 |
| 5,016,182 | 5/1991 | Bergland et al. | 364/469 |
| 5,041,070 | 8/1991 | Blaser | 493/30 |
| 5,050,812 | 9/1991 | Mueller | 242/58.1 |
| 5,064,031 | 11/1991 | Kakizaki | 188/299 |
| 5,067,305 | 11/1991 | Baker et al. | 53/460 X |
| 5,071,399 | 12/1991 | Ashby | 53/460 X |
| 5,093,610 | 3/1992 | Bailey | 318/661 |
| 5,099,290 | 3/1992 | Yokota | 255/310 |
| 5,138,821 | 8/1992 | Crowley | 53/569 X |
| 5,161,735 | 11/1992 | Bendel | 229/303 |
| 5,169,060 | 12/1992 | Tighe et al. | 229/301 |
| 5,174,494 | 12/1992 | Ashby | 229/305 |
| 5,388,815 | 2/1995 | Hill et al. | 53/460 X |
| 5,445,367 | 8/1995 | Long | 53/460 X |
| 5,524,421 | 6/1996 | Nauheimer et al. | 53/569 X |

| MATERIAL | TENSION RANGE LBS/INCH WIDTH/ MIL THICKNESS | PREFERRED WINDING METHOD | |
|---|---|---|---|
| A. Aluminum Foils | .5 to 1.5 | Taper | 1.5 to 1 |
| B. Cellophanes | .5 | Taper | 1.25 to 1 |
| C. Cellulose Acetate | .25 to .5 | Taper | 1.25 to 1 |
| D. Ethyl Cellulose | .5 | Taper | 1.25 to 1 |
| E. Glassine | 1.0 to 2.0 | Taper | 1.1 to 1 |
| F. Methyl Cellulose | .5 | Taper | 1.25 to 1 |
| G. Polyester (Mylar) | .5 to 1.0 | Constant or Taper | 1.25 to 1 |
| H. Polyethylene | .2 | Constant or Taper | 1.25 to 1 |
| I. Polypropylene | .187 to .25 | Constant or Taper | 1.25 to 1 |
| J. Polystyrene | 1.0 | Taper | |
| K. Rubber Hydrochloride (Pliofilm) | .06 to .25 | Constant | |
| L. Vinyl-Chloride Copolymers (Saran) | .06 to .187 | Constant | |
| M. Vinylindene Chloride Copolymers (Crovac) | .06 to .187 | Constant | |
| **PAPER AND LAMINATES** | | | |
| N. 20# | .5 to 1.0 | Taper | 1.5 to 1 |
| O. 40# | 1.0 to 2.0 | Taper | 1.5 to 1 |
| P. 50# | 1.25 to 2.5 | Taper | 1.5 to 1 |
| Q. 60# | 1.5 to 3.0 | Taper | 1.5 to 1 |
| R. 80# | 2.0 to 4.0 | Taper | 2 to 1 |
| S. 85# | 2.0 to 4.25 | Taper | 2 to 1 |

NOTE: 1.1 Taper-Generally "Hard Roll" 1.25 Taper-Generally "Firm"
1.5 Taper-Generally "Firm" 2.1 Taper-Generally "Soft"

Figure 1b

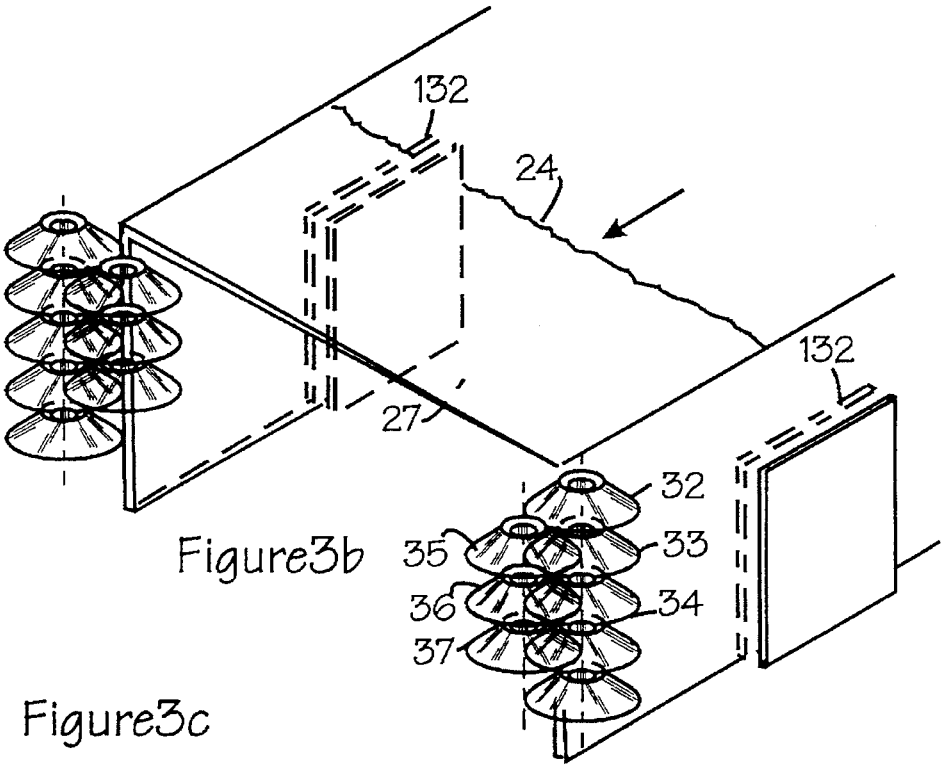
Figure3b
Figure3c
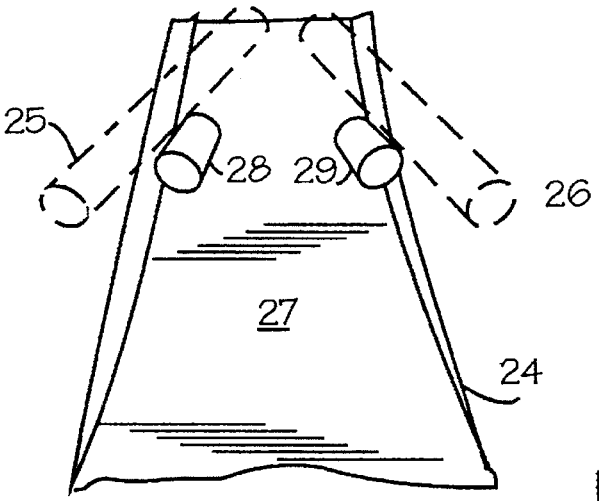
Figure3d
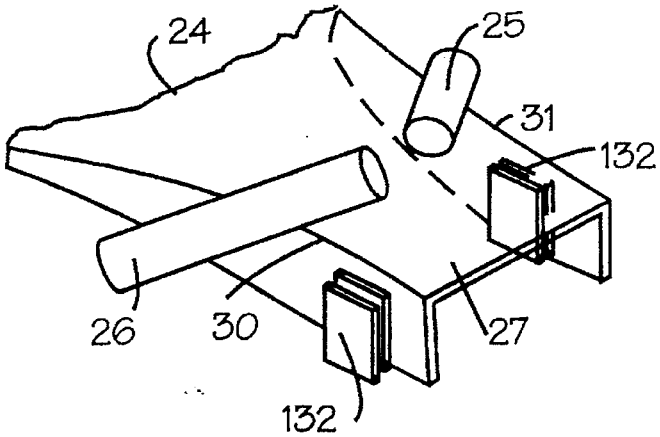

MULTIPLE ENVELOPE WITH INTEGRALLY FORMED AND PRINTED CONTENTS AND RETURN ENVELOPE

This application is a continuation in part of application Ser. No. 08/039,588 filed on Mar. 29, 1993, and now U.S. Pat. No. 5,409,441, which is a continuation in part of application Ser. No. 07/780,087 filed on Oct. 16, 1991 and now abandoned.

BACKGROUND OF THE INVENTION

1. Field of the Invention

The present invention relates to a method of manufacture and devices for constructing boxes and envelopes, and to an apparatus and method of fabricating and maintaining accurate register and feed on a printing press during the manufacture of various printed products, including, but not limited to, continuous form envelopes, boxes, business forms with integral pockets and/or attached envelopes, as well as a device for the imprinting, loading, forming and sealing of boxes and envelopes, while providing accurate registration during the entire fabrication process.

The registration devices and process described herein also enable a printing press to imprint graphics and data onto the underside of a continuous web of material without the use of a turn around devices commonly known as a turn bar. The devices for imprinting, loading, and sealing of envelopes enables the user to encode the outside of such envelopes with identifying information relating to the identity of the sender, such that the need for an enclosed identifying return payment coupon is thereby eliminated.

2. Description of Related Technology

Flat packaging pouches have grown in popularity in recent years, particularly in the field of direct mail advertising and related direct response "bang tab" envelopes. There is a large body of art pertaining to such envelopes for mailing, return reply, and advertisements with integral response mechanisms. It is obvious from the large body of prior art that numerous attempts have been made to correct the deficiencies or improve upon the features of each previous invention.

One common distinguishing feature in every cited reference in the art of envelope making, is the method of applying adhesive to one sheet or web and superimposing a second and separate sheet upon first web, thus resulting in a pouch. Such a method is described in U.S. Pat. No. 4,726,804, issued to Stitcher.

Stitcher describes a process in which a "U" shaped pattern of adhesive is deposited onto a bottom web, with the open end of the "U" corresponding to the open, or insertion, end of the finished pouch. A second web or sheet is superimposed over the first web, severed, and bonded to the "U" shaped adhesive, thereby forming a pouch. The resulting product can be folded or cut so as to form individual pouches (also referred to in the art as pockets) or left in a continuous roll form for automatic loading and imprinting prior to initial mailing.

The design deficiencies of a pouch envelope are well known in the industry. For example, the wider the resulting glue line, the larger the overall continuous envelope products must be in order to accommodate the particular correspondence or other item to be received in the envelopes. Consequently, the continuous envelope with a larger glue line will have larger dimensions than its counterpart conventional envelope which is folded and glued on its face so that the effective interior side of a conventional envelope is not affected.

The Stitcher reference also describes a method of feeding, cutting and attaching a second piece of material to a moving web to form the back of an envelope. The web is advanced by a pair of pull wheels which are driven synchronously together with the other driven rolls, and suitably controlled by known gear reducing methods, so that their surface speed matches the speed of the web in operation. Consequently, proper and precise indexing of the severed segments of the two webs may be accomplished.

Envelope manufacturing methods that combine two separate webs must make some provision for providing an extending flap. The Stitcher reference provides for the flap by die cutting and removing a section of waste material from the second web. This wasted material and the equipment needed to remove it can be cost prohibitive in practice. Thus, the Stitcher method requires the removal of a significant amount of waste material during the manufacturing process. Stitcher creates an amount of waste material that exactly matches the size of the envelope flap plus the size of the loading cutout. Stitcher applies the die cut portion to a moving bottom web with placement rollers that rotate at the same speed as the bottom web. Thus, Stitcher lays down a patch that is the same size as the envelope. Stitcher cuts the extra material and removes it from the web as waste. Stitcher does not address the problem of eliminating the wasted material. In order to vary the length of the applied patch, the second supply web must advance at a rate of speed different than that of the main web. Sticher makes no provisions for such a variable advance mechanism operating on the second web.

Some previous devices utilize a method of adhesively attaching each of the four sides of the pouch, thus requiring an alternative method of opening, as opposed to the traditional envelope flap being opened by a common letter opener. Such pouches contain printed instructional references on the outside of the envelope, directing the recipient to follow the proper sequence of steps required to remove portions in order to open said pouch. Many such envelopes provide a pull tab, tear strip, or snap off tab as the only "approved" method for opening the envelope. The use of the descriptor "approved" is remarkably important because, in actual use, pull tabs and tear strips routinely fail to tear fully along the intended length, and snap off tabs regularly fail to snap off along intended lines of weakness.

Having failed their intended purpose, the opening methods are rendered useless and the envelope recipient must resort to more primitive means to gain access to the envelope's contents. Most often, these primitive means include tearing the envelope apart along nonperforated lines of weakening. In many instances the enclosed materials are damaged, if not destroyed, because the envelope pouch tears in random and unpredictable directions.

A significant number of prior art return reply envelopes require that the return reply envelope be assembled by the recipient prior to mailing. If the return reply envelope has not already been destroyed in the process of opening the outer wrapper, then the recipient may attempt to assemble the reply vehicle, which, like the envelope opening instructions, requires the recipient to ignore conventional envelope construction methods and instead depend upon written and graphical instructions. Thus, the consumer is faced with the sometimes daunting task of deciphering the origami like diagrams and instructions describing the folding operations necessary to fold the device into a mailing vehicle.

U.S. Pat. No. 5,174,494, issued to Ashby is one example of the prior art in which the return envelope must be folded and formed by the recipient. The Ashby design prefers the use of transfer tape, instead of remoistenable adhesive, to aid the recipient in the attachment of the marginal edges of the envelope panels when forming the return envelope. Transfer tape requires the removal of a silicone impregnated release liner to expose the pressure sensitive adhesive, thereby creating disposal materials. Transfer tape is also far more costly than remoistenable adhesives. Since pressure sensitive adhesive remains active along its marginal edges after receiving a folded envelope panel, inserted materials that come in contact with the internal envelope seams will become immediately and most often, permanently attached inside the reply envelope.

Another problem for the recipients of such reply envelopes is the difficulty of properly inserting the reply payment coupon or ordering form such that the correct address is properly aligned in the die cut address window. Improper insertion of the coupon or order form will result in the U.S. Post Office's delivery of the envelope, with canceled postage, to the address shown in the window, namely, that of the original recipient, rather than that of the original sending organization. Misalignment of the coupon or order form can obscure relevant delivery address information, thereby resulting in significant delays in the delivery of the return envelope to the sending organization.

In addition to these operational disadvantages, flat packaging pouches have distinct and sometimes significant marketing disadvantages. First, because of their inherent design, flat pouches cannot hold bulky materials without creating undesirable "puckering". Puckering becomes a significant problem when the envelope must contain more than a single thickness of material or small parts. Second, because of the way inserted materials place stress on the "U" shaped seams, and more precisely the side seams, the flat pouch is less reliable as a containment device, a serious deficiency for those firms using envelope/pouches for parts packaging.

The "puckering" effect has two undesirable effects. First, the thicker the object placed within the pouch, the greater the stress placed on the bottom and side seams of the pouch. Second, in order to alleviate the problems associated with this added stress on side seams, pouch manufacturers have been forced to increase the overall size of the pouch, thereby creating an ever more significant problem with seam strength.

Upon insertion of materials into a pouch, the pouch deforms to relieve stress along the side seams, forcing the "opening" or insertion end of the pouch to reduce in size. The majority of the prior art references address the use of envelopes only for the purpose of sending a single, or at most, double thickness sheet of enclosed materials. However, present day billing and direct mailing techniques employ the use of multiple page insertions of advertisements. In fact, the current trend is toward a greater, not lesser, amount of enclosed matter in an effort to encourage purchases by the recipient of the advertised products or services.

In order to compensate for the puckering and reduced opening size problems, manufacturers have been forced to enlarge the overall dimensions of pouches, especially when compared to a comparable capacity gusseted or fold around envelope. In order to compensate for reduced seam strength, manufacturers have had to increase the width of the "U" shaped adhesive area.

However, enlarging a flat pouch package leads to a more undesirable problem, namely, ever increasing seam weakness. For example, a pouch with an interior dimension of 4"×5" requires a seam width of approximately ⅛" on each side. The two side seams add ¼" to the pouch, or 5.8% of the pouch's total width. When the pouch is enlarged to 8"×10", the seam must be increased to at least ½" in order to maintain the same strength, thereby occupying 11.1% of total pouch width.

Gusseted and fold around envelopes offer distinct advantages over conventional envelopes or flat pouch design envelopes. Gusseted and fold around envelopes accommodate larger products while occupying a smaller planform area. In some cases, because the gusseted envelopes are formed with expandable side pleats, they can even replace small boxes as the packaging medium for a particular product. State of the art gusseted envelopes, produced by conventional envelope making methods have been available only in single piece form, only with pleats at the side and then only at significantly higher cost than comparable conventional envelopes. While flat pouch style envelopes have become available in continuous form tractor feed formats, gusseted and fold around envelopes have not. Also, the availability of gusseted envelopes is erratic because of the specialized machinery and techniques involved in fabricating the gusseted sides. Increased cost, a lack of a continuous form format, and regional unavailability have limited the appeal of gusseted envelopes to both manufacturing and direct mailing concerns. These same firms have been frustrated in their attempts to automate their packaging, printing and loading processes when a gusseted envelope design is needed for a particular application.

The gusseted envelope has the advantage of placing the stress created by the object residing within the envelope against the side and optional bottom pleats, rather than against a glued seam. The pleated gusset creates a "bellows" effect in the envelope, causing the perimeter, highly stressed areas to expand so as to reduce stress, thereby eliminating the problems of puckering, reduced opening size, and reduced seam strength.

A similar situation exists in box industry. Current designs of noncorrugated boxes used in the shipment of small parts are available only in single piece format. They are commonly referred to as either "folding" or "set up" boxes. Folding boxes are preformed, glued, and perforated by the box manufacturer. When used by the parts manufacturer, they are opened into full position by simultaneously squeezing against opposing sides of the box. This causes two flaps located in the bottom of the box to lock. Set up boxes, as the name implies, are completely set up by the box manufacturer before they are shipped. No assembly is required by the parts manufacturer. However, this design is considerably more costly to manufacture and ship, since the majority of the box shipment is by airplane. Not surprisingly, there already exists a large body of art which is directed to the making and erecting of boxes and envelopes. A brief summary of automated envelope and box making devices can be provided with reference to the following patented devices.

For example, U.S. Pat. No. 1,297,748, issued to Streeper, discloses the use of a form or mandrel around which a box is created.

U.S. Pat. No. 2,512,382, issued to Ringler, discloses another mandrel around which a flat blank is manipulated to form an interlocking, self supporting box structure.

In order to fold paper in a moving web, state of the art devices have traditionally relied on "plow folders." Similar in design to farm plows that "turn over" the earth, plow folders remain permanently fixed on the press and literally turn paper around. Plow folders are passive in design and have serious drawbacks. The first disadvantage is the generation of heat. Understandably, paper passing at high speeds through a plow folder generates a large amount of heat as well as wear. In addition, the plow folder places stress on the moving web, thereby increasing web tensions and creating potential stretching or breaking problems. Further, plow folders are not adjustable. Each new size of fold demands a separate folder. Nor does the plow folder design work well with multiple folds or pleats as are required in a gusseted design envelope. Finally, the frictional wear present in a plow folder creates additional web registration problems.

U.S. Pat. No. 4,915,679, issued to Gotou describes a process in which a multi-layered bag made from synthetic resinous film is pleated and joined to a kraft paper substrate. Gotou uses a combination of both plow and rotary folding devices. Gotou does not contemplate the severing and subsequent placement of a gusseted piece onto another web. Such an operation would require the pleating device to actually crease the web material so that it retains its pleating and shape once severed from the web. Without this permanent crease, the pleats would expand immediately after being severed from the web.

Gotou uses a stationary guide to deform and rotate the web material into a subsequent guide. Gotou is essentially a plow folder which generates a great deal of friction and heat and is susceptible to rapid wear. To counteract the web stresses caused by heat and friction, stationary plow folders are generally manufactured with wide gaps between the flair members and the remainder of the guide assembly. These wide gaps result in both low tolerance folding and radiused corners, rather than a tight crease. Tight tolerance plow folders are rarely used for long production requirements because they demand a tight fit between the flare and the guide members. This tight fit only magnifies the friction and heat problems inherent in such devices. Tight tolerance plow folders tend to jam more often and result in web stretching. Also, tight tolerance plow folders cannot handle a wide variety of web material thicknesses and must be manufactured for only a specific material thickness.

Gotou utilizes disk shaped flared members and forms the pleats having radiused corners in successive operations. The disadvantage of the Gotou method becomes apparent when operating a web at high tension. Web tension, such as experienced on an envelope press, will distort the partially formed folds produced by the Gotou multiple step process. Gotou does not address the problems of web stretching in between his roller folders.

An alternative design for creating a folding motion is to utilize an air bearing approach such as is used in a web reversal unit. However, air bearings are limited to a single fold per bar and are usually used to form large folds, such as in newspapers. The registration problems associated with web reverse units can also be a common problem with air bearing folders.

Some boxes or envelopes cannot withstand the demands placed on them without the use of some sort of adhesive. U.S. Pat. No. 3,626,819 discloses the use of a mandrel to form a box from a blank upon which an adhesive has been selectively applied.

U.S. Pat. No. 3,192,837, issued to Hoyrup et al., discloses a device in which the mandrel itself is heated so as to activate a heat sealable impregnated blank during the box forming process.

Another problem encountered in using a mandrel to form a box or envelope is the securing of the box to the mandrel during the temporary forming operation. U.S. Pat. No. 3,191,508, issued to Beamish, addresses the problem of box/mandrel contact by the use of vacuum ports within the mandrel die. The vacuum pressure permits the mandrel to grip the box during formation and allows rapid release of the box or envelope when the forming operation is completed.

The next step in the box envelope making art has been to attempt to integrate the various box forming operations into a single automated device. U.S. Pat. No. 3,635,129 discloses a machine for forming trays which incorporates a mandrel, hot melt adhesive, and vacuum ports within the mandrel to control manipulation of the blank stock.

U.S. Pat. No. 3,648,605, issued to Hottendorf, discloses a box making machine utilizing a mandrel, hot melt adhesive, and a vacuum. Similarly, U.S. Pat. No. 3,800,681, issued to Corderoy, discloses an automated device for fabricating cartons, which accomplishes a variety of folding operations with the assistance of mandrels, hot melt adhesives and vacuum ports.

An additional problem existing in the box making art has been the actual filling of a box during or immediately after the box fabrication step. U.S. Pat. No. 1,983,323, issued to Stokes, discloses a multiple step box making process including the step of filling the completed box with the desired product.

Another problem encountered in the box making art is registering or synchronizing a continuous web during the manufacturing process so that the box will be formed accurately and will receive printed information consistently on the box surface. U.S. Pat. No. 2,214,593, issued to Mustin et al., discloses the use of ink marks along the perimeter of the web which may be sensed by a photoelectric assembly.

U.S. Pat. No. 2,706,944, issued to Claff et al., discloses a machine for making blank boxes which incorporates the use of guide marks to a dummy web at predetermined spaced intervals in order to obtain a printed box blank.

U.S. Pat. No. 2,985,990, issued to Waite et al., discloses a web registration system using a series of apertures along the perimeter of the web material.

U.S. Pat. No. 3,185,046, issued to Gross, discloses the use of registration slots to position a blank accurately during the box forming process.

State of the art devices used to superimpose a piece part onto another substrate have utilized both "patching" units and "pick and place" units. Patching units are commonly used in the envelope trade to apply transparent "windows" to the inside of business envelopes. The patching unit cuts a predetermined length of "window" material from a continuous roll. Since exact window placement is of little consequence in envelopes, patching units are not well suited to the strict placement tolerances of gusseted envelopes. Also, most window envelope "patching" is done in sheet form, rather than on a high speed moving web.

Pick and place units, on the other hand, are designed to remove precut pressure sensitive materials from a silicone liner, and apply them to a moving web. Pick and place units are far more accurate than patching units, but require a drastic reduction in web speed. In addition, pick and place units are geared to the press, so they too have registration problems if the web is not in total synchronization with the finishing tools. Current state of the art patching and pick and place units neither monitor nor automatically adjust their operation in response to varying web registration. For example, if the web shifts, as is common during a press run, the press operator must either manually or, byway of an electrically controlled servo motor, move a splined worm gear either forward or backwards on the main drive shaft of the press. The exact amount of gear movement required to bring the patching and pick and place unit back into registration with the main web is speculative, depending solely on the experience and judgement of the press operator.

Thus, neither patching nor pick and place units can constantly monitor and then automatically advance or retard their operation as can the current invention. Driven by stepper motor and controlled by motion control logic, the nip and anvil roller of the current invention can momentarily increase or decrease its rate of rotation in order to "catch-up" or "fall back" to meet the changing state of the main web before transferring the piece part to the positioning roller and eventually the main web.

Patching and pick and place units can also become out of register with the main web because of gear wear and gear lash. Gear wear can result in a reduced diameter gear and thus, continuing to operate a patching or pick and place unit with worn gears will result in stack-up errors, where each additional piece part placed onto the moving web will be more and more out of register. Coupled with the problems resulting from web shift, gear wear can make registration all but unattainable. Gearing the pick and place unit to the press also dictates that the repeat cycling be fixed to a specific repeat length. The same is true regarding the registration of press printing stations and die-cutting stations.

Current flexographic presses require printing plates to be adhesively or magnetically mounted to a geared printing cylinder. The circumference of the printing cylinder and finishing dies must exactly match the repeat length of the desired finished printed piece. If, for example, the printed piece has a finished length of 3½ inches, and the press utilizes a ⅛ inch circular pitch gearing system, the printing cylinder and dies must each be 28 teeth, or any number equally divisible by 28. Thus, the plate cylinder with mounted plate transfers an ink pattern of 3½ inches in length to the moving web. Since the circumference of the 28 tooth plate cylinder is exactly 3½ inches, the plate is required to repeat the same ink pattern every 3½ inches. The same is true with the die repeat requirements.

The state of the art of flexographic printing press design requires that all print cylinders, dies, and nip rollers utilize gear drive trains. Therefore, geared print cylinders and dies must rotate at the speed of the press. To continue the above example, the above mentioned printing plate cannot, under the current technology, transfer a 3½ inch pattern of ink to the web, lift off of the web, reduce its rate of rotation, skip the next 11 inch portion of web material, regain its original rate of speed, drop down to the moving web and then print another 3½ inch pattern of ink upon the web.

In state of the art gear presses, because the cylinders and dies theoretically rotate at the same rate as the web, the above task would require a 116 tooth (14.5 inch circumference) print cylinder and die. The print cylinder and die would be manufactured with a 3½ inch area of "live" matter and 11 inches of blank, wasted plate and tool steel, a significant underutilization of expensive material.

More important than the waste factor however, is the problem of maintaining web registration on a geared press. Even the most elementary training materials for press operators, such as *Flexography Principles and Practice, 3d Edition* (Copyright 1980, Flexographic Technical Association, Inc. 95 West 19 th Street, Huntington Station, N.Y. 11746) contain various passages warning of the potential for press misregistration:

"In order for registration to hold during the run, the proper tension must be set and maintained throughout the run. This is accomplished by adjusting the various tensions on the unwind, rewind, and nip rolls." (p. 28, col. 2 emphasis added)

"Each color station has its own impression cylinder, and each station is driven through a gear train. It is very important that each gear in the gear train is manufactured to close tolerances, especially the tooth to tooth dimension since misregister can occur due to the inaccuracies of the driving gears. Since a number of gears are involved, it is possible that the error in only one gear can be magnified, causing the print register or print repeat to shift." (p. 76, col. 2 emphasis added)

"Unwind tension control is necessary to print in good register. This is especially true on stack press equipment and just as true in respect to repeat variations on central impression cylinder presses." (p. 60, col. 1 emphasis added)

"... overcoming core shaft inertia and gearing friction loads may take away all of the brake's sensitivity so it cannot control the web tension properly. Further, if the press speed is high and the core shaft and brake gearing have a high inertia value, as the roll decreases the brake may be turned to a zero setting and the tension value in the web can still be too high, thereby stretching the web in order to overcome high inertia value." (p. 60, col. 2 emphasis added)

It is important to note that this educational material not only informs the reader that web tension is critical to registration, but that gear tooth mesh tolerance and gearing friction loads also may have a detrimental impact on web registration. This warning takes on added significance when one considers the large number of gears on a typical printing press.

Not mentioned in the educational materials, but well known to those skilled in the art, is the problem of accurately determining the proper nip roller pressure to apply as the driving force to the web. Insufficient nip roller pressure results in web slippage and web shift, while excessive nip roller pressure deforms the nip roller, causing deflection and accelerated feed as the pliable nip roller covering resumes it former shape subsequent to compression.

Nip roll contact area varies with changes in the amount of pressure applied to the nip roller. For example, when under moderate pressure, a nip roller on a typical seven inch narrow web flexographic press, with average durometer value of ninety will contact an area of the web approximately one eighth of an inch by seven inches. That is a small contact area when considering the countervailing forces being exerted by the unwind and rewind rolls and explains why webs can slip and shift. The press operator can increase the nip roller pressure to obtain more contact area in an effort to stop slippage. Additional pressure applied to the nip roller can result in a contact area as much as one half inch by seven inches. However, the added contact area resulting from increase nip roller pressure does not come without substantial cost.

The additional pressure ultimately results in less contact area and significant nip roller expenses. This is because boosting nip roller pressures causes roller deflection. Roller deflection results in less contact area. And less contact area results in additional accelerated nip roller wear. Nip roller deflection is analogous to underinflated automobile tires. Underinflated tires have less tire to road contact area because the car's full weight is carried by the tire's outer edges, causing the center area of the tread to deflect away from the road. In nip rollers, high pressure applied to the roller's journal ends, causes the center of the roller to deflect away from the web. Thus, the nip roller has even less web contact area and just as with underinflated tires, high nip roll pressure causes premature wear, heat, and delamination resulting in unreliable web feed and excessive replacement costs.

High nip roller pressures also result in the accelerated feed of web material. At high pressures, the nip roller presses against the web and the opposing rotating roller, thereby compressing the roller's pliable outer covering. As the nip roller completes its rotation away from the midpoint of contact with the web, but while the nip roller is still in contact with the web, the pliable outer covering expands. The expansion actually powers the web at an accelerating rate of advancement which upsets web tensions.

The goal of the press operator is to adjust nip roller tension to the minimum amount required to achieve reliable web feed. However, since nip rollers are designed to pull material from the feed roll, and full feed rolls are quite heavy, a minimum nip roller tension setting will result in slippage when pulling material from a full feed roll. In actual operation, the press operator is constantly adjusting unwind and rewind tensions, nip roller tensions, plate to plate registration, and plate to die registration.

Some newer press designs have incorporated optical sensing devices that automatically track and adjust plate to plate printing discrepancies by way of monitoring printing registration marks in the margin of the web. These highly automated registration systems are expensive, available only on high end press models, and generally are not available for retrofit to existing press equipment. Numerous attempts have been made to provide for more exacting registration and feeding of web fed printing presses and imprinting devices.

The Indramat Division of The Rexroth Corporation, 255 Mittel Drive, Wood Dale, Ill. 60191 manufactures and sells digital intelligent AC servo drive motors for electronic line shafting applications and motion control software and electronics. FIG. 37 is a line art reproduction of FIG. 2 from an Indramat sales brochure no. IAE 74180 Rev A 09/93 entitled "Converting/printing machine with hybrid drive configuration," and depicts the state of the prior art relative to Indramat's approach to motion control on a converting/printing machine. As is typical of recent attempts to adapt motion control to existing gear type presses, Indramat shows in FIG. 37 a retrofit application where the infeed station 610 and printing sections 601 and 602 of a converting/printing machine are driven by one conventional main drive shaft 603 which is powered by motor 604 by way of drive belt 605. The finishing operations of die cutting station 606 and folding station 607 are driven by the company's intelligent servo motors 608 and 609. Indramat servo motors accept positioning signals from the motion control logic 611 and report back to the motion control logic 611 on the exact positioning of the servo motor shafts of servo motors 608 and 609. A position sensor 610 attached to the main drive shaft 603 provides a reference signal to the motion control logic 611 indicating the relative position of the printing press. The motion control logic 611 instructs the die cutting 608 and folding 609 servo motors to rotate, advance, or retard in direct relation to the position feedback sensor 610 attached to the main driveshaft 603.

In a departure from a hybrid approach of combining gear and servo technology, Indramat also offers sectionalized servo drives controlled by motion control logic, wherein each printing and web movement device is driven by an intelligent servo motor controlled by motion control logic, totally eliminating the need for a main drive motor, drive belt and main drive shaft. Each station is sectionalized, containing its own servo drive motor which both accepts and transmits positioning signals to and from the motion control logic.

Referring now to FIG. 38, which is a line art reproduction of FIG. 3 from an Indramat sales brochure no. IAE 74180 Rev A 09/93 entitled "Converting/printing machine with sectionalized drives," we see a depiction of a converting/printing machine controlled entirely by computer. Motion control logic 613–622 receives commands from computer 612. Thus, coordinated commands from computer 612 instruct each motion control logic 613–622 to direct each servo motor 628–632 to rotate, advance, and retard at a rate determined by the computer 612. Feedback positioning data is also generated by each servo motor 628–632 to provide monitoring capabilities to computer 612.

U.S. Pat. No. 5,050,812, issued to Mueller, discloses an envelope making machine containing register maintaining devices wherein pull rolls pull web material from a feed roll and maintain tension on said web by means of dancer rolls and pressure rollers. Proper feed rates are maintained by varying the rotation of an overfeeding clutch bearing. Dancer rolls are well known in the art and serve as either shock absorbers to take up slack in a web, or as active devices to force a web to advance or retard.

U.S. Pat. No. 5,016,182, issued to Bergland, et. al., discloses another method of register control by employing a dancer roll arrangement with a meter (nip) roll to pull the web material from a feed roll. The meter roll has an encoder (pulse generator) attached to its shaft, the encoder providing pulse signals to control the impression cylinder. The meter roll is driven by a variable ratio transmission attached to a servo motor power source by gears. Dancer rolls are employed to absorb web shocks. Bergland does not address any rewind tensioning issues because the final envelope product is sheeted from the end of the press into individual units, eliminating the need for rewind.

U.S. Pat. No. 4,984,458, issued to Montgomery, discloses a method of detecting printed register marks upon the web by way of photo optical sensing devices. Said sensing devices provide reference signals to a web tensioning device which provides a high pressure stream of air against the web and simultaneously applies power to variable clutch devices attached to the print cylinders.

U.S. Pat. No. 4,955,265, issued to Nakagawa, discloses a method of detecting printed or punched marks in the web by way of an optical sensor. A Hall Effect magnetic device attached to the end of a cutting cylinder provides reference pulses to the control logic, said control logic merging print location reference signals and cutting cylinder reference signals and transmitting appropriate "advance" or "retard" commands to a compensating roller, said compensating roller acting like a dancer roller to force an "advance" or "retard" condition upon said web.

U.S. Pat. No. 4,949,891, issued to Yamashita, provides register means by way of two separate gearing paths, an electromagnetic clutch and photoelectric tube, said photoelectric tube sensing printed marks on the back side of the web.

U.S. Pat. No. 4,913,049, issued to Sainio, discloses a process of using Bernoulli effect air techniques to diminish the "flutter" on a high speed web, said flutter disrupting the process of optically sensing printed register marks previously placed by ink methods upon said web. The invention utilizes the reference signals from optical sensors to vary the rate of air flow against the web to control varying rates of flutter.

U.S. Pat. No. 4,896,605, issued to Schroder, discloses a registration method by which a pulse generator is mechanically attached to a folding jaw cylinder. In addition, four brightness detecting sensors are permanently affixed to the printing press to monitor four distinctly separate zone groups. Said sensors establish a brightness value for each zone and transmit reference signals to the logic control circuitry, said logic control circuitry comparing said signals to the incoming pulse signals from the folding jaw cylinder. Web "advance" or "retard" commands are transmitted by said logic in the form of an increased or reduced voltage supply to a driving servo motor.

U.S. Pat. No. 4,892,426, issued to Steele, discloses a method of monitoring paper movement in printing devices such as cash registers and calculators. The invention employs rollers which engage the paper web along a flat surface, said rollers rotating about an axis at a rate matching the rate of paper flow into and out of the printer. Pulse generating devices are affixed to the shafts of said rollers, thereby providing a stream of input and output data to the control logic, where said data is compared and adjustments made accordingly.

U.S. Pat. No. 4,786,353, issued to Templeton, discloses a method of monitoring and controlling temperature on a plastic film web to control both repeat length and width variations.

U.S. Pat. No. 4,737,904, issued to Ominato, discloses a registration method where servo driven feed rollers with an attached pulse generator pulls web material from the feed roll. Pulses from said pulse generator merge at the control logic with reference signals obtained from photo optical sensors, said optical sensors detecting printed marks on the web. Advance or retard signals are sent to the feed roll servo motor to correct registration deficiencies.

U.S. Pat. No. 4,719,575, issued to Gnuechtel, provides print registration by analyzing areas of contrast changes on the printed web. Upon analyzing data from optical sensors used to detect the contrast areas, the control logic transmits commands to the press drive unit to "advance" or "retard" the web.

U.S. Pat. No. 4,533,269, issued to Pou, discloses a method for providing incremental advance of a supply web in a price marking tag and label device.

U.S. Pat. No. 4,552,608, issued to Hoffmann, discloses a computer controlled labeling machine wherein an encoder is affixed to the shaft of a cutter, said encoder providing reference signals to the feed roll stepper motor to feed the web stock. The control logic also receives reference signals from photo optical sensors, said sensors detecting printed register marks on the web of labels. Upon proper commands, the label web is cut into individual units. No rewind device is provided.

U.S. Pat. No. 4,541,335, issued to Tokuno, discloses a registration method wherein plate cylinders are driven by stepper motors, said stepper motors receiving pulse signals from the press control logic. Photo optical sensors detect "print start" marks on the web, thereby providing reference signals to the print cylinder stepper motors and the pull roller stepper motors, said pull rollers tending to pull web material from the feed roll. Two printing plates are mounted on each cylinder with a physical gap between said plates. Two impression cylinders are provided at each print station. Each print cylinder rotates to transfer the inked image from one plate to the web. A photo optical sensor detects "end print" register mark and the control logic commands the print cylinder to retard its rate of rotation while a predetermined length of the web passes without restriction through the gap between the mounted plates. The print cylinder, having received the appropriate "resume" commands from the control logic, returns to its original rate of rotation, thereby transferring the inked image from the second plate on the web currently entering the second said impression cylinder.

U.S. Pat. No. 4,528,630, issued to Sargent, provides print registration by way of printing a repeating series of marks on the web. Photo optical sensors detect the distance between said marks and provide reference signals to the control logic. Said control logic transmits "advance" or "retard" commands to servo motors affixed to the drive shaft gears at each print station.

U.S. Pat. No. 4,484,522, issued to Simeth, discloses a registration system utilizing photo optical sensors and printed register marks on the web. Reference signals from said sensors enable the control logic to issue "advance" or "retard" commands to motors affixed to the print cylinders.

U.S. Pat. No. 4,361,260, issued to Hanlan, discloses a method of press registration wherein three reference sensors are located on the press at the drive motor, the print and die station and at a location along the web. Said web location sensor detects printed indicia and transmits pulse signals to the control logic. Said logic transmits "advance" or "retard" commands to the drive motor.

U.S. Pat. No. 4,351,461, issued to Carlsson, discloses a registration method wherein a driver mechanism engages with transversely preformed crease lines such that the web is advanced a predetermined amount with each rotation of the driver mechanism.

U.S. Pat. No. 4,318,176, issued to Stratton, discloses a method of registration utilizing photo optical sensors to provide reference signals to the control logic. Said sensors detect "live" areas of print in the body of printing on the web. The control logic establishes a window of reference signals enabling the logic to modify web "advance" or "retard".

U.S. Pat. No. 4,316,566, issued to Arleth, discloses a registration method for a pouch making machine wherein an encoder is affixed to sealer bar lands, thereby providing reference signals to control logic to aid in providing stepping pulses to the pull roll stepper motor.

U.S. Pat. No. 4,264,957, issued to Pautzke, discloses a method of maintaining web registration wherein a reference signal from sensors detecting printed marks on the web provides data to the control logic, said control logic issuing commands to a compensating device to vary the distance between adjoining print stations.

U.S. Pat. No. 4,214,524, issued to Corse, discloses a method of press registration wherein the control logic, having received appropriate pulse signals from photo optic sensors detecting printed marks, issues commands to web tensioning devices to increase or decrease the amount of pressure exerted upon said web.

U.S. Pat. No. 4,081,944, issued to Sjostrand, discloses a method for reading printed marks on a web by use of photo optical sensors.

U.S. Pat. No. 3,899,946, issued to Niepmann, discloses a method of feeding a print referenced web by way of a web feeding drum of different circumference than the print repeat length.

U.S. Pat. No. 3,806,012, issued to Roch, discloses a method of maintaining print registration by mechanically altering the tension or elongation of the web between print stations.

U.S. Pat. No. 3,774,016, issued to Sterns, discloses a method of registration wherein sensors detect discrepancies between printed marks on the web and severing cuts placed thereon.

The focus of the prior art has been to address the issue of registering one printing plate to another, and each printing plate to die cutting tools and other finishing tools. However, due to serious deficiencies in the current methods of delivering and removing a steady and reliable flow of web material to and from the print and die stations, proper registration is much more difficult to achieve than merely monitoring and controlling the position of each printing plate or finishing tool, on to another.

Many current press designs incorporate the use of a main drive shaft which is geared to print cylinders, nip rollers, dies, and other finishing tools. The disadvantages and registration problems associated with geared systems are previously described. Other press designs utilize stepper or servo motors to vary the rate of rotation at nip, print, and die stations. However, these designs accept web movement as a given. Rather than attempt to control web movement, the prior art has concentrated on registering printing and die operations by advancing or retarding individual shaft rotations to "catch" the moving target area.

The concept of accepting web movement as a given is the key fault in the Indramat approach described previously. The key differences between the Indramat approach and the present invention is that the present invention attempts to minimize web movement. The present invention incorporates a multitude of monitors and controls to eliminate the major causes of web movement. In addition, since there will always be some minor web movement through the press due to stretch and moisture accumulation, the present invention provides for constant monitoring of the web at each print station to allow the motion control logic to correct for these minor web variances when they occur. This is in sharp contrast to the Indramat system which monitors and controls only the position of the individual servo motors without regard to exact web position or movement. Web stretch and lateral web movement caused by air pressure fluctuations in a turn bar assembly cannot be detected by the Indramat system and will proceed unnoticed by the motion control logic. Thus, each printing station may operate in total registration one to another, while being out of synchronization with the web. This is a serious deficiency.

Even more important than gear deficiencies described previously, is the fact that the prior art consistently provides for the pulling of web material from the feed roll. In addition, rewind rolls of material are driven independently of the main press drive shaft.

Press material delivery systems are designed to pull material off the feed roll at the speed of the press. Unfortunately, inertial and geometric forces make this a difficult, if not impossible task, without added braking, tension, and dancer systems.

Unwind roll braking systems described in the prior art typically employ a follower roller attached to an arm. The follower roller rides along the circumference of the feed roll and travels in an arc toward the core as the roll size is diminished. The follower arm pivot is attached to either variable resistance or encoder sensors that provide a steady stream of input signals to the braking system. Thus, the follower roller assembly constantly monitors the roll radius and thereby the outer diameter and circumference of the feed roll and, at full roll radius, signals the braking system to provide maximum hold back tension to counteract the pulling force of the press material delivery system and maintain proper press web tension. Without such hold back, the steady pulling forces of the press material delivery system (pull or nip rolls) would overcome the high inertial forces of a full feed roll, and being of large diameter and significant weight, the full feed roll would dispense large amounts of material at an accelerating rate of flow into the press. If press speed were to be rapidly decreased, the feed roll would continue to free wheel, unwinding unneeded material onto the pressroom floor, until such time as friction and inertial forces bring the feed roll to rest. Thus, the purpose of feed roll braking at full diameter is to prevent excess material from unwinding from the roll and upsetting web tension.

A significant problem with current state of the art press feed systems is evidenced when an out of round feed roll is placed in the unwind station. The out of round condition acts like a cam to force the follower roll in repeated thrusts away from the feed roll, instantly applying additional hold back, only to remove it a second later. No tension control system can cope with such tremendous shocks to the web. Web shifts are drastic, most often resulting in the scrapping of Otherwise good feed rolls.

In a further example of the inherent deficiencies of monitoring only the servo motor shaft positioning of the infeed roll, even an intelligent servo motor, depicted by the Indramat system, driving an out of round infeed roll of web material would be unable to detect the varying rates of material payout due to the out of round condition. Instructing the infeed roll servo motor to rotate at a fixed rate of rotation, while ignoring an out of round condition, will result in erratic feed rates. Thus, web tension would vary with each rotation of the infeed roll causing registration problems from print station to print station.

The infeed servo motor is similarly unable to detect a change in wind tension of the infeed roll. The number of turns of material on an infeed roll varies directly with the wind tension of that roll. Wind tension is rarely consistent throughout a roll. These variances within the feed roll cannot be detected by monitoring shaft position systems.

The irony is that out of round conditions are most apt to occur in large diameter rolls, due to their weight and the increased occurrence of dropping such large rolls. It is just such large rolls that result in the most dramatic shock jolts to the web when the follower encounters the out of round portion of the roll. No suitable solution has been presented for this problem by the state of the art.

As the feed roll diminishes in radius, the follower roller descends toward the core, signaling the brake to apply a rapidly diminishing amount of hold back, until such point, at approximately one fourth of initial roll size, where hold back is discontinued entirely. Hold back is not necessary at smaller feed roll diameters because each rotation of the reduced circumference feed roll delivers a steadily decreasing length of material to the press. The challenge then, as the feed roll decreases in radius, is to enable the feed roll to rotate at a rate fast enough to dispense an adequate amount of material to the press. At high press speeds, such high feed rotations are almost impossible to achieve.

The Indramat system described previously provides for a an infeed unwind system that is powered by a servo motor, thus eliminating the problems of pulling material off of the infeed roll. The underlying assumption in this approach is that if infeed roll revolutions can be monitored and controlled by the infeed servo motor shaft, dancer rolls can take up any minor variations in infeed roll payout.

As previously described, infeed material delivery problems such as out of round rolls, varying tensions within the infeed roll, and material stretch all contribute to web movement. Meanwhile, at the opposite end of the printing press, the same inertial and geometric forces affect the process of rewinding the finished printed and die cut material onto a final roll. While the press is operating, and the full feed roll is receiving maximum hold back forces by the braking system on the feed end of the press, the rewind, being at minimum diameter, is at maximum torque.

FIG. 1*b* depicts a rewind tension chart that demonstrates the preferred rewind methods and suggested taper tension rates for different types of web materials. One should note that the chart prefers that all papers, (such as those used to manufacture envelopes and business forms) and laminates are to be rewound at a tapering rate ranging from 1.5:1 to 2:1. Thus, for a taper of 2:1, the start of the rewind roll begins at a winding tension of two pounds tension per linear inch and proceeds to taper off to one pound per linear inch as the roll diameter increases, exactly the opposite of the feed roll.

At the beginning of the press run, the full unwind roll is receiving maximum hold back force while, at the same time, the rewind roll is attempting to advance the rewind roll at maximum force. These opposing forces exert maximum stress on the web, resulting in stretching and breaking. Add to these preexisting stresses the stretching resulting from moisture accumulation the web may acquire by way of the printing process, i.e., ink, ink solvents, drying agents, and plate wetting agents such as water and alcohol, etc. As the printing operation progresses toward mid roll, the feed roll hold back diminishes and the rewind advance begins to taper off. Thus, overall web tension decreases and whatever adjustments the press operator made at the outset of the printing operation are now rendered obsolete. Therefore, the press is in need of additional adjustments.

As the feed roll nears the core, the feed roll, being of small diameter and low weight, exhibits little, if any, inertial force. In addition, the drastically reduced roll diameter results in a condition where the feed roll can no longer rotate at a speed fast enough to dispense a proper length of material to the press. These two factors cause increasing web tension at the feed end of the press, the press being starved for material feed. The press operator can reduce the speed of the press, but that would disrupt registration, requiring added adjustments at a point when material is about to run out but this is not a wise operational choice.

At the rewind end of the press, the rewind roll is reaching maximum diameter and receiving a minimum amount of advance tension. In a conventional printing press, neither feed roll hold back, nor rewind advance is controlled by the main drive shaft of the press. Unwind braking systems operate independently of the main drive shaft. Rewind systems incorporate a motor independent of the main press motor, the rate of rotation of which is a ratio higher than that of the main motor of the press. Thus, the rewind motor is always rotating faster than the rate of the press. The rewind rate of rotation and taper therefore is controlled by either a mechanical or air controlled clutch device.

In summary, extreme tension is present at the beginning of the printing process, with the feed roll preferring a state of hold back, while the rewind roll prefers a state of advance. The printing process proceeds to a neutral state at midroll, where hold back and rewind advance are approximately equal. Then, toward the end of the feed roll, press conditions shift to a state where a disproportionate amount of tension is at the front end of the press at the feed roll. If the opposing forces of unwind hold back and rewind advance were exactly equal, only web tension would be affected by the state of roll diameter, not that of web position.

In practice, however, hold back and rewind tensions are never exactly equal. When unwind hold back is greater than rewind advance, the web shifts toward the feed roll. If the press operator applies an excess amount of air pressure to the rewind clutch assembly, the opposite condition will occur, where rewind advance exceeds the unwind hold back, resulting in the web shifting toward the rewind end of the press. The press operator can either decrease unwind hold back or increase rewind advance to correct such web shift. However, as the operation proceeds toward the end of the feed roll, even the total elimination of unwind hold back cannot stop the increasing tensions and the ultimate shift of the web toward the unwind end of the press. The press operator can increase the amount of rewind advance to counteract the web shift. But such an increase in rewind advance tends to apply greater tension to the previously loosened circumferential windings on the rewind roll, resulting in the lateral shifting of such windings in a cone shaped pattern known to those skilled in the art as "telescoping". If the press operator does not immediately detect such telescoping, the rewind material will shift laterally to the point where it will disengage from the circumference of the rewind roll. Once disengaged from the outer circumference of the rewind roll, the printed and die cut material will proceed to wrap itself around the rewind driving shaft adjacent to the full roll of rewound material, thereby starting a second roll of rewound material and again changing web tensions.

Thus, as mentioned earlier, press tensions, and therefore web positioning, are constantly changing. Current press designs incorporate a tension transducer to detect changing web tensions and a dancer assembly to absorb the web shock from changing web tensions, or, in the alternative, to force a change in web tensions or web positioning. Other attempts have been made to monitor and control infeed roll shaft rotation. However, none of these devices correct the cause of web shifts, namely, high initial inertial roll forces requiring hold back, low inertial forces at roll end, material starvation at the end of the feed roll, out of round conditions, varying tensions within the infeed roll, material stretch, and tapering rewind tensions. Nor can the current state of the art as demonstrated by the Indramat system, by monitoring and controlling only servo shaft position, detect movements within the web or tension changes within the press. The mechanical gear systems only deal with the problems caused by the independent systems of unwind hold back and rewind advance, and their relationship to the material delivery systems of the press.

In addition to the stretching forces inflicted onto a web by the infeed and rewind inconsistencies already discussed, web movement variations are influenced by speed of the web, the amount of inks and coatings applied to the web and the accompanying absorptive capacity of the web material in conjunction with the relative humidity of the production environment, rate of solvent evaporation from the inks and coatings, and temperature and air velocity of the drying devices.

Web materials have a tendency to accumulate and retain heat through each successive pass through a print station dryer, resulting in web stretch and breakage. The same is true with each additional application of printing inks and coatings. Thus, it is especially important to monitor the temperature and moisture content of the moving web after the web material passes through each drying station.

Commonly accepted practice in the industry is to apply heated air to the web after each print or coating operation. It is also common industry practice to increase the temperature of this heated air to speed drying. In many cases this practice is counter productive. As previously mentioned, heat buildup on the web is common. After the web has been heated beyond optimal temperature, additional heat applications will actually prevent ink adhesion to the web.

This phenomenon occurs because the superheated web material immediately vaporizes the ink or coating solvents as they first come in contact with the web. The first film of ink or coating that comes in contact with the heated web dries immediately, before it has a chance to penetrate the web, and in effect seals the web against further ink or coating penetration. In addition, the drying solvents that were present in this initial ink or coating film application are driven away from the web into the still liquid layer above it, adding to the solvent content of the remaining ink or coating material resting on the surface of the web.

At this point press operators routinely raise the temperature of the heated air even further to force solvent evaporation from this stagnant ink or coating film. This is also counter productive. With web heat forcing solvents away from the web, and additional heat air being directed at the opposite film edge of the ink or coating, the result is rapid solvent evaporation from the outer film edge of the ink or coating. This causes the ink or coating to "skin over" forming a liquid center between the skin and the web.

An analogy to this phenomenon can be found when painting a house. If paint is applied on a dry sunny day to superheated wood siding, the bottom layer of paint dries almost on contact with the surface. If the painter were then to use a heated air dryer on the outer surface of the paint, it would "skin over", leaving a still liquid center trapped in between the wood siding and the surface skin. This is the reason paint manufacturers do not recommend applying paint onto a heated surface.

By monitoring web temperature and moisture content after each pass through the dryer that present invention can eliminate web superheating by varying the temperature and air velocity present in each dryer. In fact, successive dryers can actually cool the web to prevent overheating. If increased air temperatures do not result in lowered moisture content readings, increased air velocity is indicated in order to break the solvent vapor barrier away from the ink or coating surface.

Two sided printing is not easily accomplished on a flexographic, rotary letterpress, or rotogravure printing press. Unlike an offset printing press, where ink is "offset" from a lithographic plate to a smooth rubber "blanket" and then to the web, flexographic and rotary letterpress technologies transfer ink directly from the raised surfaces of the printing plate to the web material. Thus, each printing plate must have stable support (impression cylinder) under the web material in order to achieve a satisfactory ink transfer. Rotogravure is similar in its transfer of ink directly from the plate to the sheet or web material. However, in rotogravure printing the ink is deposited into recesses in the printing cylinder, rather than on raised surfaces. The rotogravure printing process requires the web to be squeezed into the printing cylinder at higher pressures in order to transfer the ink to the web.

Two sided printing without a turn bar is common in the offset printing industry. In a "perfecting" offset printing press two printing stations, top and bottom, are arranged opposing each other, most often in a vertical arrangement, with the web flowing between the two opposing print stations. As ink is transferred (offset) from plate to blanket and then to the web, the web is actually squeezed between two smooth blankets, each rotating at the same speed, each acting as the other's impression cylinder.

The same method cannot be utilized in flexographic, rotary letterpress, or rotogravure because the plate is the vehicle that transfers the ink to the web and the plate contains either raised or recessed areas. Squeezing the web between two opposing flexographic plates, for example, would result in web creases, ink distortions, and web perforation. The state of the art for flexographic, rotary letterpress, and rotogravure printing presses has mandated the use of a turn around device to rotate the web radially 180°. The disadvantages to the turn around device have been discussed previously.

U.S. Pat. No. 4,917,010, issued to Gilham describes a franking machine with a variable and fixed date thermal printhead. The described thermal printer is designed with heating elements assembled in line arrays to print either characters, numerals or a combination of both. The Gilham printer as described cannot print graphics or bar codes. Gilham discloses a matrix of dot printing elements individually selectable to print a desired character or other pattern. Gilham's provision of arrays of elements either in the form of strips or dots for printing characters provides a speed advantage over a thermal printer using a single thermal strip for selectively printing a row of dots and which requires sequential operation to build up the characters.

The key to producing sharp, aesthetically pleasing and scannable variable information is to use a thermal head with the highest possible density of microdot heaters. The optional thermal heater, as described by Gilham, would be prohibitively expensive, being on the order of $5,000–10,000. As a practical matter, the standard array that Gilham mentions is not a workable design for imprinting envelopes with variable information, bar codes and graphics. Gilham makes no mention of a feed device for either the envelopes or the film ribbon. Gilham's design, as disclosed, would not work with envelopes or boxes as disclosed in the present invention. Most thermal printers advance the substrate material by way of a drive roller mounted directly under the print head. The drive roller is driven by a stepper motor that is interconnected to a printer "driver" circuit board. The main disadvantage to such an approach is that the device wastes a length of thermal ribbon equal to the length of the length of the driven substrate material. If the envelope is for example, 6" in length, such a device will consume 6" of ribbon.

Other "ribbon saver" devices are available from suppliers such as Zebra Technologies Corporation, 3455 Commercial Avenue, Northbrook, Ill. 60062. In these ribbon saving devices a friction feed rubber roller doubles as both an impression cylinder and a drive roller. This roller is raised toward the thermal print head during print operations and rotates to advance both the business form and the thermal transfer ribbon. As the business form approaches areas where printing is not desired, the rubber impression cylinder is lowered, while a second friction feed device, located downstream from the print station area, powers the advancement of the form while the thermal transfer ribbon advance is halted.

In an alternative design, only one friction feed roller is employed, located downstream from the print station. The impression cylinder, located directly below the thermal print head, is merely raised and lowered according to the print, no print commands from the device's logic. In this design, the thermal transfer ribbon is advanced by relying on the adhesive characteristics of ink itself. Because the surface tension of this wax like ink is relatively low, feed tension of the thermal ribbon must also be low, or stretching of the thermal ribbon will result. This is a significant disadvantage.

Another disadvantage of relying on surface tension to advance the thermal ribbon is the high incidence of creased thermal ribbon resulting in broken printed characters and skewed printing. This is caused when the graphics or text being printed by the thermal print head are not balanced across the business form.

For example, a 4" wide form is advanced through a thermal print head, with heavy ink coverage being applied along a 1" edge of the form. As the thermal ink along this edge is melted onto the form by the heaters in the thermal print head, the ribbon tends to adhere to the form only in that area. However, the 3" of ribbon adjacent to this 1" band of printing is not adhesively attached to the form. When the rubber impression roller is lowered to halt ribbon advancement, and the form alone is advanced by the friction roller downstream from the print area, the thermal ribbon travels along with the form for a short distance until it reaches the peel bar, where it is detached from the form. During that small amount of travel, a disproportionate amount of stress is applied to the 1" area where printing was accomplished. No pulling action is generated in the 3" area where no printing was performed. Thus, the ribbon tends to wrinkle due to the uneven stress.

Both of the aforementioned designs rely on friction feed advance mechanisms. These mechanisms have inherent drawbacks due to their tendency to slip. Slippage can be due to several factors. First, coated paper stocks tend, with sustained use, to impart a calendared finish to the rubber friction feed roller, causing slippage. Second, since thermal transfer ribbon actually transfers a wax like ink substance to the top of the business form, and since heat is the vehicle that accomplishes this transfer, insufficient cooling may result in a buildup of thermal transfer ink onto the rubber friction feed roller. This not only can result in slippage, but in ink transfer from the roller to the face of subsequent forms, causing ghosting images.

An additional problem encountered in the box making field when using a continuous machine moving at relatively high speed is a method of synchronizing or at least accounting for variations in line speed at various points during the manufacturing process.

U.S. Pat. No. 5,041,070, issued to Blaser, discloses the use of a magnetic sensor, a stepper motor, and a logic control unit. However, Blaser uses these devices to feed material on an intermittent basis. The web is fed intermittently through the bag machine with a short dwell period during which the seal bar unit is actuated to seal and sever the web. The Blaser reference does not contemplate continuous web movement. The very nature of Blaser's process prohibits the continuous advancement of the secondary web. For example, the feed rolls are rotated to advance the web a distance equal to the length of the finished bag. Rotation of the feed rolls is thus synchronized with the movement of the seal bar to move the web only within the rest period of the seal bar, that is, with the seal bar in the raised position.

U.S. Pat. No. 4,545,780 discloses a carton erecting apparatus which includes an accumulator area for the preprinted web material.

An additional problem in assembly line envelope addressing and stuffing is the handling of invoices or statements, multiple advertising inserts, and return envelopes and coupons. For example, credit card companies, department stores, business firms, non-profit organizations and those engaged in direct mail response activities have long utilized a method of packing a return response envelope in the same mailing envelope that contains the invoice, monthly statement or direct mail advertisement. As to monthly invoices or statements, it is also common practice to enclose secondary literature to impart knowledge to the receiving party, or to further entice them with advertisements.

To eliminate the tedious task of matching the personalized invoices, statements, or advertisements to a matching pre-addressed mailing envelope, most sending organizations use a window envelope. The personalized matter they send is purposely designed and imprinted in such a manner so that the mailing address aligns with the envelope window when the materials are inserted. The printed materials are also purposely designed so that a portion of the mailed materials containing information such as the recipient's name, address or account number may be detached from the perforations and enclosed in the supplied return envelope to accompany the recipient's payment or order. The return of this personalized payment coupon is essential for the proper crediting of the recipient's account.

The state of the art teaches that the personalized encoding of the return reply envelope is impractical due to the fact that personalized invoices are generated in large batches and stuffed into a window envelope, along with a pre-addressed but not personalized return reply envelope. If the sending organization were to print personalized return reply envelopes, they would then have to exactly match each personalized return reply envelope to its corresponding invoice. Any mistake in the matching process would result in the miscrediting of payments to the wrong accounts. The typical sending organization would not want to take that chance.

When there is only a single return mailing site for payment or order processing, the sending organization often encloses an ordinary style envelope that is pre-printed with the desired return mailing address. The recipient encloses the detached portion of the sender's mailing in the supplied envelope, seals it, affixes postage, and mails it. When the sending organization utilizes multiple return mail acceptance sites, as is most often the case with credit card companies and nationwide department stores, the return envelope is a window style. In that instance, the detached portion is also designed so that the preprinted return mailing address of the nearest regional payment or order processing center aligns with the envelope window.

In order to accurately locate the mailing address within the window area of both the sending and return envelope, the sending organization is usually forced to design the mailing materials to include two distinctly different information panels. One panel contains the recipient's mailing address, while the other detachable panel contains the sender's return address. Due to minimum envelope size requirements by the U.S. Post Office, these two panels most often each correspond to a size of 3½"×the envelope width.

Except for the necessity of locating the mailing address within the envelope window area, there is no other reason for these panels to be so large. Also, for identification purposes, the sending organization usually desires that some part of the original mailing be returned with either the customer's payment or their purchase order, regardless of the style of the return envelope. Ideally, the need for the returned portion can be eliminated entirely.

As postal rates have increased, sending organizations have come under intense pressure to reduce the cost of their mailings, to increase the response rate of their direct mailing advertisements, and to reduce the cost of handling the return payments and orders generated by the original mailing. This has caused sending organizations to utilize every available opportunity to entice their customers to buy, making it commonplace for them to enclose advertising and promotional material with their monthly invoices and statements.

In order to increase the response rates of these mailings, sending organizations have increasingly applied promotional and motivational messages to the front of the envelope. Some sending organizations apply printed pressure sensitive labels containing the message to the front of the envelope, while others actually print the message on the front of the envelopes using conventional envelope printing techniques.

Another cost saving technique available to sending organizations is the discount postage offering of "ZIP+4", available from the U.S. Post Office. To qualify for this discount, sending organizations must include the entire 9 digit zip code in the address portion of the envelope. To ensure more rapid processing and possibly a greater discount in the future, the sending organization can apply the U.S. Post Office "POSTNET" "ZIP+4" bar code along the bottom edge of the envelope. Some sending organizations have availed themselves of the advantages of POSTNET ZIP+4 by bar coding the bottom edge of the invoice, statement, or advertisement address panel and by using an envelope with two windows, one for the alphanumeric address, and a second window along the bottom edge for the ZIP+4 bar code.

Unfortunately double-window envelopes add even more cost to the mailing. And, because automated postal equipment grips the envelope along the delicate windowed bottom edge, wrinkling, tearing, and contents damage can occur. This is a distinct disadvantage because envelope appearance is of prime concern to sending organizations.

Preprinting the bar coded ZIP+4 on a single window envelope is even more troublesome, as it defeats the purpose of using window envelopes in the first place, since it once again requires the sending organization to match the contents to the envelope. Printing the ZIP+4 on the envelope after it has been stuffed would require the sending organization to hand enter the zip code (a time consuming process), scan the human readable zip code showing through the window, or carefully track the order of stuffed envelopes as they enter the bar code printer.

Sending organizations encounter yet another problem when stuffing return envelopes into the mailing envelope along with other printed advertising materials. In many cases the consumer removes the entire contents of the envelope, keeping only the relevant personalized matter and discarding the rest-including the return envelope. Then, when returning a payment check or purchase order, the consumer is forced to provide yet another envelope and hand address it. The random sized envelopes consumers send back must be hand processed upon their receipt by the sending organization. The present invention eliminates the use of loose return reply envelopes and instead provides for the retention and use of the envelope by attaching it directly to the invoice itself. The recipient must physically remove the envelope from the invoice, thus eliminating the discarding of loose return reply envelopes.

In addition to these problems, the environmental consequences of massive direct mailing has required sending organizations to reexamine their use of windowed envelopes and pressure sensitive promotional and address labels. Current paper recycling technologies cannot process envelopes that contain a translucent glassine or clear plastic film window. And, while the current recycling technologies can remove pressure sensitive adhesives from envelopes, the waste sludge that results from such removal poses disposal problems. Sending organizations in the future must employ mailing strategies that consume less paper and use materials that are fully recyclable.

Numerous variations of envelope designs have been developed to address the above-mentioned problems with billings and direct mailings. For example, U.S. Pat. No. 5,169,060, issued to Tighe, et. al, discloses a direct and return mailing unit consisting of a pouch attached to intermediate connected panels of printed matter, such intermediate panels being of lesser longitudinal dimensions than said pouch and one said panel containing a die cut window for address purposes. Upon completion of imprinting, said panels are folded successively upon each previous panel and sealed by adhesive means to said pouch, thus forming a mailing device with open sides. The Tighe invention may be opened using conventional means. However, the improper insertion of the letter opener will sever the flap from the return envelope, rendering it useless.

U.S. Pat. No. 5,161,735, issued to Bendel, discloses a self-contained insert mailer, consisting of three mailer panels, each constructed of five plies of material, wherein the front ply includes image transfer means for transferring an image printed on said front ply to the back ply. The mailer piece is personalized by means of a ribbonless impact printer striking the outermost ply and thereby transferring the personalized data to the relevant inner plies.

U.S. Pat. No. 4,984,733, issued to Dunn, discloses a dual mailer construction intended to accomplish the same dissemination of material that would normally require two or more mailings.

U.S. Pat. No. 4,944,449, and U.S. Pat. No. 4,944,450, both issued to Schmidt, disclose an oversize laser mailer and return envelope, wherein a sheet is folded transversely to form an envelope. The mailer is folded along crease marks and lines of weakness and adhesively assembled subsequent to imprinting.

U.S. Pat. No. 4,934,536, issued to Mills, discloses a series of interconnected tractor-feed envelope pouches, each with an integral pull tab and insert material. In use, the pouch is imprinted in a manner similar to U.S. Pat. No. 5,161,735, wherein a ribbonless impact printer strikes the surface of the outer ply, thereby imparting an image to the inner plies via a carbon or carbonless coating.

U.S. Pat. No. 4,915,287, issued to Yolk, discloses an envelope pouch consisting of three panels and an integral tear-off flap.

U.S. Pat. No. 4,898,322, issued to Coffey et. al., discloses an envelope pouch for use in an automated teller machine consisting of multiple pockets in a single envelope pouch.

U.S. Pat. No. 4,889,278, issued to Steidinger, discloses a printed mailer form, wherein a mailer form is printed and then folded upon itself successively to result in an envelope assembly.

U.S. Pat. No. 4,883,220, issued to Brown, discloses a continuous, partially preprinted, heat sealed envelope pouch for packaging photographic film prior to photofinishing.

U.S. Pat. No. 4,860,945, issued to Breen, discloses a fan-folded envelope pouch with detachable coupon members.

U.S. Pat. No. 4,852,795, issued to Volk, Jr., discloses a mailing cover with reply envelope pouch made from an integral web for insertion into a catalog or magazine.

U.S. Pat. No. 4,852,794, issued to Bennett et al., discloses a direct mail solicitation device consisting of an outer wrapper pouch, a die cut window, an elongated inner sheet and a traditional reply envelope contained therein.

U.S. Pat. No. 4,830,269, issued to Jenkins, discloses a two part mailer with a top opening return envelope pouch, side pull apart opening means on the mailing envelope, die cut window, and an imprintable personalizable inner sheet matching the size of the inner portion of the mailing envelope pouch.

U.S. Pat. No. 4,804,135, issued to Bourbeau, discloses continuous strip envelopes. The Bourbeau invention consists of a web which is die cut with side panels which are to be folded inwardly along fold lines. The next step in the manufacturing process involves folding a back panel upwardly and along a fold line to overlie a front panel and the previously folded side panels. The folding process depicted cannot be accomplished on a traditional web press without substantial modifications, such modifications requiring that the press feed rate be approximately doubled at the finishing end of the press to allow for the feeding of additional material to allow the back panel to be folded onto front panel. The Bourbeau invention does not disclose a requirement for such press modifications, nor does the invention disclose the precise method for performing these successive folding operations on the press, or in the alternative, the requirement that the folding operations are to be performed in separate and subsequent finishing operations.

U.S. Pat. No. 4,776,510, issued to Jenkins, discloses a two part mailer with a mailing envelope pouch containing a glassine window and a traditional return reply envelope adhesively attached to inner printed matter.

U.S. Pat. No. 4,770,337, issued to Leibe, discloses a multiple part business form containing envelope pouches, die cut windows, and personalizable inner matter for imprinting via carbon or carbonless impact methods. The envelope mailing pouch is opened utilizing a side pull tab.

U.S. Pat. No 4,747,535, issued to Haase et al. discloses an envelope assembly wherein the envelope flap is folded onto the face of the mailing pouch. The mailing pouch is formed with by depositing a U shaped pattern of adhesive onto a web in a manner similar to other such pouch designs. Instructions are printed on the pouch face instructing the recipient to grasp a corner pull tab area and lift said flap upwardly and in the direction of a printed directional arrow. The recipient may use the mailing pouch as a return reply vehicle only if the recipient does not mistakenly employ the use of a standard letter opener, in which case the return reply feature is destroyed upon initial opening.

U.S. Pat. No. 4,705,298, issued to Van Malderghem et al., discloses a continuous business form containing a die cut window, a reply envelope and a self imaging web activated by impact printing methods.

U.S. Pat. No. 4,754,915, issued to Steidinger, discloses a mailer form, wherein a single sheet is folded successively, and is openable by a side tear off stub.

U.S. Pat. No. 4,668,211, issued to Lubotta, discloses a method for preparing a returnable self mailer, wherein a single sheet is imprinted and folded upon itself to form an envelope pouch and die cut window.

U.S. Pat. No. 4,651,920, issued to Stenner, discloses a continuous series of panels, wherein said panels are folded transversely to form envelope pouches, in which reply pouch contains a plurality of apertures which allow examination thereof to determine the presence or absence of a particular reply device in a particular pocket.

U.S. Pat. No. 4,632,427, issued to Angus, discloses a combined mailer and return envelope pouch, consisting of die cut address windows and detachable envelope pouch portions. Said envelope mailing pouch is opened by tearing along a longitudinal line of weakness located on the face of said envelope. The inner printed matter is imaged by the use of an impact printing device.

U.S. Pat. No. 4,543,082, issued to Stenner, discloses an envelope wherein panels are folded transversely to form envelope pouches with pockets and apertures, similar to U.S. Pat. No. 4,651,920, also issued to Stenner.

U.S. Pat. No. 4,454,980, issued to Poehler, discloses a return biller envelope book wherein ordinary envelopes are removably affixed to a continuous prefolded web.

U.S. Pat. No. 4,440,341, issued to Pennook, discloses a return envelope mailer consisting of an outer mailing pouch with a side opening pull apart grasping area, and internal informational materials which are the same dimension as the return envelope pouch.

U.S. Pat. No. 4,437,852, issued to Volk, Jr. et. al., discloses a mailer, wherein enclosure sheet(s) containing an adhesively attached return envelope pouch are folded into an outer mailer pouch.

U.S. Pat. No. 4,157,759, issued to Dicker, discloses a continuous mailer with a removable tab portion along the top or bottom edge of the back ply.

U.S. Pat. No. 4,148,430, issued to Drake, discloses a mailing envelope containing personalized inner sheets and a return reply envelope. The outer mailing envelope and the return reply envelope contain die cut windows. The personalized imprinting is accomplished prior to final folding and gluing.

U.S. Pat. No. 4,081,127, issued to Steidinger, discloses a mailer device with an enclosed and separate return reply envelope.

U.S. Pat. No. 4,066,206, issued to Peterson, discloses a continuous envelope assembly. The Peterson invention uses a fold around side design. However, the Peterson invention forms the side fold around feature by way of folding excess material from the face of the envelope/pouch onto the back portion. The Peterson invention entails the waste of material when the envelope is interspaced with business forms. The envelope bottom in the Peterson invention is formed by adhesively attaching the back side onto an adhesive strip. Thus the Peterson invention is a cross between an envelope with full width from side to side, and a pouch which does not have full top to bottom access and must be oversized to allow for its glued seam. The Peterson invention does not disclose the method by which the back side is placed onto a moving web in the exact location required so that the trailing edge is aligned precisely with the adhesive strip.

U.S. Pat. No. 4,011,985, issues to Simson, discloses an advertising device, containing imprinted matter and an integral return reply card or envelope.

Finally, U.S. Pat. No. 3,941,309, issued to Gendron, discloses a combined brochure and return envelope for nonmailing usage, such as a newspaper or handout.

SUMMARY OF THE INVENTION

One embodiment of the present invention is a method permitting the manufacture of envelopes and boxes in continuous form. However, with minor modifications in tooling, the addition of a second pleating web, and different software commands to the motion control logic, the method is capable of producing a continuous form of one, two, or more envelopes interspaced with a single thickness web to serve as an invoice, statement, or promotional printed matter. Optionally, the single thickness web may receive additional plies of printed matter, or manifold carbon or carbonless business forms.

The manufacturing process described herein may also be used to produce business forms containing integral gusseted pockets for the insertion of materials.

The invention also discloses a method by which highly accurate web feed, rewind, tension, positioning, thickness, temperature, and moisture content may be monitored and adjustments to press registration, rate of material delivery, ink dryers and web tension may be accordingly adjusted. In addition, the exact monitoring of web variables and the use of stepper motor or servo motor driven print station cylinders, rather than gear driven, allows the use of two sided printing without the use of a web reverse device.

As energy conservation becomes more important to the profitable operation of a printing plant, more interest must be paid to monitoring the energy efficiency of press drying systems. Especially in multicolor printing presses, where each color station may deposit drastically different amounts of ink, it makes logical sense to monitor the moisture levels of the printed web as it exits from each dryer to determine if less energy can be consumed by the drying process. The present invention makes such provisions.

Provided to the sending organization in either roll or fan folded form, these new business forms and boxes eliminate many of the operational and manufacturing problems described herein.

The sending organization loads the blank or partially printed forms into a computer driven printing device of some sort, i.e. tractor feed laser, thermal transfer, dot matrix, or any other such device capable of imprinting both alphanumeric and bar code information. The mailing envelope is imprinted with the recipient's mailing address and the POSTNET bar code and U.S. Postal Service Facing Identification Mark (F.I.M) bar code. The sending organization may choose to either print their return address themselves, or have that information preprinted at the time of manufacture by the forms supplier. By employing current computer imprinting technology, the sending organization can also imprint a personalized and variable or general promotional message on the front of the mailing envelope.

The form is then advanced through the printing device, and highly accurate registration maintained, by way of the tractor feed holes at the outside margin. The sending organization can imprint all the variable information on the face of the invoice, statement, or advertisement. This variable information can include any combination of graphics or bar codes, as well as alphanumeric data. Subsequent to the imprinting process, the hybrid envelope business form is folded and inserted into the mailing envelope. No other assembly or gluing is necessary.

The mailing envelope is similar to those of a traditional design with a conventional flap located at the top edge of the envelope, openable using a conventional letter opener. No pull strips or tear tabs are provided, therefore no printed instructions are necessary to inform the recipient of the correct opening method.

In the preferred embodiment, the sending organization uses the imprinted scannable code on the envelope to eliminate the need for the recipient to enclose an identifying coupon into the return envelope. However, the invention also provides for a detachable, returnable "coupon" located on the single thickness web for the recipient to enclose in the return envelope. Because the return envelope is not a window style, there is no requirement for the recipient to register the return address within the return envelope. Therefore, if the sending organization prefers the use of identifying return coupons, the coupon need not be as large as traditional coupons. Additionally, since the return envelope is completely formed, there is no need for the recipient to read directions or "assemble" the return envelope.

If the sending organization elects to include a return envelope, the return envelope is imprinted with the return address desired by the sending organization, including the sender's POSTNET and F.I.M. bar codes. Large national sending organizations can imprint the addresses of various regional processing centers, thereby eliminating the need for inventorying supplies of preprinted envelopes. The sending organization can ensure that the reply envelope contains a return address and save the recipient the task of entering said recipient's return address, commonly placed in the upper left hand corner of the return envelope by imprinting such data at the sending organization's location.

Arrangements can also be made to imprint on the back side of the envelopes and on the form portion. This arrangement would further reduce the amount of paper needed to execute the invoicing or advertisement function. Printing on the back side is not done currently due to the difficulty of registering the form to a second computer imprinter. By utilizing the present invention, the sending organization can transport the partially printed forms to a second printer, where the customer's bar code is scanned as said form is next in queue for the second printer. By providing tractor feed holes in the form, the registration problem is thereby eliminated.

Finally, the sending organization can imprint the envelope flap with the recipient's account number, or any other identifying characteristics, by using bar code technology or magnetic character ink recognition (M.I.C.R.) technology. Although current bar codes are nonhuman readable, some sending organizations may elect to print the bar code on the inside of the envelope flap to ensure customer account privacy. In addition to providing for the imprinting of both the front and back side of the envelope flap, the invention also allows the sending organization to imprint a small portion on the inside of the envelope. The bar code or M.I.C.R. can be scanned by a second computer imprinter to identify the account information of the incoming form, thereby enabling the second computer imprinter to imprint the back side of the invoice, statement, etc., with the proper information.

Once the imprinting process is completed, the forms may be finished by one of two methods. The imprinted forms may be fed into a die cutting, folding, stuffing and sealing device. This device trims the tractor feed area from the form and imparts creases and perforations to the form. The return envelope is then tucked into the mailing envelope. At this point, the sending organization can choose to include additional promotional materials by pushing them into the exposed crease, thereby forcing the entire form into the mailing envelope. Prior to final enclosure however, the bottom of the imprintable form is severed from the top of the flap of the mailing envelope. The mailing envelope is then sealed.

An optional finishing method requires that the crease and perforation lines be imparted at the time of manufacture by the forms manufacturer. Then, once imprinted by the sending organization, the forms may be fed into a bursting device prior to the folding and insertion process described above.

Upon return receipt by the sending organization, the bar code or M.I.C.R. can be scanned and all the relevant customer data can be brought to the computer screen. This feature can entirely eliminate the need for detachable return coupons. After scanning the back flap for customer data, the sending organization opens the reply envelope, removes the check or purchase order and the transaction is complete. This procedure eliminates the need to hand enter customer account numbers, as well as the wasteful disposal of coupons.

The manufacturing methods described herein may also be modified to apply "pockets" to business forms for a variety of uses. One such example, disclosed in the specification, is that of an optical laboratory "pull-sheet". Currently, optical laboratories provide a printed sheet to inventory personnel detailing the relevant lens and frame specifications. The lenses and frames are removed from inventory and placed into a work tray along with the printed sheet. At each stage of lens processing, the laboratory personnel must double check to ensure that they are machining the proper lens. The business form of the present invention would eliminate all such double checking. The business form itself serves the useful function of holding all relevant parts in the proper place. Many other such uses of "pocketed" business forms exist.

The current invention combines the advantages of tractor feed envelopes with the advantages of continuous interconnected tractor feed business forms. Thus the present invention is a hybrid envelope/business form that can be supplied in either roll or fan folded format. The configuration is easily variable in construction by way of minor tooling changes and software command changes. The hybrid envelope/business form lends itself well to computer imprinting and bar coding and automatic loading/stuffing techniques.

When used as a vehicle for invoicing, billing statements, loan payments, or any other such installment correspondence that requires a return response, the hybrid envelope/business form allows the sending organization to eliminate window envelopes and pressure sensitive address and promotional labels, imprint POSTNET information on the front of the mailing envelope, imprint customer bar codes, optical character recognition (O.C.R.), and magnetic ink character recognition (M.I.C.R.) information anywhere on the envelope, drastically reduce the amount of paper used, eliminate the return coupon, eliminate hand entry of customer account information, and speed up the entry of payments and purchase orders. The invention also allows the sending organizations to continue the desired practice of enclosing additional advertising materials with the personalized matter. When used as a vehicle for direct mail advertisements, the invention combines all the advantages and flexibility of personalizing the printed matter, with the advantages and flexibility of imprinting personalized promotional messages and customer address information, including POSTNET, on the front of the mailing envelope. The invention also allows direct mail advertisers to eliminate window envelopes and pressure sensitive address and promotional labels, to imprint customer bar codes, optical character recognition (O.C.R.), and magnetic ink character recognition (M.I.C.R.) information anywhere on the envelope, reduce the amount of paper used, eliminate hand entry of customer account information, and speed up the entry of customer purchase orders.

When used as a business form, the invention allows the customer to order the form with pockets attached at any location. The customer can then imprint any variable information on the form and on the individual pockets.

The current invention also combines the advantages of conventional and gusseted envelopes, and folding and set up boxes, with the advantages of continuous interconnected forms and tractor feed. The envelope and box can be supplied either in roll form or fan folded. The present invention lends itself well to computer imprinting and automatic loading techniques.

When used as a box making device, the apparatus of the present invention includes a supply of continuous tractor fed cardboard or paper blanks which are fed to a printer. At the printer station, a thermal printer imprints a bar code and other information on the cardboard blanks. The continuous blanks go to a queue area in order to compensate for any unevenness in the line speed. The continuous blanks are die cut to individual blanks of box size. Next, a forming mandrel is brought down and a box is formed. Finally, the product is inserted into the box.

In conventional thermal printer in-line processes, the film ribbon for the thermal printer is always utilized along the entire length of the blank on which it is printed. This results in substantial waste of the film ribbon. The present invention employs sensors, which are controlled by computer, to drop the impression cylinder below the print head when the printer is over an area of the blank which is not to be printed. One of the reasons this has not been done in the past is because of the difficulty in achieving sufficient registration accuracy. The use of tractor feed along the edge of the blanks as utilized in the present invention enables improved registration so as to provide accurate control of those areas of the blanks on which printing is to be accomplished.

When used as an envelope imprinter and loader, the apparatus is similar to the above description with respect to the imprinting mechanism. As in the above description, the continuous form envelopes are routed into a queue area in order to compensate for any unevenness in the line speed. The blanks are die cut to individual envelope size. Next a vacuum device opens the envelope and the envelope is ready for product insertion. Then a product is inserted into the envelope. The envelope is pivoted upwards into an eccentric forming mandrel, causing the flap portion of the envelope to fold downwardly. Finally, the envelope is pushed down a declining ramp that incorporates another forming mandrel to complete the flap closure.

The current invention also discloses a programmable logic controlled variable drive system that constantly monitors web location and web tension and accurately powers the unwind feed roll to provide material at a rate exactly consistent with the speed of the press while controlling the rate of rotation and tension of the rewind roll. The present invention automatically adjusts plate to plate and plate to die registration, monitors web thickness before and after die and lamination procedures in order to adjust plate to web clearances and calculates the exact circumference of both unwind and rewind rolls. The system also detects web stretch and web breaks at any location on the web path, detects web movement caused by changes in air pressure in web reverse devices and adjusts web movement to correct for such deviations, monitors web temperature and moisture levels and automatically adjusts the temperature and rate of flow of ink dryer devices to save energy and prevent lateral and transversal web stretching and movement, while providing a steady flow of relevant information to the press operator. Such a system would be a highly preferred method to the current art. The current invention not only describes such a registration system, but the design is such that it is far lower in cost than those available from press manufacturers and most importantly can be added, in whole or in part, retroactively to almost any printing press.

Thus, the present invention is a hybrid device, incorporating the simplicity and economy of full roll input, along with a variation on the pick and place technology, that is, one that automatically adjusts to changing web registration.

BRIEF DESCRIPTION OF THE DRAWINGS

FIG. 1B is a chart showing the recommended ratios of rewind taper tensions for a range of web stock materials;

FIG. 3*b* is a pictorial representation of the pleating rollers depicted in FIG. 3*a;*

FIG. 3*c* is a side elevation of the creasing rollers as depicted in FIG. 3*a;*

FIG. 3*d* is a perspective view of the creasing rollers as depicted in FIGS. 3*a* and 3*c;*

DESCRIPTION OF THE PREFERRED EMBODIMENTS

Figure 1:
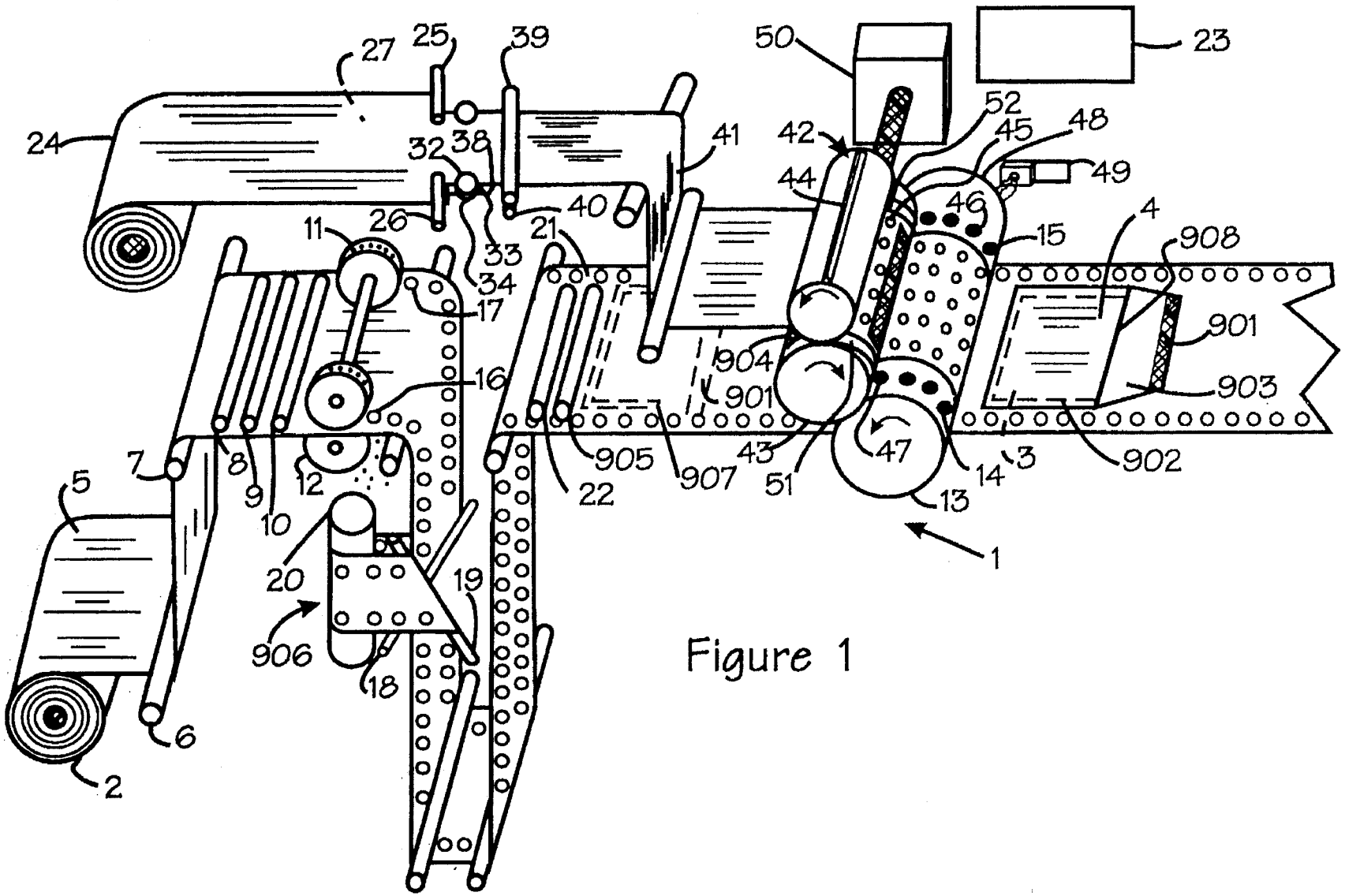
FIG. 1 is a pictorial view of an apparatus to accomplish the manufacturing process of the present invention when forming gusseted and fold over envelopes.

The gusseted envelope and variations thereof can be produced on a variety of web fed printing presses, including offset, flexographic and rotogravure. The press 1 as depicted in FIG. 1 represents a generic press with finishing capabilities, the press being of conventional design regarding web feed and rewind, tension control, print to print registration and cylinder rotation. Press 1 utilizes only a partial embodiment of the current invention's method for web feed, monitoring and registration. FIG. 1 shows only those features of the present invention essential to an understanding of its operation and does not show several important state of the art operational details well known to those skilled in the art, such as, for example, those features required to accomplish printing, inking, or ink drying during the printing process.

As seen in FIG. 1, web supply roll 2 is converted into the face 3 of envelope 4. Web 2 may include any of a variety of raw sheet materials, including coated stocks and conventional roll papers, as well as a bleached board stock, The stock 5 which makes up web 2 follows a path along web guides 6 and 7 and through consecutive print stations 8, 9 and 10 as well as past a suitable drying apparatus (not shown).

The stock 5 then passes through a male 11 and female 12 tractor feed punch unit, such as is disclosed in U.S. Pat. No. 3,828,632, issued to Grano and assigned to Tools and Production, Inc. Traditional presses utilize tractor feed as a finishing step only, that is, the tractor feed holes are provided either for use by the end user as a means to accurately transport the material through the pin feed drives of computer imprinters, or for use during final assembly in registering several individual sheets or the web subsequent to the conversion process. Prior to the current method of manufacture and, when applied at the end of the conversion process, they have served no purpose in the manufacturing process. In contrast to the traditional use of tractor feed holes, the present invention places the tractor feed punch at the beginning of the press operations, thereby permitting the tractor feed holes to serve the vital purpose of providing a reference for registration during critical finishing operations occurring at the opposite end of the printing press, or throughout the entire manufacturing process and shown in FIG. 1A. In applications other than the production of the current tractor feed form, wherein tractor feed is not desired, an alternate method of registration is provided and disclosed herein.

Since the gusseted envelope design incorporates one, two, or more separate pieces that must be placed onto the moving web during construction, it is imperative that registration be precise when placing the gusset(s) onto the moving web. Yet state of the art web fed presses are not ideally suited to the tight registration tolerances needed for this type of finishing operation. Traditionally, second web application, die cutting, scoring and perforating operations have been conducted with tolerances on the order of plus or minus 1/16 of an inch. The present invention, by use of either the tractor feed arrangement or the star wheel arrangement, drastically improves those tolerances, to the order of plus or minus 0.001 of an inch, making the placement of the gusset piece quite accurate.

As mentioned earlier, prior to entering the tractor feed unit 11 and 12, the stock 5 passes through print stations 8, 9 and 10. In this partial embodiment, the printing plates 8, 9 and 10 place a registration mark (not shown) in the margin of stock 5. These printed marks provide visual registration to the press operator to enable them to register the printing marks to tractor feed punch unit 11 and 12. Subsequent to passing through tractor feed unit 11 and 12, the stock 5 will pass over a sensing drum 13, the sensing drum having protruding pins 14, 15 etc., thereby providing positive web engagement which enables near perfect registration.

Once the web stock 5 has been punched with tractor feed holes 16, 17 etc., the web stock 5 proceeds through turn bars 18, 19 and 20, which together serve as what is commonly referred to as a web reverse unit 906. Web reverse units are commercially available from Mark Andy Inc., 18081 Chesterfield Airport Road, P.O. Box 1023, Chesterfield, Mo. 63017.

The web reverse unit 906 is but one of many weak links in a state of the art registration process. In order for a web reverse unit to function properly, the 45° angle cross bars 18 and 19 blow compressed air into the region between the bars 18 and 19 and the stock 5 to form a floating "bearing". Any variation of air pressure, press speed, web tension, or web humidity can cause a change in registration as perceived by the subsequently encountered finishing tools 22, 905, and 42. Each cross bar 18 and 19 can contribute to this effect, thereby doubling the potential for erroneous registration.

State of the art web reverse units often gain or lose up to one half of an inch in web registration due to changing air pressure. Thus, the registration of web 5 in relation to the finishing tools 22, 905, and 42 is constantly changing. In the partial embodiment depicted in FIG. 1, the present invention utilizes a state of the art web reversal unit, but due to the presence of the tractor feed mechanism, provisions are thereby made to maintain the integrity of the registration process.

After the stock 5 has been turned by the web reverse unit such that the printed side 3 is facing downwardly on the press, patterns of adhesive 901 and 902 may be applied to the rear or upper side 21 of the stock 5. The adhesive application can be accomplished by any of three methods, namely, rotary silk screening, solid pattern coating or ribbon coating. Equipment to perform any of these three operations can be obtained from Graco, Inc., Post Office Box 1441, Minneapolis, Minn. 55440. Products performing these functions are sold under the "Microprint" trademark. Any of these three methods is capable of placing a hot melt, pressure sensitive, water based, or remoistenable dry gum adhesive within a predetermined area of the stock 5.

The adhesive application units 22 and 905 are controlled by impulses from the motion control circuitry 23. Motion control circuitry, translator devices, and stepper motors are commercially available and can be obtained from Robbins & Meyers, Motor & Control Systems Division, 1600 2 nd Street South, Hopkins, Minn. 55343. The motion control circuitry 23 constantly monitors the web's registration status, insuring that the adhesive 901 and 907 is accurately applied.

The making and application of the gusset will now be described. The present invention, rather than providing a passive means of folding, as is the case with both the air bearings and plow folders described earlier, utilizes a method that is interactive with the moving web. As is seen in FIGS. 1 and 3, the gusset web 24 is supplied along a separate path and from a supply distinct from stock material 5. One should note that the gusset web material 24 may be a different material from stock material 5. For example, web material 24 may be of clear plastic, while stock material 5 is paper or paperboard.

The web 24 is fed continuously, but at varying rates. Such varying rates differ from the rate of supply of web 5 for two distinctly different reasons. First, web 24 is fed at varying rates in reference to web 5 in order to allow web 24 to adjust its function either faster or slower, in response to the constantly changing position of web 5, such that the placement of part 45, which adhesively attaches to finished part 4, will be in perfect registration with web 5 and any subsequent finishing tools 22, 905, and 42.

The web shifts and resulting registration problems associated with web reverse devices, geared drive trains, and varying feed and rewind roll tensionings have been explained previously. When air pressure to the web reverse device fluctuates, web 5 will either advance or retard in relation to web 24 and the finishing tools 22, 905, and 42. For example, in the event of decreased air pressure at web reverse device 906, web 5, being advanced by an outfeed nip roller (not shown), said outfeed nip roller tending to advance web 5 to take up the slack produced by the decreased air pressure at web reverse device 906, will be out of register with web 24. Therefore, web 24 must quickly accelerate from its previous rate, and then only for a short period of time, in order to reacquire the proper registration positioning with respect to web 5. Upon reacquiring proper registration positioning with web 5, web 24 can resume its previous rate. The rapid acceleration and ultimate resumption of the previous rate of web 24 is determined by the positioning roller 13 engaged with web 5, sensor 49, motion control logic 23, and the stepper motor (not shown) driving pleating nip rollers 39, 40. To continue the example, web 24 must slow from its previous rate when the air pressure increases in web reverse device 906, causing web 5 to retard in relation to web 24. Similar differing and variable retard and advance movements of web 24 must take place when web 5 advances or retards due to gear friction, or feed and rewind roll tensioning changes. Thus, the rate of web 24 is differing and variable in relation to web 5.

The second reason for the differing and variable rate of web 24 in relation to the rate of web 5 is to provide for the additional payout of web 24 material to form either a single or double bottom pleated gusset as will be explained next.

The pleating and gusseting process will now be explained. First, a set of rubber rollers 25 and 26 are mounted at a forty five degree angle to moving web 24 so as to form a ninety degree crease in the moving web 24. Mounted on the underside 27 of web 24, and maintaining constant pressure against the rubber rollers 25 and 26, are tapered bearings 28 and 29 spinning on cantilevered mountings (not shown). This design eliminates the friction, heat, tension and web breakage problems associated with state of the art plow folders, and the registration problems created by air bearings. The relative positions of crease rollers 25 and 26, as well as tapered bearings 28 and 29 is completely adjustable, thereby requiring only one set of rollers and bearings per press apparatus 1.

After the ninety degree crease 30, 31 has been placed in moving web 24, the web 24 passes through guide 132, after which it encounters a series of interlocking diamond shaped rollers such as, for example, rollers 32, 33, 34, 35, 36, and 37, which form pleats 38. The pleats 38 may be of any particular amplitude, angularity or number depending on the number and characteristics of the pleating rollers 32–37.

A final "nip" or pleat gathering roller 39 gathers the pleats 38 towards the main web 24 and presses the web 24, which becomes web 41, against pressure roller 40. The rate of rotation of pleat gathering rollers 39 is controlled by motion control logic 23. This compression of web 24 tends to "set" the folds making up pleats 38.

Figure 11:
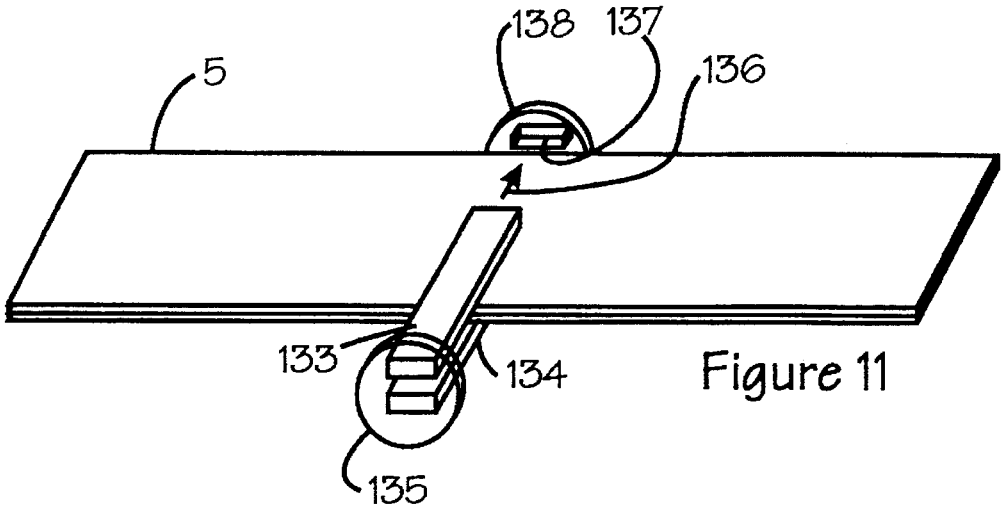
FIG. 11 is a perspective view of a bottom gusset forming apparatus shown in a first configuration which may be incorporated into the present invention.
Figure 12:
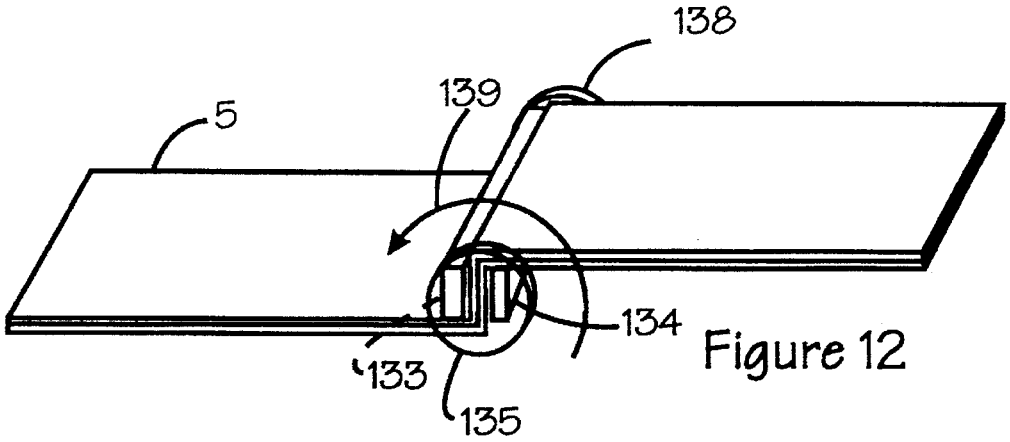
FIG. 12 is a perspective view of the apparatus of FIG. 11 shown in a second configuration.
Figure 13:
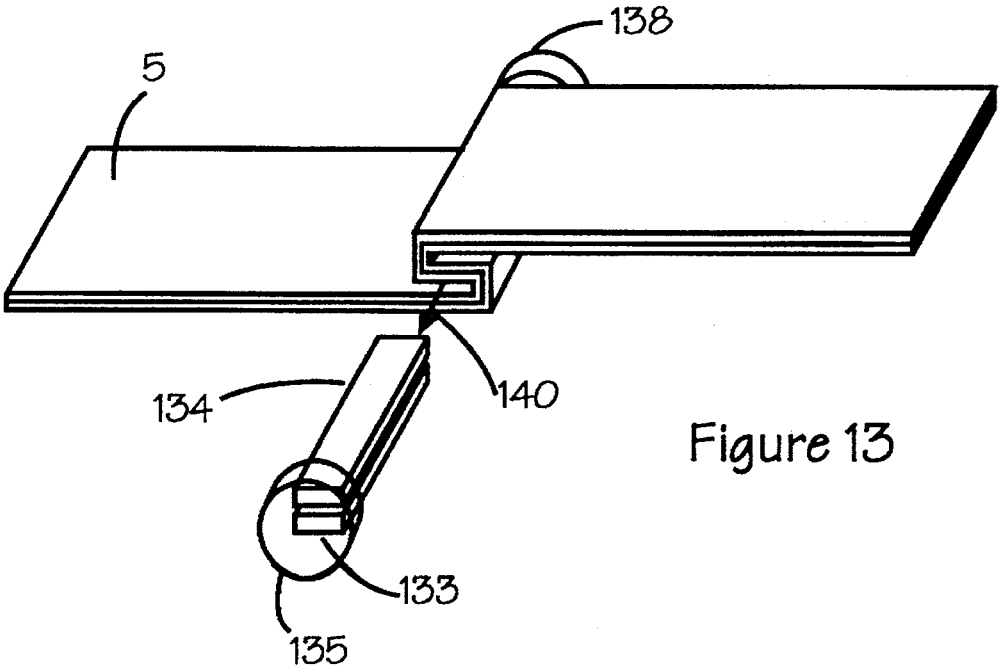
FIG. 13 is a perspective view of the apparatus of FIG. 11 shown in a third configuration.

Referring now to FIGS. 11–13, an apparatus and method of making a bottom gusset is discussed. An upper pleating member 133 and a lower pleating member 134 are cooperatively connected to a rotating disk 135 which may be rotated by a suitable mechanism (not shown). In FIG. 11, the pleating members 133 and 134 are being advanced so as to surround moving stock 24, the pleating members traveling in the direction 136. As shown, pleating member 133 may cooperatively mate with a suitable orifice 137 located in passive disk 138 on the opposite side of web 24 from disk 135. This arrangement thereby gives the pleating members 133 and 134 some mechanical stability rather than being cantilevered only from disk 135.

As seen in FIG. 12, disk 135 and 138 begin to rotate in the direction shown by arrow 139. Prior to the initiation of rotation by pleating members 133 and 134, nip rollers 39 and 40, being driven by a stepper motor (not shown) and upon commands from the motion control logic 23, will momentarily increase the rate of feed of web 24 to allow pleating members 133 and 134 to properly form the bottom gusset in what will eventually become part 45. For example, if pleating members 133 and 134 are one half inch in width, then the double bottom gusset in gusseted part 45 will require an extra inch of material to be advanced during the rotation of pleating members 133 and 134. Thus, the extra material required to form the gusset is derived by way of a momentary acceleration in the rate of web 24. Therefore, during the brief moment required to form the bottom gusset, web 24 is advancing at a faster rate than does web 5.

Finally, as seen in FIG. 13, the pleating members 133 and 134 have rotated a full one hundred eighty degrees, and are withdrawn from stock material 24 in the direction 140. This operation is periodically repeated at spaced intervals so as to create the gusseted arrangement shown. Referring again to FIG. 1, activation of the control circuitry 23 causes the pleat gathering rollers 39 and 40 to advance the prepleated web 41 to rotary die cut station 42, such advancement being driven by a stepper motor (not shown) connected to control circuitry 23. The anvil roll 43, situated under the rotary die 44, is equipped with vacuum ports 904, etc., that are designed to hold the cut part 45 in place and then transfer it to the positioning roller 13.

The vacuum ports 46 and 47, for example, on the positioning roller 13 translate the part 45 from the anvil roller 43 and roll it into position on the main web 5. To prevent the side pleats and bottom gusset from unfolding after translating part 45 from anvil roller 43 to positioning roller 13 and prior to placing part 45 onto web 5, semi circular guide rails (not shown) exert slight pressure against said side pleats and bottom gusset, urging said pleats and bottom gusset against positioning roller 13 and maintaining compression. Upon leading edge 908 coming in contact with web 5, said vacuum is terminated and pressurized air is moved through ports 46, 47, etc. to ensure prompt release of part 45 from roller 13. Vacuum termination and air pressurization to ports 46, 47, etc., is provided by ordinary solenoid valves (not shown) and controlled by motion control logic 23. The end of positioning roller 13 contains an interactive registration device 48.

One such interactive method is the use of steel lobes (not shown) that interact with a magnetic pick up position sensor 49. The steel lobes alter a magnetic field in the sensing reluctor 49, thereby producing a signal to motion control logic 23. This method is commonly used in automobile ignition systems to denote engine crankshaft position and relay that information to the electronic control device. Several alternative methods may be used to detect the position of positioning roller 13. Hall Effect devices utilize a rotor with steel windows which pass across a semiconductor resulting in either a switch open or switch closed circuit. Hall Effect switches and sensing reluctors are regularly used in the automotive industry to provide reference signals from crankshafts and brake rotors to control logic in ignition systems and antilock braking systems (ABS). Hall Effect sensors may be obtained from Phillips Technologies, Airpax Instruments, Cheshire Industrial Park, Cheshire, Conn. 06410.

Another highly accurate registration method employs the use of a circular disk with slits, or apertures. This apertured disk is mounted to the end of the monitored shaft and rotates at the same rate of speed as the shaft. The apertured disk interrupts the flow of light emitted by the light source of a photointerrupter and those signals are transmitted to the control logic 23. Such disks and photointerrupters are commonly used in a computer mouse and trackball and are referred to as optical encoders. Optical encoders provide the same type of signal to motion control logic 23 as does the Hall Effect sensor. Optical encoders are available commercially from Renco Encoders Incorporated, 26 Cormoar Drive, Coleta, Calif. 93117.

Any of the above mentioned methods can be utilized to mount on the end of roller 13 to provide reference signals to the control logic 23. It is anticipated that future developments in the field of reference tracking devices will result in new and more precise technologies. The actual method by which control logic 23 receives reference signals is irrelevant. The only requirement is that control logic 23 receives a constant stream of reference signals denoting, at all times, the exact location of positioning roller 13.

The impulses from the web location sensor 49 are used to calculate timing signals for the stepper motor 50 used to power die 44, the stepper motor (not shown) that drives pleat gathering roller 39, as well as to provide timing signals to adhesive application units 22 and 907.

The die station 42 operates at a different speed from the speed of moving web 5. Therefore, the die station 42 can cut parts of varying lengths by software commands, with automatic registration. This, of course, is a distinct advantage over the state of the art devices which require gear changes, reregistration, and exact repeat lengths. In fact, by utilizing reference signals, motion control logic, and stepper motors, the manufacturing method of the present invention eliminates the need for matching gear repeat lengths entirely. Two grooves 51 and 52 are cut into the anvil roller 43 to permit the pins 14, 15 etc. on the positioning roller 13 to rotate without interference.

The final phase of the gusseted envelope manufacturing process relates to finishing the product to customer specifications. The product can be rolled or fan folded (not shown) using conventional fan fold equipment.

The apparatus of the present invention can easily produce gusseted envelopes with integral liners. For example, optical lens manufacturers require the addition of a scratch resistant lint free liner material. The apparatus can also manufacture gusseted envelopes with the flap oriented in either direction. The apparatus of the present invention can be adapted to add gusseted envelopes to standard business forms. Also, the apparatus of the present invention is capable of producing any shape of gusset such as "V" cut, "C" cut, or "U" cut. Finally, the apparatus of the present invention can be adapted to print on both sides of the front web and one side of the gusset web.

Figure 2:
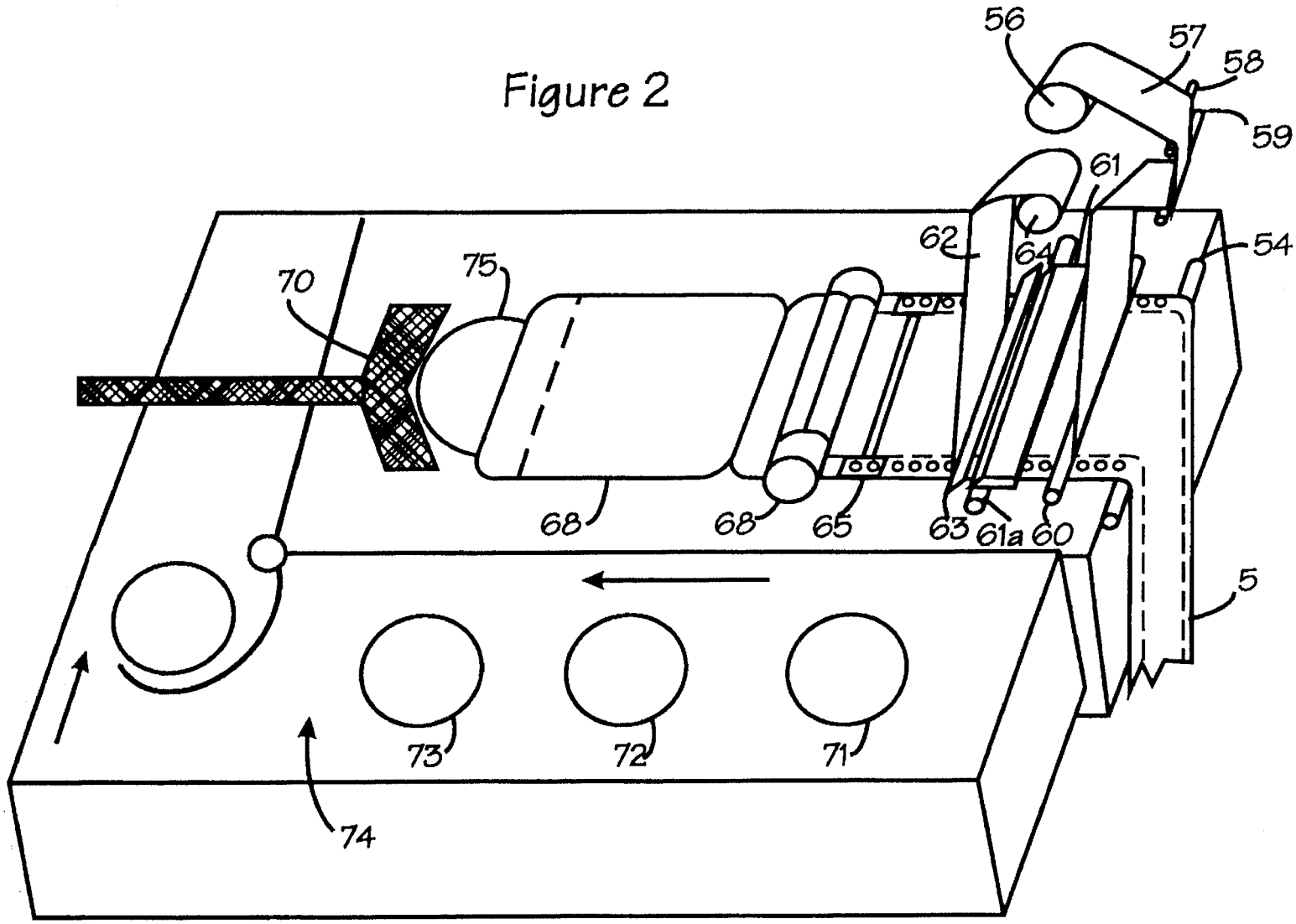
FIG. 2 is a pictorial diagram of a gusseted and fold over envelope imprinter and loader which may be used in conjunction with the apparatus of FIG. 1.
Figure 10:
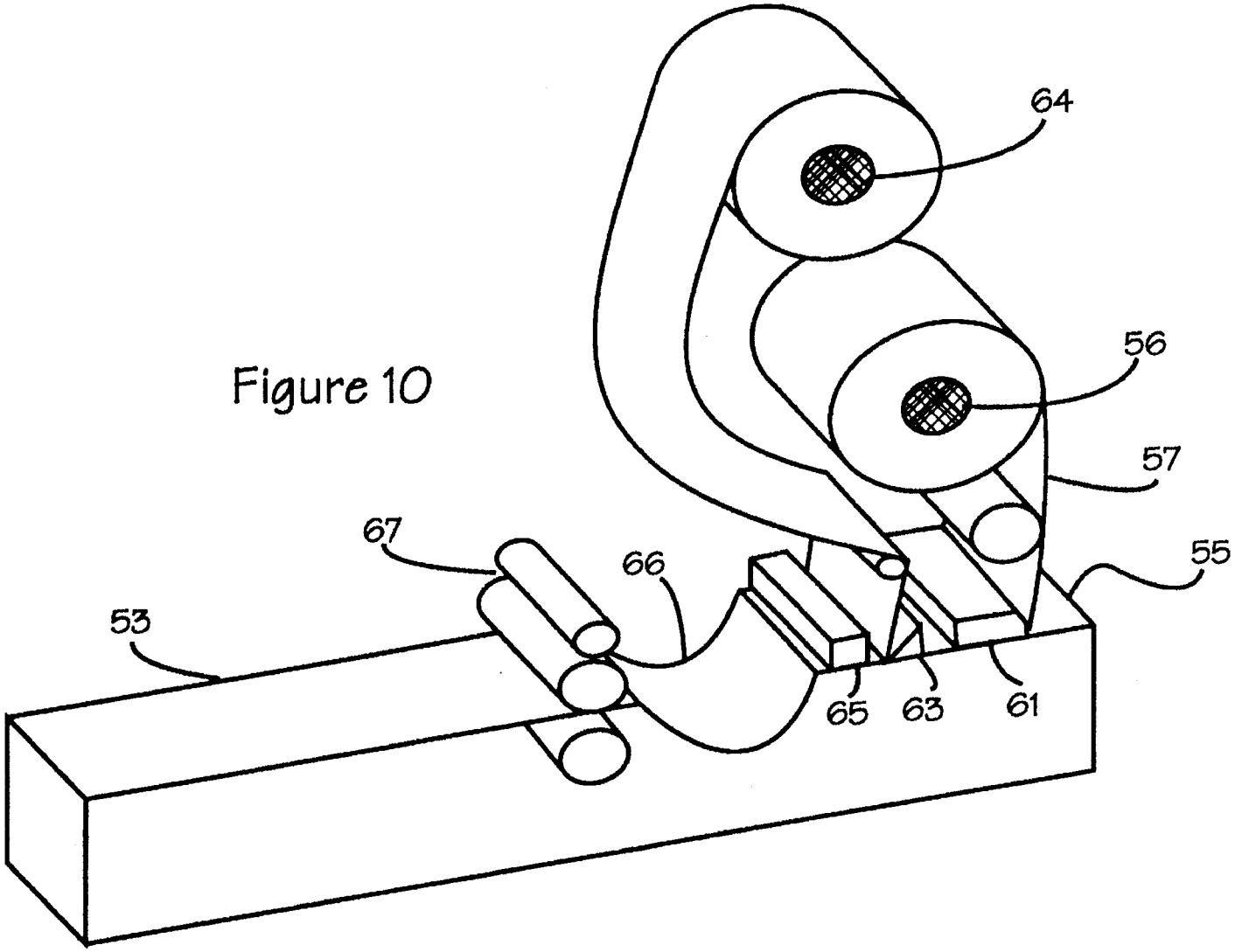
FIG. 10 is a perspective view in schematic form of the ribbon feed and imprint section of the gusset envelope imprinter and loader as depicted in FIG. 2.

Referring now to FIGS. 2 and 10, a gusseted envelope imprinter and loader apparatus is described. The web 5 exiting the apparatus as disclosed in FIG. 1 now consists of preformed gusseted envelopes (not shown). When loaded into imprinter loader 53, web guide bar 54 orients web 5 such that it travels along surface 55 of the imprinter loader 53.

A roll 56 supplies thermal ribbon 57 to dancer tension control system rollers 58 and 59. Such a dancer tension control system is available from, for example, Sperry Flight Systems, Electro Components, Holloway and Calvin Streets, Durham, N.C. 27702. The ribbon 57 then travels to web guide 60 where it is oriented over web 5 and aligned to travel under thermal print head 61. The thermal print head may be of the type manufactured by Kyocera, I/O and Storage Division, 8611 Balboa Avenue, San Diego, Calif. 92123. The Kyocera "KST" series thermal print head would be an example of a particular model suitable in this application.

The thermal print head 61 is activated by conventional software commands to imprint information on preformed gusseted envelopes traveling along web 5. Once the information is printed onto the envelopes, the used thermal ribbon 62 passes under peel bar 63 where the used thermal ribbon 62 is separated from the web 5 and taken up on spool 64. Web 5 is advanced along surface 55 by a pin feed drive 65, pulling web 5 under print head 61 and thereafter pushing the printed envelopes into queue area 66.

Imprinter loader 74 may also be fitted with a ribbon saving feature that halts the flow of ribbon 57 past peel bar 63 when printing is not desired. During the printing operation, impression cylinder 61A is urged upwardly by any means such as a solenoid or air cylinder (not shown). The upward movement of impression cylinder 61A urges web 5 to come in contact with thermal ribbon 57 and thermal print head 61. Thermal print head 61 is permanently fixed to imprinter loader 74 and thus the upward pressure from impression cylinder 61A results in an increase pressure between impression cylinder 61A and thermal print head 61 effectively sandwiching web 5 together with thermal ribbon 57. Thus, web 5 and thermal ribbon 57 advance at the same rate during printing operations and when urged toward die 68 by tractor feed apparatus 65.

To save ribbon during periods when printing is not desired, impression cylinder 61A is lowered downwardly, relieving pressure against web 5 and thermal ribbon 57. As web 5 advances past peel bar 63 by way of tractor feed advance mechanism 65, spent thermal ribbon 62, which had been adhesively attached to web 5 by the action of thermal print head 61, will become separated from web 5 by the pulling force generated by thermal ribbon take up roll 64.

Thermal ribbon 57 will continue to advance at the same rate as web 5 only if one of two conditions are met. Either impression cylinder 61A is moved upwardly against web 5 and thermal ribbon 57 to effectively sandwich the two materials together under pressure, or, in the event impression cylinder is moved downwardly, thermal ribbon 57 is adhesively attached to web 5 by the thermal printing process and has not yet been separated from web 5 by the peel bar 63.

If impression cylinder 61A is moved downwardly, or thermal ribbon 57 has become separated from web 5 at peel bar 63, thermal ribbon 57 will no longer advance, even if web 5 is moved forward by tractor feed mechanism 65. Thus, print, no print commands to thermal print head 61, coinciding with the corresponding upward or downward movement of impression cylinder 61A will result in the use of less thermal ribbon 57. This is a significant advantage to the customer.

The ribbon saving feature of the present invention differs from the prior art in its elimination of a friction feed mechanism in place of tractor feed advance device 65. Tractor feed advancement of web 5 also eliminates the possibility of thermal transfer ink transfer to a solid friction feed roller, as is presently found in other ribbon saving printers described in the prior art.

Yet another advantage to the tractor feed advance mechanism is the highly accurate and reliable delivery of web 5 to cutting die 68. The nature of the envelopes which make up web 5 is such that the envelope flap portion is of single thickness, while the body of the envelope is of multiple thicknesses. The friction feed devices of the prior art would result in erratic advancement of these single and multipart forms into die 68.

Thus the tractor feed holes in the margins of web 5 serve to serve to provide highly accurate and reliable registration during both the manufacturing process as well as the imprinting and loading process. The prior art does not disclose the imparting of tractor feed holes into a web at, or close to the beginning of the manufacturing process and then engaging rotating position sensing rollers into such holes in the margin of a moving web as a method of determining web movement variations, stretch, breakage, etc., at multiple points during the manufacturing process.

Similarly, the prior art does not disclose the use of a tractor feed advance mechanism as a method to ensure the accurate delivery of web material into a cutting die. Upon exiting queue area 66, the printed envelopes pass to die cut station 67 which includes rotary die 68 for individually cutting gusseted envelopes.

The cut envelopes 69 move along surface 55 where they are suitably aligned with insertion ram 70. A chain (not shown) may engage the tractor feed holes at this point to facilitate alignment of the cut envelope. A series of products 71, 72, 73 etc. move along product conveyor 74 until they are aligned with insertion ram 70, which pushes product 75 into envelope 69.

Figure 4:
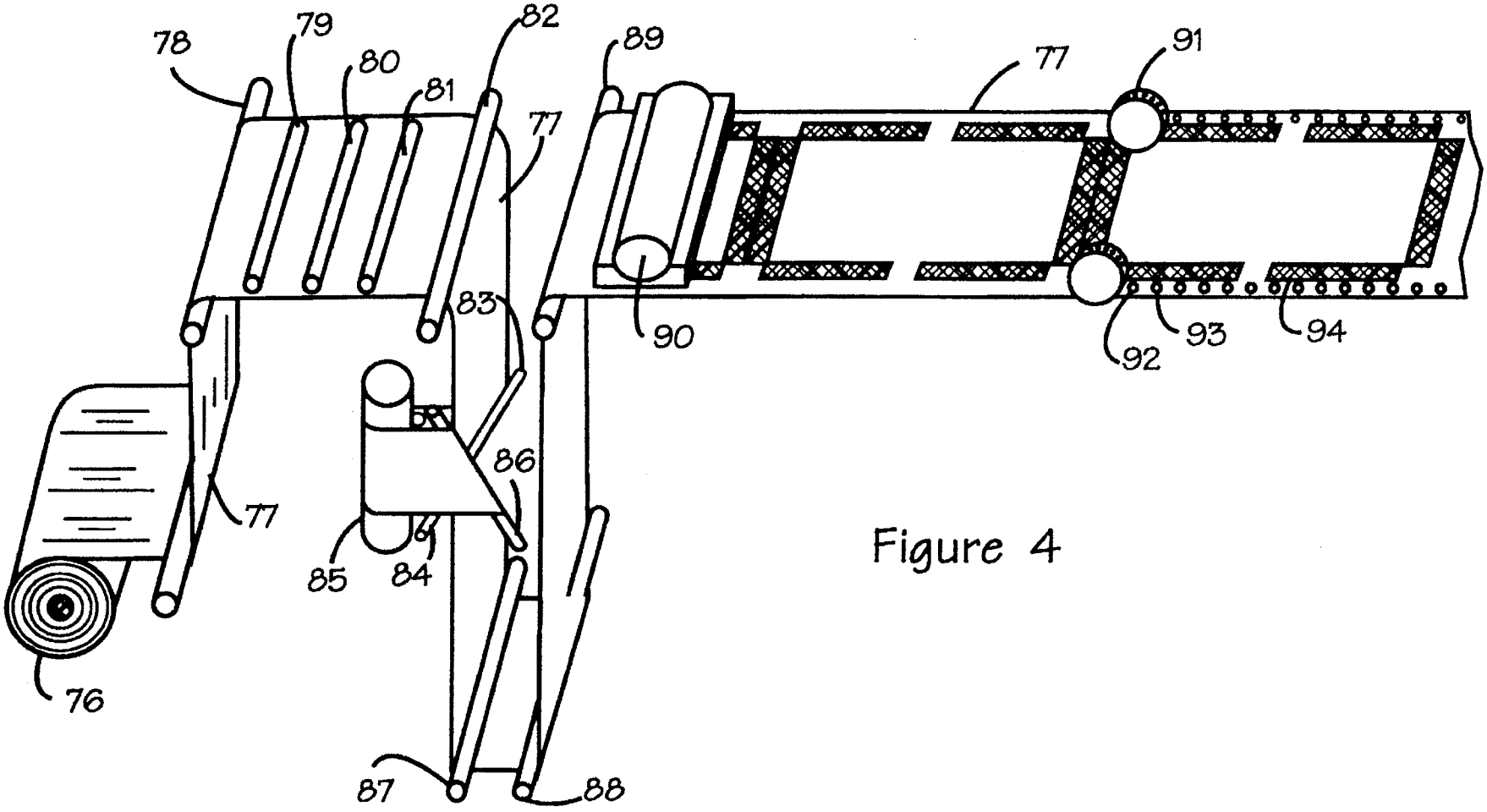
FIG. 4 is an alternative embodiment of the present invention adapted for use in manufacturing a box.

Referring to FIG. 4, a similar apparatus to that disclosed in FIG. 1 is described, except that some modifications have been made to facilitate the manufacture of a continuous form of boxes. Similarly, FIG. 4 depicts only a partial embodiment of the press registration system discussed herein. A spool 76 supplies stock material 77 which exits spool 76 and has its path manipulated by web guide 78. The material 77 travels beneath print station 79, 80 and 81, similar to the process described for print stations 8, 9 and 10 for the gusseted envelope device. The stock 77 then travels over web guide 82 and enters web reversal unit 83. Web reverse unit 83 includes a first 450 angle bar 84, a vertical transition roller 85 and a second 45° roller 86.

Stock material 77 then is deflected by web guides 87, 88 and 89 which feed stock material 77 to pattern adhesive applicator 90. The pattern adhesive applicator may be of the Grayco "MICROPRINT" type described earlier for pattern adhesive applicator 22.

FIG. 4 depicts a manufacturing process where the stock material 77 is punched by tractor feed unit 91 subsequent to the adhesive application step. As previously described, for total web monitoring and control, tractor feed unit 91 may be operated prior to print station 79, along with single or multiple installations of position sensing roller such as 13 FIG. 1.

Figure 5:
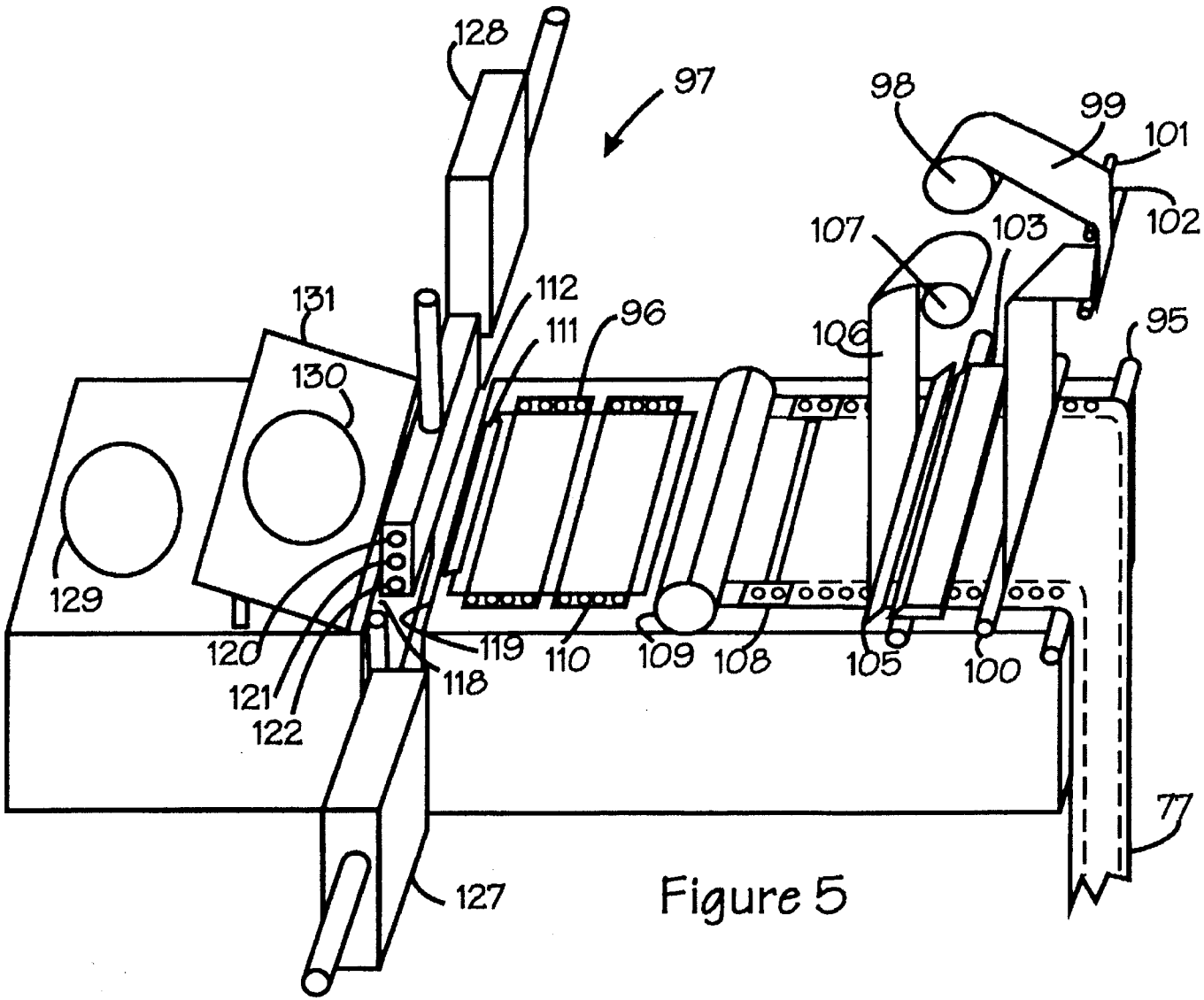
FIG. 5 is a pictorial representation of an imprinter and loading device which may be used subsequent to the operations performed by the apparatus depicted in FIG. 4.

As seen in FIG. 4, the punched holes 92, 93 etc. reside outside the area occupied by the pattern adhesive 94 that has been deposited on stock 77. Referring to FIG. 5, the imprinter loader apparatus is described. The stock material 77 as supplied to the customer from the apparatus described in FIG. 4. Upon loading the stock material 77 into imprinter loader 97, stock material 77 next passes over web guide 95 so as to be aligned with work surface 96 of the imprinter and loader 97.

Figure 9:
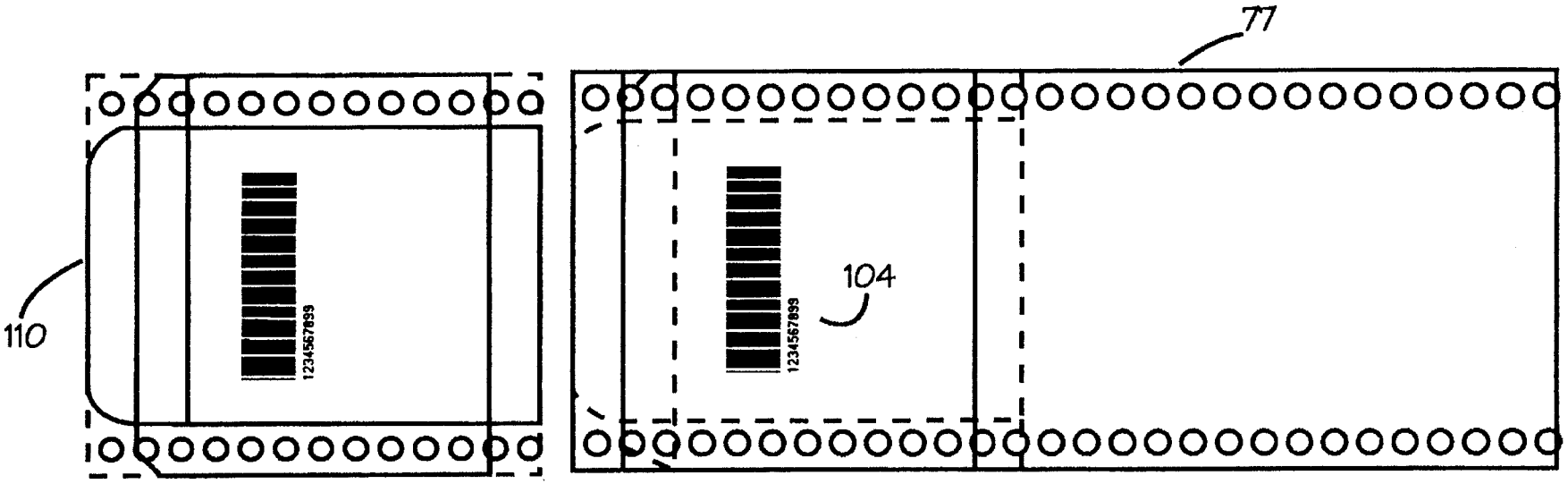
FIG. 9 is a plan view of a box blank as utilized in a preferred embodiment of the present invention.

Above work surface 96 spool 98 supplies thermal ribbon 99 to web guide 100 via dancer rollers 101 and 102. Web guide 100 causes thermal ribbon 99 to be superimposed over web 77, the combined lamination passing under thermal print head 103. Referring to FIG. 9, the web 77 has bar code 104 applied by thermal print head 103. Subsequent to the application of bar code 104, the stock 77 passes under peel bar 105 where used thermal ribbon 106 is accumulated on spool 107.

Figure 6:
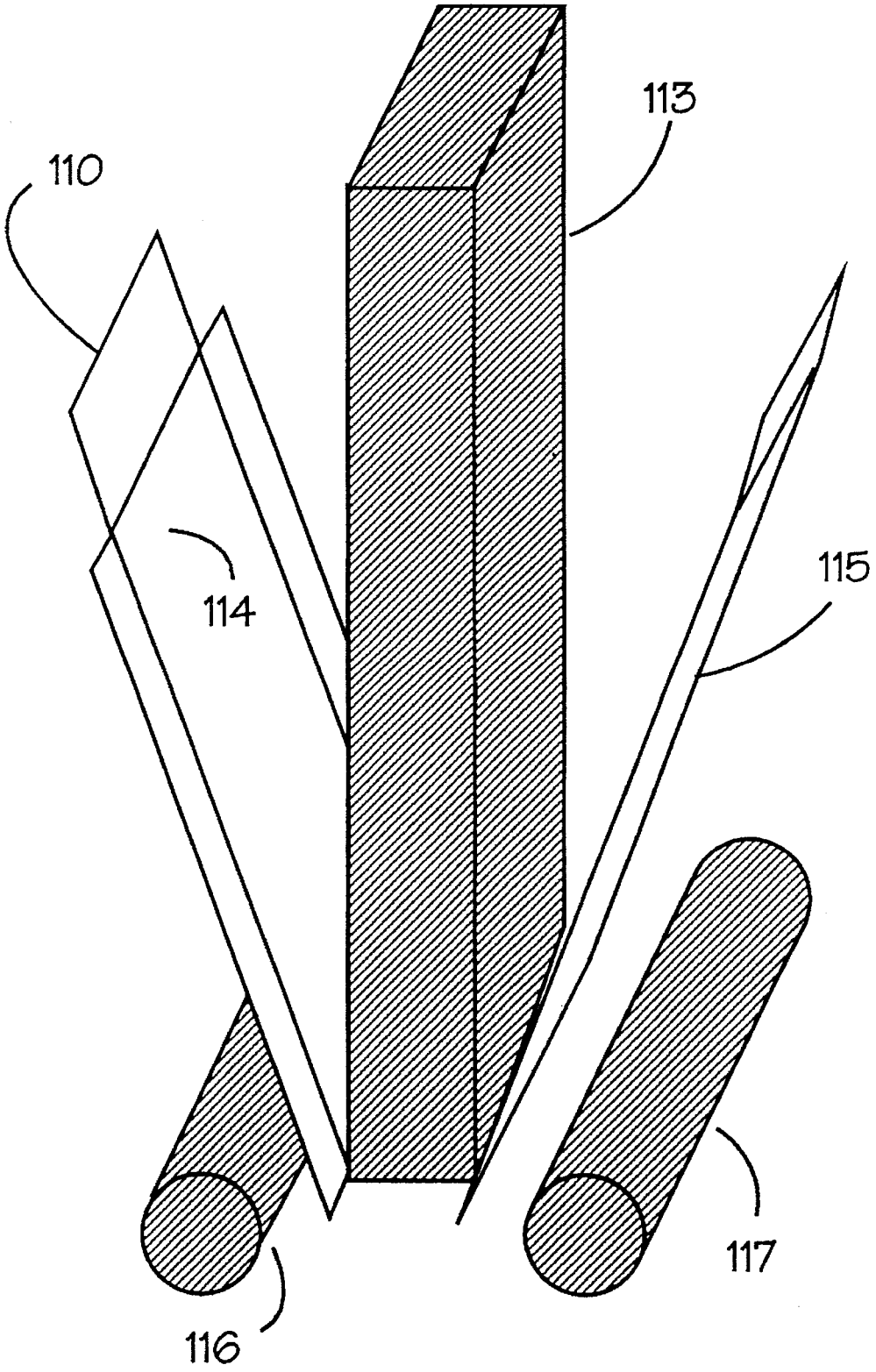
FIG. 6 is a pictorial representation of a first step in forming a box with the device depicted in FIG. 4.

The process of stock material 77 advancement through thermal print head 103 is similar to that of FIG. 2 previously described. The ribbon saving feature previous described is also applicable to imprinter loader 97. Pin feed drive 108 pulls web 77 under thermal print head 103 and pushes web 77 under rotary die 109 where the box stock is cut into the desired shape 110 as shown more clearly in FIG. 9. The cut box blank 110 passes over pivot point 111. Pivot point 111 introduces box blank 110 into cavity 112, where the actual shape of the box is created. As seen in FIG. 6, the first step in assembling box 1 is to press box blank 110 against forming ram 113 so as to form the front 114 and rear 115 of a box. Folding rollers 116 and 117 assist in pressing the front 114 and rear 115 of the box against ram 113, or alternatively, the cavity 112 may be suitably dimensioned so that the folding rollers 116 and 117 are not needed, the sides 118 and 119 of cavity 112 serving the purpose of folding rollers 116 and 117.

Figure 7:
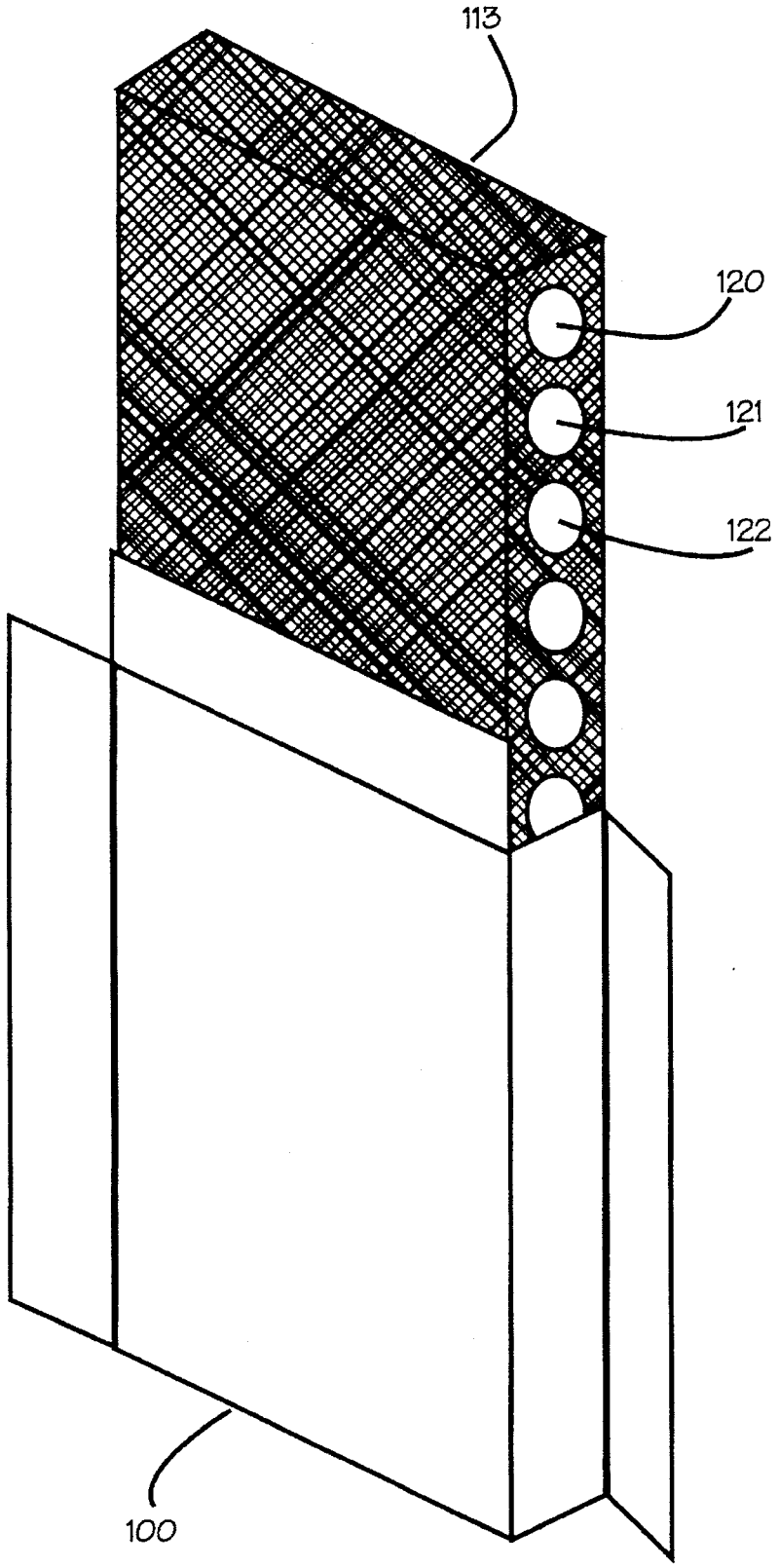
FIG. 7 is a pictorial representation of a second step utilized by the apparatus depicted in FIG. 4.

Referring to FIG. 7, the second step in forming the box is accomplished by folding the sides and bottom of the blank 110 around ram 113. Vacuum ports 120, 121 and 122, for example, are used to hold the box blank 110 in place during this step. Finally, referring to FIG. 8, the final formation of the blank 110 into a box is completed. Forming rollers 123 and 124 crease the sides 125 and 126 and the bottom (not shown) around forming ram 113.

Heat seal bars 127 and 128 press box blank 110 against forming ram 113 and activate the adhesive 94 so as to secure the box into its final structural configuration. As seen in FIG. 5, incoming parts 129 and 130 are manipulated towards part slide 131 where the parts may be deposited into the box by gravity.

Figure 14:
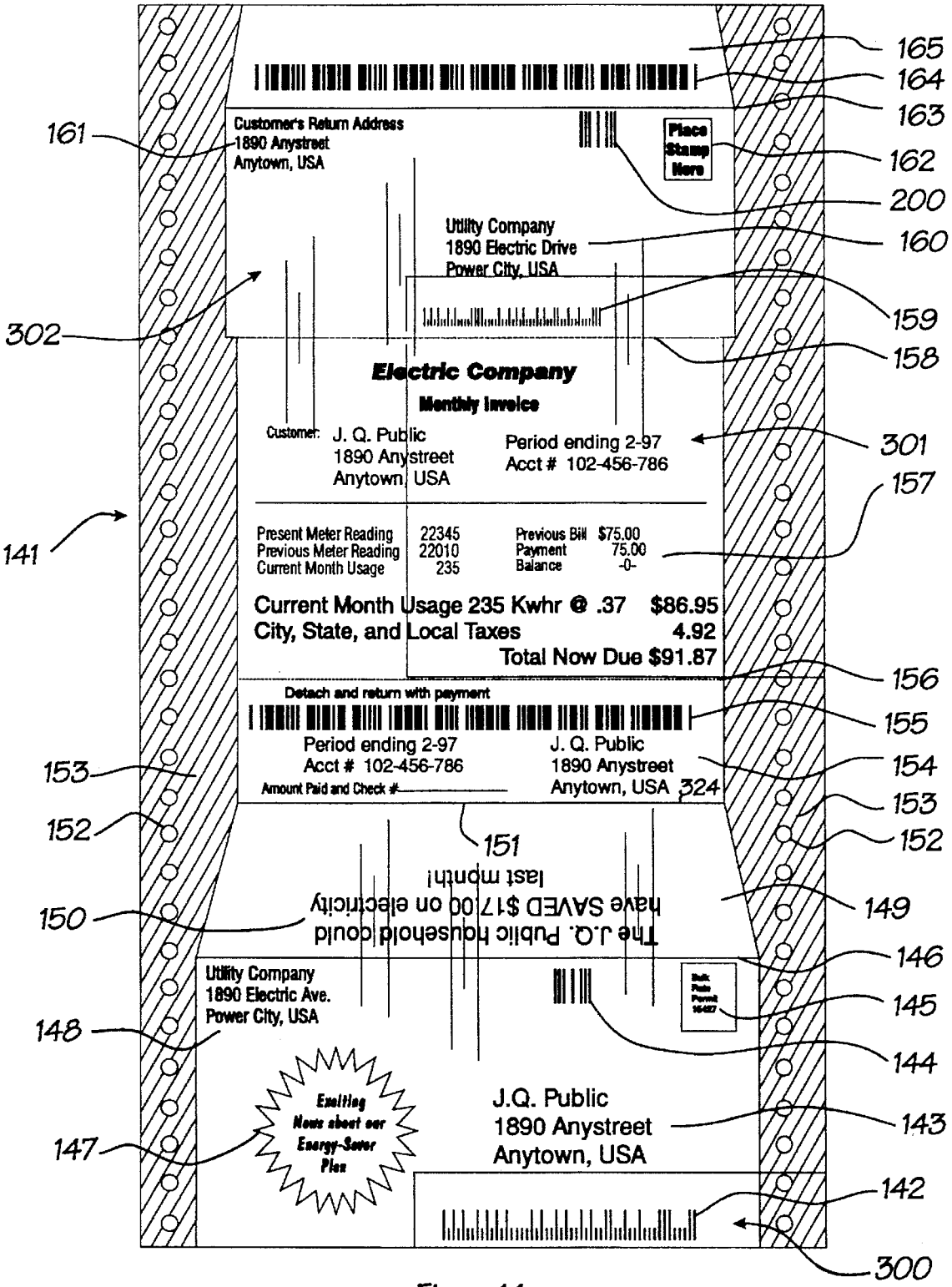
FIG. 14 is a pictorial representation of a possible configuration of the hybrid envelope/business form showing a mailing envelope, invoice with a return coupon, and return reply envelope.

The envelope/business form of the present invention can be produced on a variety of web fed printing presses, including offset, flexographic and rotogravure. The hybrid envelope/business form 141 as depicted in FIG. 14 represents a single portion from a continuous roll of a generic monthly invoice. Form 141 is an example of an invoice for electrical usage as might normally be sent to an average consumer. FIG. 14 shows only those features of the present invention essential to an understanding of its operation.

Figure 23:
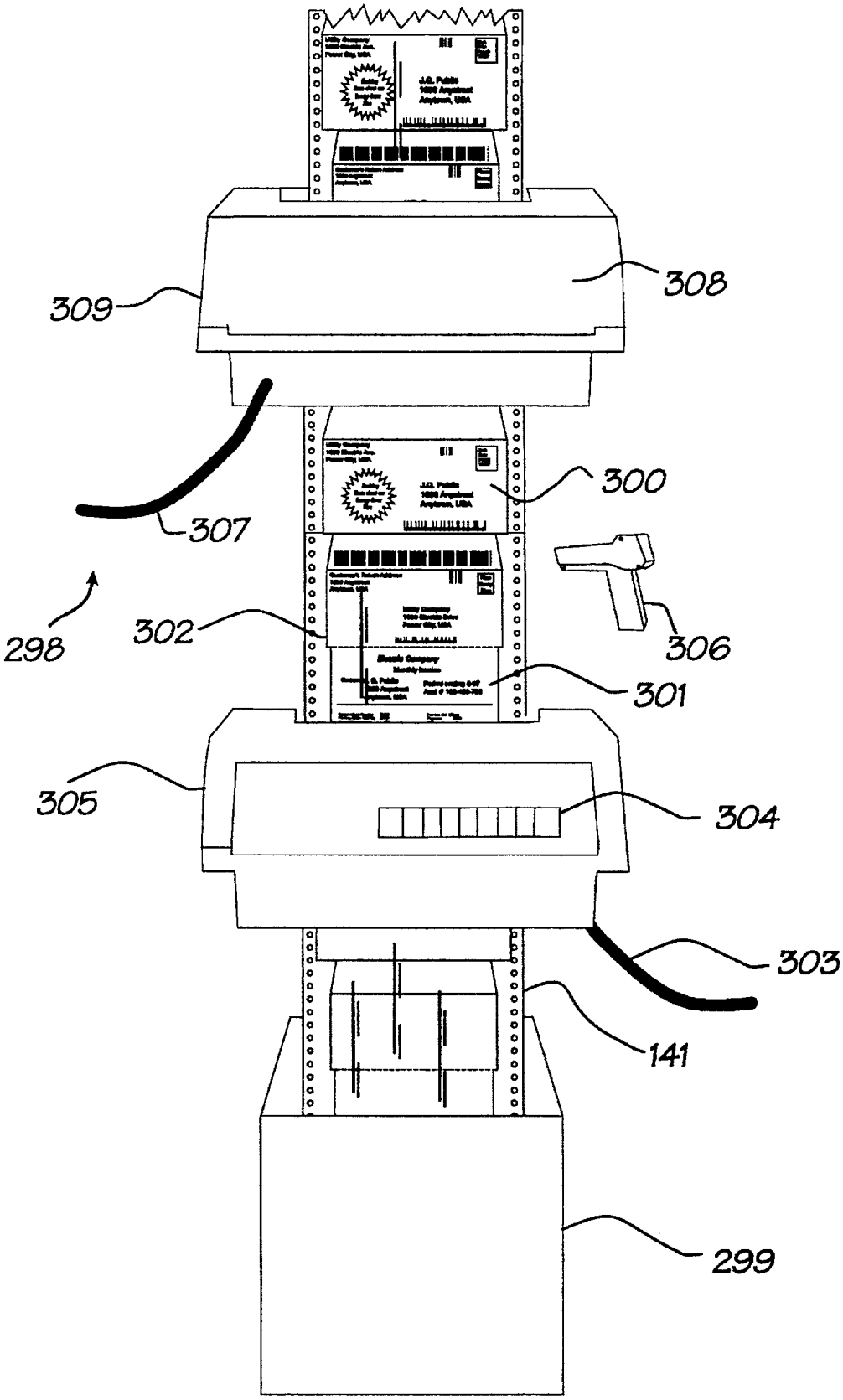
FIG. 23 is a pictorial representation of the process of imprinting both the front and back of the hybrid envelope/business form shown in FIG. 14.

As seen in FIG. 14, the electric utility, by way of using commercially available computer imprinting devices, such as those sold by Weber Marking Systems, 711 W. Algonquin Road, Arlington Heights, Ill. 60005., imprints the customer's POSTNET bar code 142 onto the mailing envelope 300 according to proper U.S. Post Office placement regulations. The envelope 300 advances through the computer imprinting device 305 as shown in FIG. 23 to imprint the customer's address 143, F.I.M. bar code 144, and postal indicia notification 145. The electric utility company can elect, at its option, to have its return address 148 and promotional message 147 imprinted by the forms manufacturer, or it can choose to imprint such data by the same computer imprinting techniques as it employs to imprint all other variable data.

The envelope 300 continues to travel through the imprinter 305 and past flap 149, said flap comprising the portion located between fold line 146 and trailing edge 324 of invoice 301, unless the electric utility opts to print data 150 on flap 149. When loaded with the mailing materials 301 and 359 as depicted in FIG. 26*i*, flap 149 of envelope 300 will fold along crease line 146.

Such travel through the computer imprinter 305 is controlled and kept in registration by way of engaging tractor feed holes 152 with the tractor advance mechanism of computer imprinter 305. Such tractor feed holes 152 will ultimately be removed with trim area 153 upon completion of the imprinting process.

The computer imprinter 305 then begins the imprinting of variable data 155 onto return coupon 154, said coupon being the area between the trailing edge 324 of invoice 301 and line of weakness perforation 156. The location and size of coupon 154, in relation to invoice 301, is of little consequence to the design and manufacture of form invoice 301, and is dictated solely by the electric utility's specifications. Utilizing standard computer imprinting technology, the electric utility can opt to print any preprinted or variable data 155 onto coupon 154, bar code 155 being only an example of such data. The body of invoice 301 can also include any such preprinted or variable data.

The invoice 301 then is advanced past perforation 158 to allow imprinter 305 to apply the electric utility's POSTNET bar code 159 in the proper position on return envelope 302. As an alternative, the electric utility could opt to have the forms manufacturer preprint POSTNET 159, F.I.M. 200, and postage indicia notification 162 at the time of manufacture, thereby eliminating the need to imprint this data in the computer imprinter. However, if the sending organization utilizes several addresses for the return of payments, then the envelope 302 can be easily personalized with such individual mailing information. The utility can also elect to imprint the customer's return address 161 onto the face of envelope 302. This would save the customer the time of hand entering the data or using gummed or pressure sensitive return address labels, such labels being commonly available in the marketplace. Once the envelope/invoice forms and boxes are manufactured, the invention allows for a method of imprinting with personalized information. No original claim is made herein to the manufacture of thermal print heads or thermal transfer ribbon. The novelty of the present invention is the ability to stop the advancement of thermal ribbon while continuing to advance the form itself. The present invention provides a method for imprinting variable data and scannable codes onto the envelope/invoice business form.

Figure 24:
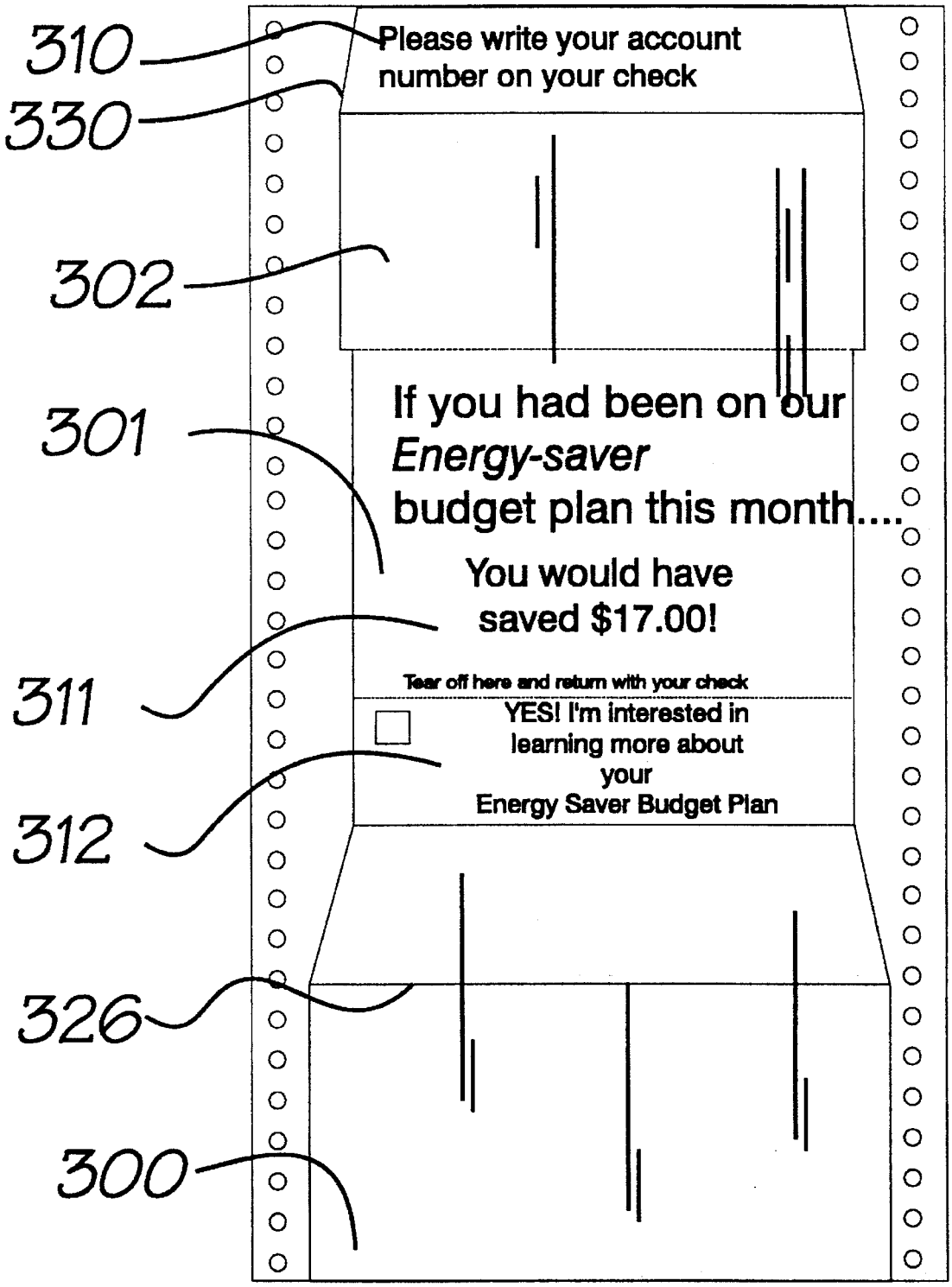
FIG. 24 is a pictorial representation of an example of printing located on the back side of the hybrid form of FIG. 14.

In an alternative embodiment, a method is disclosed for imprinting variable data onto the reverse side of the same envelope/invoice business form (see FIG. 23 and FIG. 24). Not only does printing on the reverse side of the invoice 301 as shown in FIG. 24 allow the sending organization to cut paper usage by one half, but also provides wide latitude in the application of marketing or other scannable encoding options. For example, message 310 of FIG. 24 is imprinted onto the inside flap of envelope 302. Such an identifying code could be scanned by the recipient in order to provide for proper account crediting of the enclosed payment. Imprinting scannable codes on the inside provides for added security by shielding the code from view until the return reply envelope is opened by the recipient.

Other options for imprinting variable data include, but are not limited to, imprinting bulk rate permit numbers and business reply permit information and the required black bar marks. The electric utility can elect, at its option, to imprint variable data 164 on either the inside or outside of flap 165 of envelope 302, or the inside of the envelope front panel. Bar code 164 as shown is an example of bar coding the customer's account number in a nonhuman readable format on the outside of envelope 302. In another form of the embodiment, where the customer objects to the imprinting of his customer account bar code on the outside of the return reply envelope, FIG. 19*a* shows an example of the loan payment envelope 261 of FIG. 19, wherein said loan payment envelope 261 has been imprinted with the customer's account information bar code 266 instead on the inside of flap 267. Loan payment envelope 261 FIG. 19*a* is shown in the state it would normally be received in a lending institution's loan payment processing department, subsequent to its opening by mailing room personnel, wherein said mailing room personnel would open loan payment envelope 261 by severing along fold line 265 with suitable automatic envelope opening equipment (not shown), such automatic envelope opening equipment being well known to those skilled in the art of mail processing, or a common letter opener (not shown). Bar code 266 can then be scanned by the loan payment processing employee.

Figure 19:
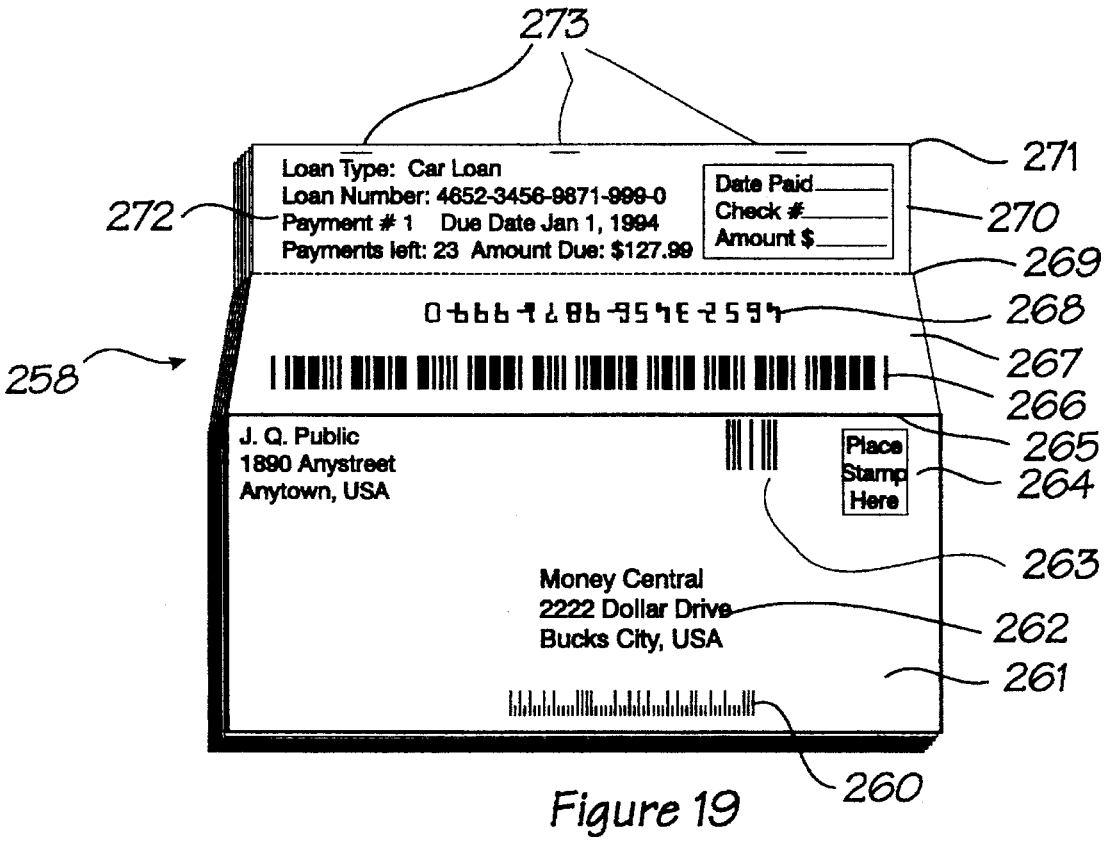
FIG. 19 is a pictorial representation of a loan payment envelope/booklet device, with envelope and customer receipt.
Figure 19A:
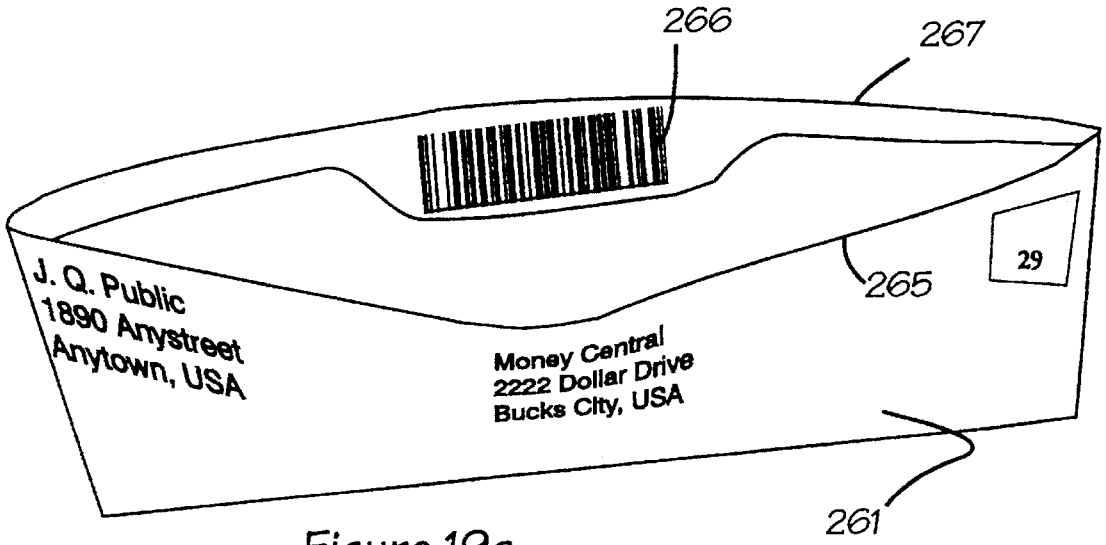
FIG. 19*a* is a pictorial representation of a loan payment envelope after it has been received and opened by lending institution, shown with a bar code indicia imprinted on the inside of the envelope flap.
Figure 19B:
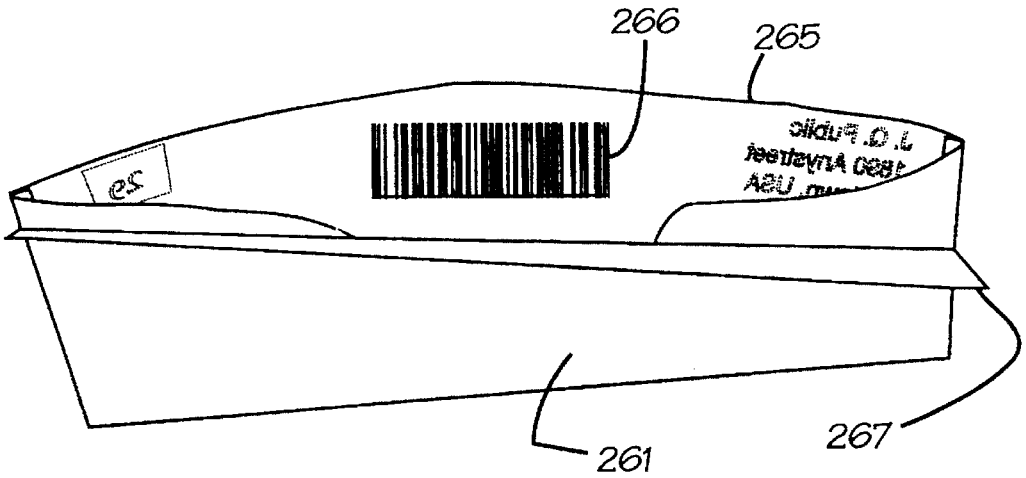
FIG. 19*b* is a pictorial representation of a loan payment envelope after is has been received and opened by a lending institution, shown with a bar code indicia imprinted on the inside of the front of the envelope.

In a minor variation of the above mentioned embodiment, FIG. 19*b* shows loan payment envelope 261 with the customer account bar code 266 imprinted on the inside of the face of loan payment envelope 261. FIG. 19*b* also shows loan payment envelope 261 in an opened state, with flap 267 being severed along fold line 267 and folded downwardly, as might be done by loan payment processing employees. Thus, the bar code 266 can be scanned.

Options other than bar coding include, but are not limited to, imprinting include alpha numeric, magnetic ink character recognition (M.I.C.R.), and graphics. Upon return of envelope 302 to the utility, a scan of bar code 164 would reveal the customer's account number, thereby allowing the utility to eliminate coupon 154 entirely. Bar code scanning devices are commonly available from Norand Corporation, 550 Second Street South East, Cedar Rapids, Ia. 52401. Scanning bar code 164 to reveal the customer's account number would also eliminate the need to hand enter customer account information from coupon 154, as is currently the practice.

When imprinted with a bar code 164 or M.I.C.R. code (not shown), the invention allows the electric utility to register the envelope/business form 302 to a second printer 309 for imprinting the back side of form 141. FIG. 23 shows a carton 299 of blank forms 141 feeding into printer 305, printer 305 being viewed from front panel 304. After imprinting variable data 142, 143, 147, 148, 155, 157, 159, 161, and 164 on front side of form 141, account information bar code 164 is scanned by scanner 306 and such information is fed into a computer (not shown). The computer then transmits to printer 309 the proper data for printing the back side of form 141 via data cable 307.

Second printer 309 is shown rotated 180° along a horizontal plane in relation to printer 305. To demonstrate the juxtaposition of printer 309, in relation to printer 305, FIG. 23 shows data input cable 307 entering the rear panel 308 of printer 309. In practice, the location of cables 307 and 303 is irrelevant.

The form 141 then proceeds through printer 309, where additional variable data 310 and 311 is imprinted. The electric utility can opt to imprint any variable data, in any location on the back side of form 141. Printing 312 on the reverse side of coupon 154 may provide for customer request boxes or change of address information.

The hybrid envelope/business form 141 shown in FIG. 14 is not limited to a single length sheet 301. As mentioned earlier, the electric utility can choose to imprint variable billing data on the reverse side of form 141. However, if the electric utility needs even more space for printing, or, in the alternative, elects not to imprint the reverse side of form 141, it can have form 141 manufactured with a double length invoice 234 and 225 as shown in FIG. 17 or even as a triple length invoice (not shown).

Figure 17:
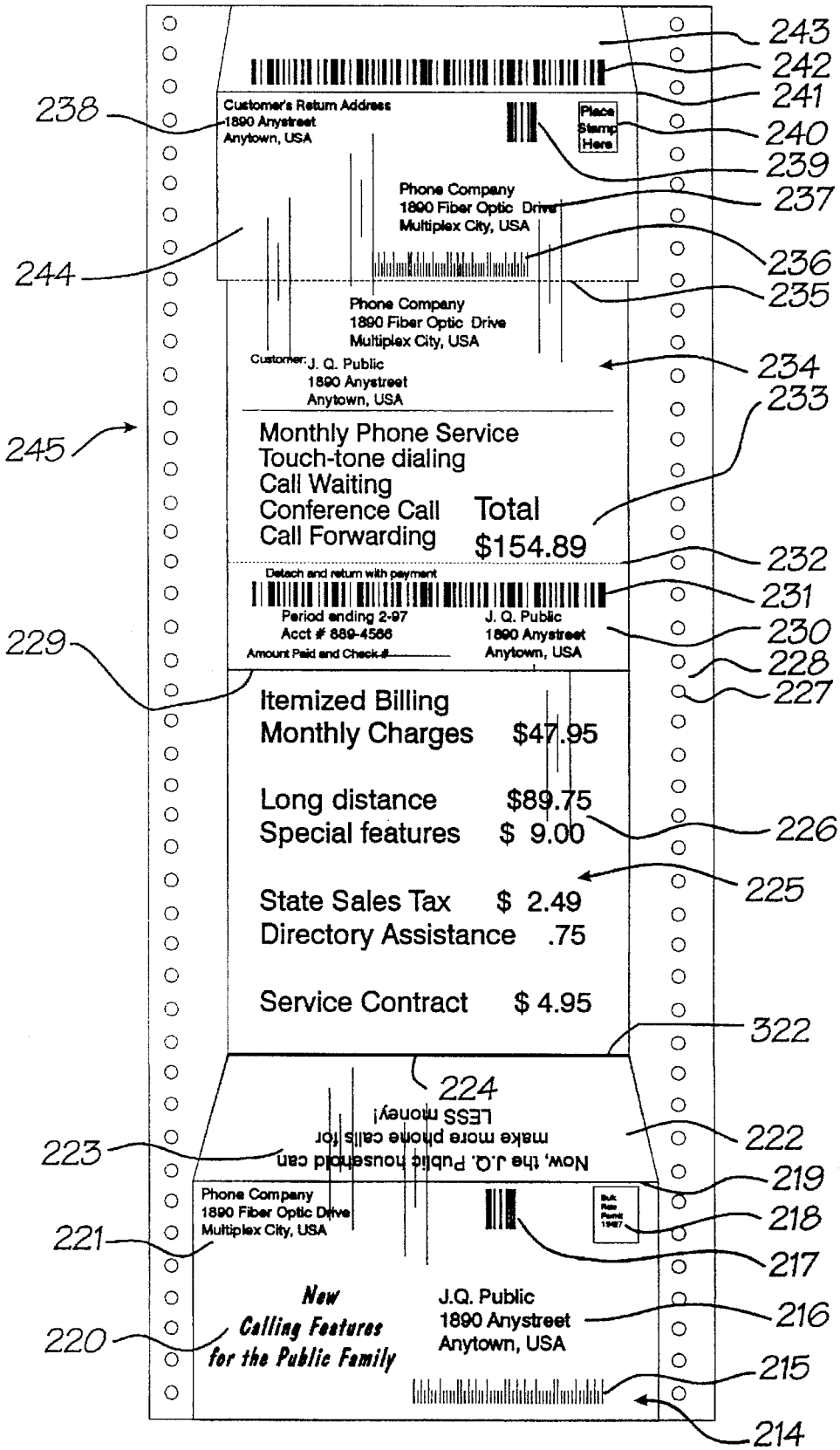
FIG. 17 is a pictorial representation of the hybrid envelope/business form with a mailing envelope, a two page invoice with integral return coupon, and a return reply envelope.

FIG. 17 demonstrates the continuation 226 of billing information 233 on invoice 234 onto a second sheet 225. All other features, POSTNET bar code 214, customer address 216, promotional message 220, return address 221 of mailing envelope 214, promotional message 223 on flap 222, line of weakness 229 separating invoice 225 from 234, tractor feed holes 227, trim area 228, variable data 231 on coupon 230, line of weakness 232, line of weakness perforation 235 separating envelope 244 from invoice 234, POSTNET bar code 236, send to address 237, F.I.M. codes 239 and 217, postal indices 218 and 240, customer's return address 238, and variable data 242 on flap 243 of envelope 244, shown in FIG. 17 are similar in function to those shown in FIG. 14.

Figure 16:
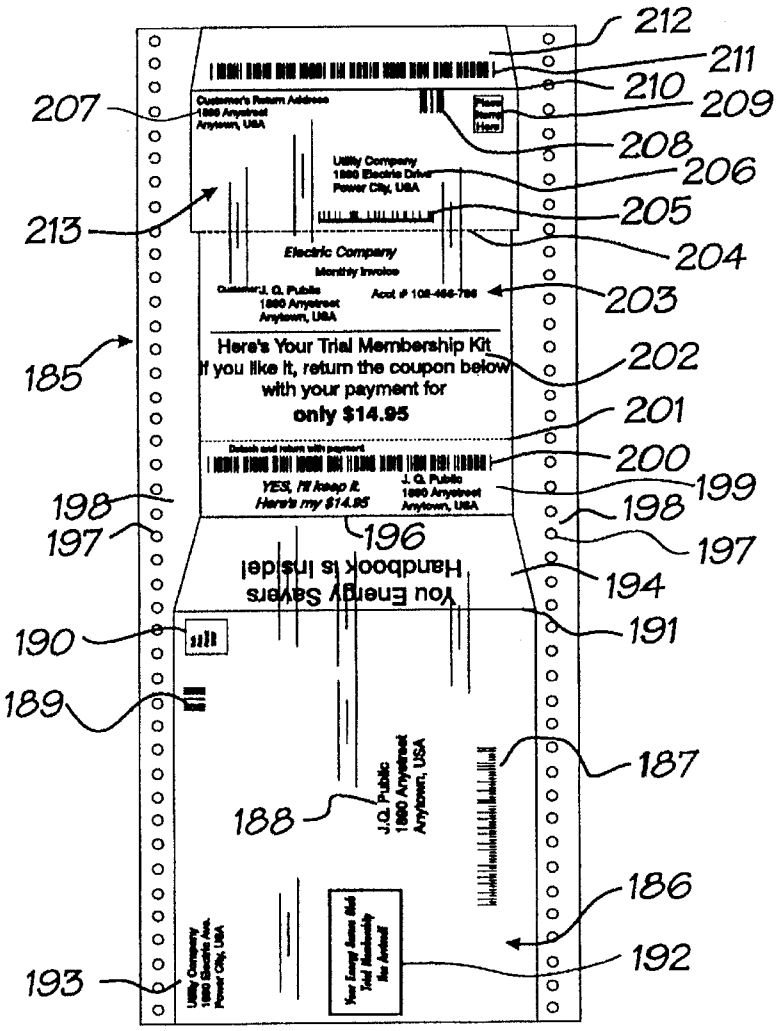
FIG. 16 is a pictorial representation of the hybrid envelope/business form with a standard 9"×12" open end (O.E.) catalog envelope with attached advertising matter, return coupon, and return reply envelope.
Figure 15:
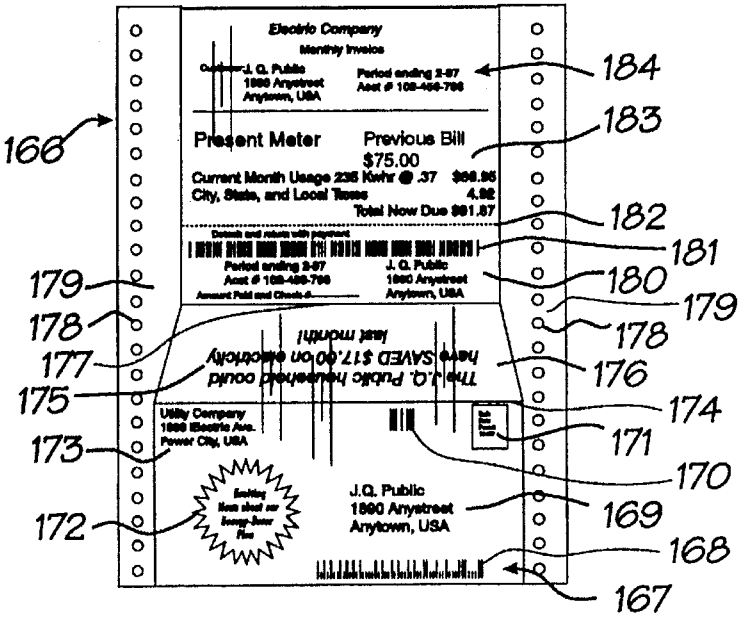
FIG. 15 is a pictorial representation of the hybrid envelope/business form of FIG. 14 without the return reply envelope.

The business form 166 FIG. 15 is similar to form 141 except that return reply envelope 302 is not provided. Form 166 could be used for applications where a return reply envelope is not desired. The business form 185 FIG. 16 shows a 9"×12" open end (O.E.) catalog envelope 186 with attached advertising matter 203, return coupon 199, and return reply envelope 213. Form 185 includes POSTNET data 187, promotional message 192, sender's return address 193, recipient's address 188, F.I.M. code 189, postal indicia 190, flap 194 of envelope 186, variable data 202 on advertisement 203, variable data 200 on coupon 199, POSTNET bar code 205, send to address 206, customer's return address 207, F.I.M code 208, postal indicia 209, and variable data 211 on flap 212 of envelope 213.

Figure 18:
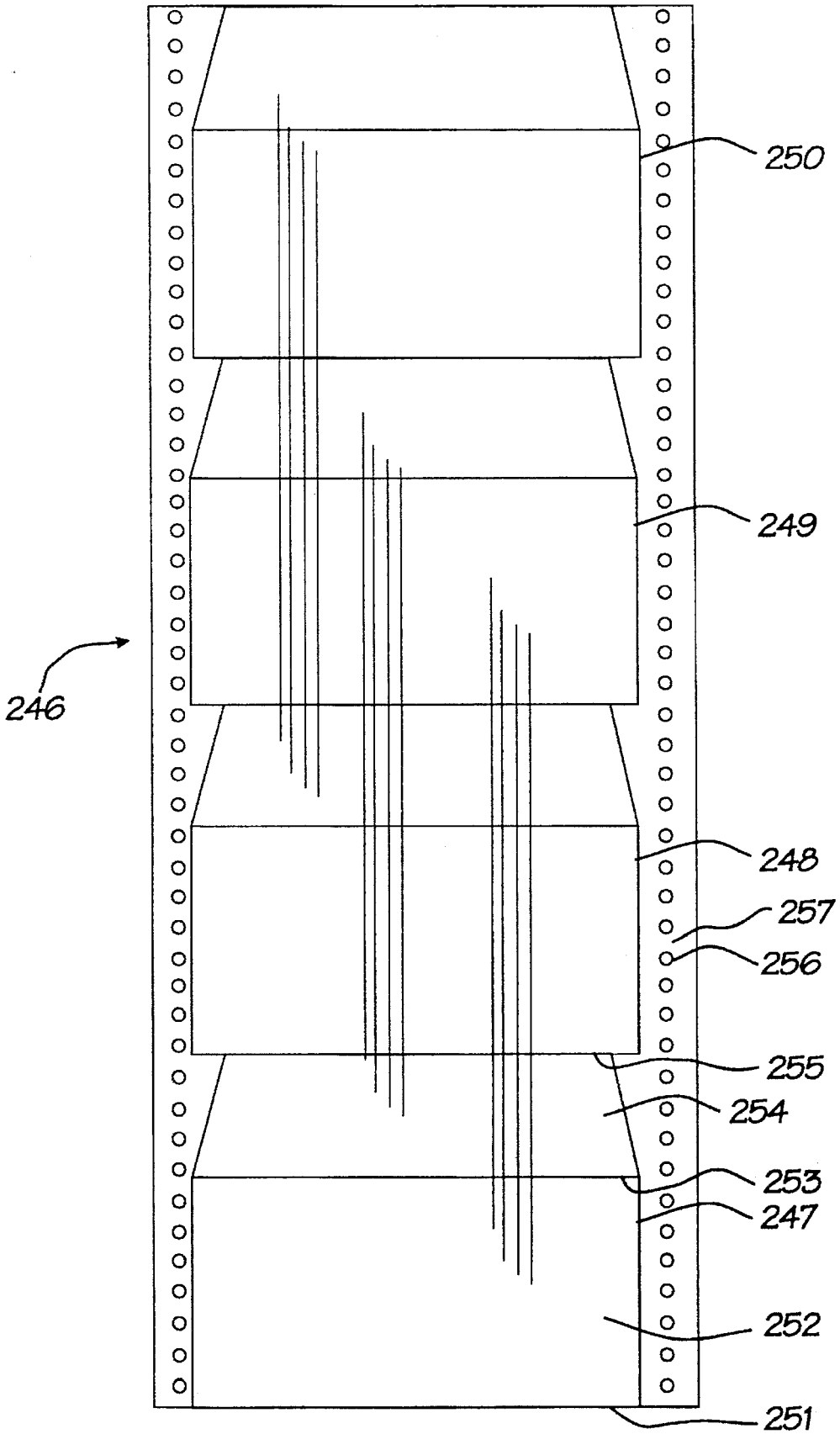
FIG. 18 is a pictorial representation of a series of letter envelopes in continuous tractor feed format.

The original configuration of the tractor feed envelope is shown in FIG. 18. Envelopes 247, 248, 249, 250, etc. are manufactured serially along a web 246. An area 252 is provided on each envelope 247, 248, etc. for addressing, postage, etc. Each envelope 249, etc., contains a fold line 253 and a flap 254. Each portion of form 246 contains tractor feed holes 256 and trim area 257, said trim area being removed by the user after imprinting, by means of either die cutting or bursting, such method being determined by the user prior to ordering said form 246 from the manufacturer.

Figure 20:
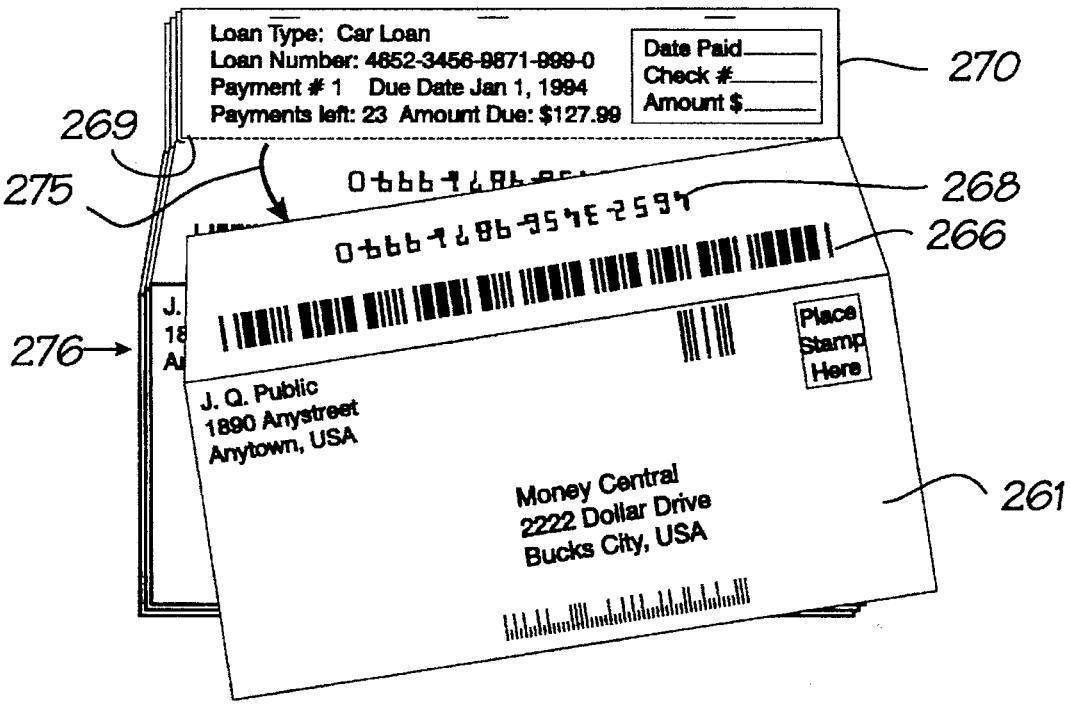
FIG. 20 is a pictorial representation of the loan payment device of FIG. 19, shown with the envelope detached, leaving only the customer receipt remaining stapled in the booklet.

Another possible configuration of the hybrid envelope/business form is shown in FIG. 19 and FIG. 20. The loan payment envelope 261 could be computer imprinted by a lending institution or a servicing bureau. Form 258, consisting of envelope 261 and customer receipt 270 are shown in FIGS. 19 and 20 with the tractor feed and waste areas (not shown) removed.

Figure 25:
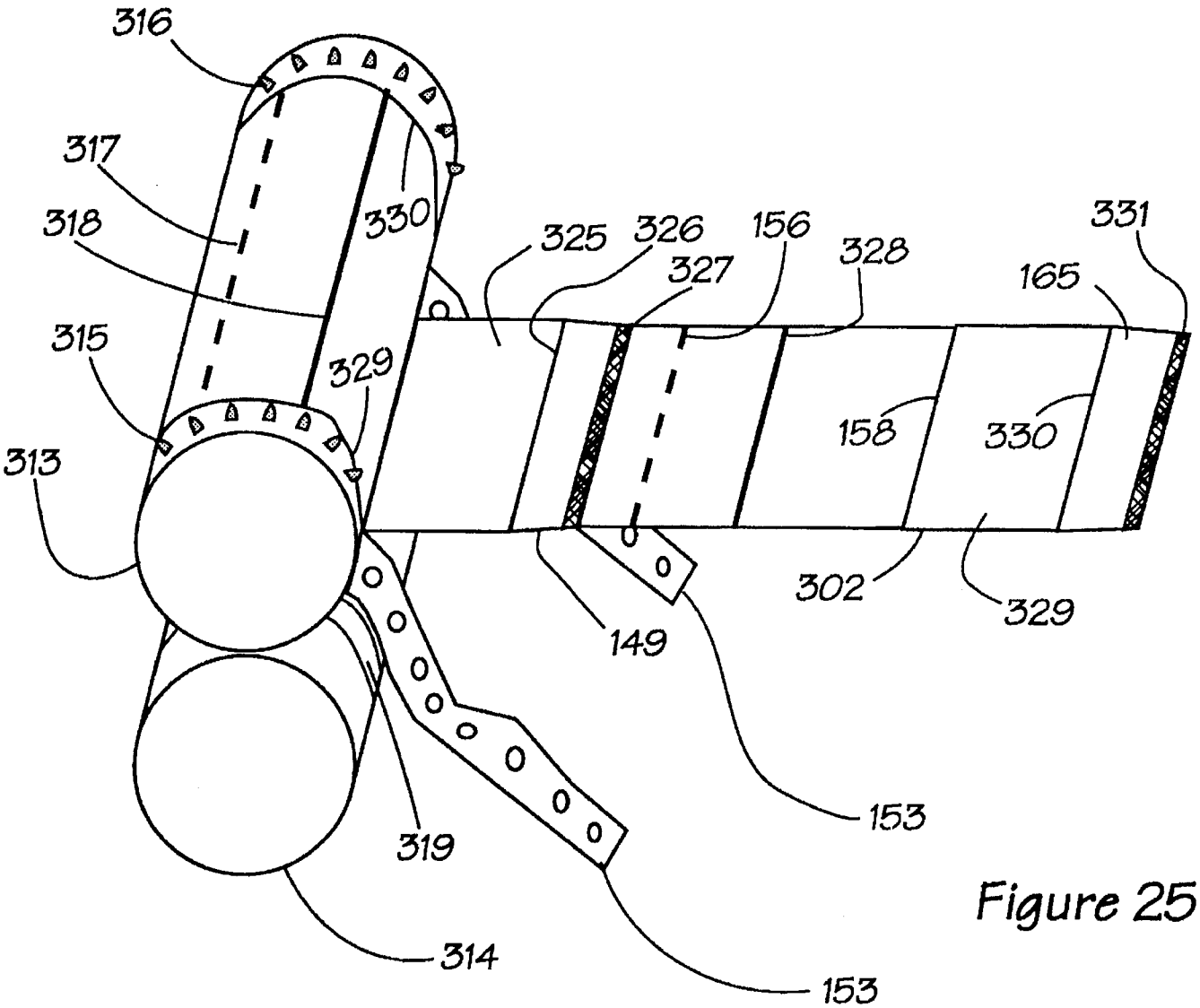
FIG. 25 is a perspective view of the die cutting and crease imparting process, showing the form of FIG. 14 with tractor feed areas removed and crease and perforation lines embossed.

The computer imprinter employed by the lending institution engages the envelope's tractor feed holes (not shown) and advances the envelope 261 to imprint the lending institution or servicing bureau's POSTNET bar code 260 along the bottom edge of envelope 261. At the option of the lending institution, POSTNET code 260, mailing address 262, F.I.M. 263, and postage indicia 264 can be imprinted by the forms provider at the time of manufacture, or by direct computer imprinting. Also at the election of the lending institution, the imprinter can print bar code 266 or M.I.C.R. code 268 on flap 267 of envelope 261. If the lending institution elects to employ a return coupon, such a coupon could be incorporated between flap 267 and customer receipt 270. Also imprintable, at the lending institution's option is the customer's return address 265. As pictured in FIG. 19, variable data 272 is imprinted on customer receipt 270. Upon completion of the imprinting process, the form is fed through a die cut station similar to that shown in FIG. 25. The die 313 in FIG. 25 is shown processing form 141. However, the same process, with minor modifications, can be used to remove the tractor feed, impart perforation 269 and sever the forms 258 consecutively at leading edge 271, thereby producing individual sheets 258 composed of envelope 261 and receipt stub 270. The sheets are stacked, aligned, and stapled into a booklet at the top edge 271 with staples 273, such that the envelopes 261 are in serial order according to the lending institution's preferences. Such booklet assembling and binding methods are well known in the printing industry.

The quantity of sheets 258 in the booklet will correspond to the number (12, 24, 36, etc.) of loan payments to be made by the customer. A cover may be added at the option of the lending institution. As used by the loan customer, FIG. 20 shows envelope 261 being detached at line of weakness perforation 269. The loan customer inserts the payment check and seals the envelope. Customer receipt 270 is available for the customer to record payment data.

When received by the lending institution or servicing bureau, bar code 266, or M.I.C.R. code 268 is scanned and all relevant account information is called to the computer terminal screen. This feature eliminates the need for a return coupon.

Figure 21:
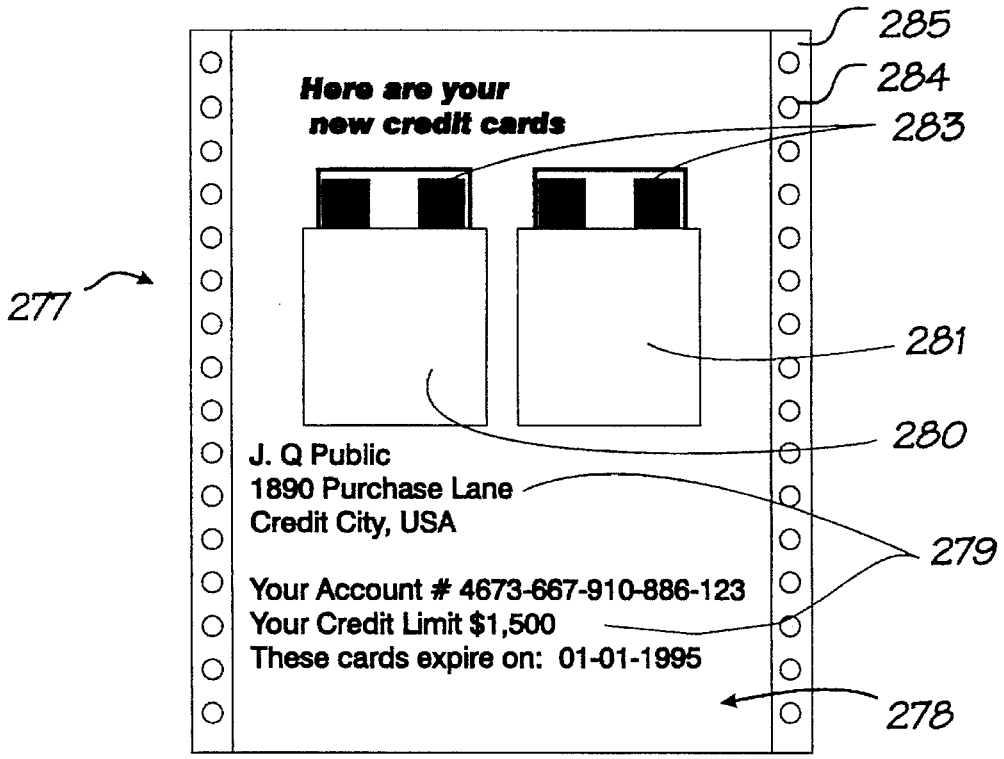
FIG. 21 is a pictorial representation of a business form with pockets attached to hold credit cards and personalized imprinting pertaining to customer information.

FIG. 21 shows another use for the technology of the present invention. Business form 277 is advanced through a tractor feed computer imprinter where variable data 279 is applied. Credit cards 283 are inserted into pockets 280 and 281 respectively. Inserting credit cards 283 into such pockets 280 and 281 would eliminate the need to adhesively attach credit cards to a form, or engage the corners of credit cards into die cut tag board material, as is presently done.

Figure 22:
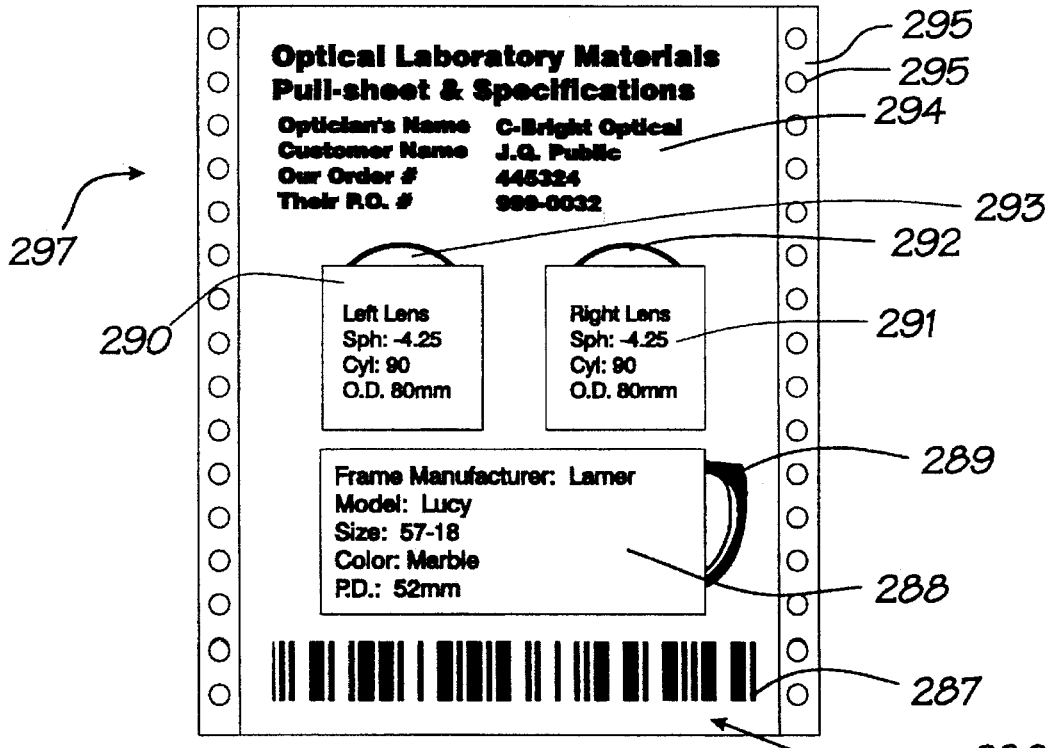
FIG. 22 is a pictorial representation of a business form imprinted with manufacturing and inventory data, with gusseted pockets attached and materials inserted into the pockets.

FIG. 22 shows yet another use for this novel technology. Here, business form 297 is computer imprinted with variable data 294 and the data shown on pockets 290, 291, and 288. Here, an optical laboratory assembles a customer order by inserting left lens 293 into left pocket 290 and right lens 292 into right pocket 291. The eyeglass frame 289 is inserted into pocket 288. The layout of form 286 eliminates the need for the optical technicians to check each lens before machining, because the left lens 283 is already in the left pocket 290, etc. Locating parts in logical order has been shown to cut down on the occurrence of errors. This type of form can be utilized in many other applications. The individual pockets shown attached to form 286 may be of any gusset pleat configuration, thus providing an expandable or "bellows" holding arrangement.

Referring now to the hybrid envelope/business form shown in FIG. 14, the remainder of the conversion process will now be explained in detail. This process, as explained earlier, can be accomplished by two methods. First, the imparting of transverse crease lines, lines of weakness, and longitudinal perforations can be performed on the printing press at the time of the form's manufacture. Subsequent to the imprinting process, the forms user will separate the trim areas from the form and divide the continuous form into individual sections by use of a bursting device. Bursting or layered form separating devices and their capabilities are well known by those skilled in the art of continuous business forms.

Second, the die cut, perforation, creasing and separation process can be performed upon completion of the computer imprinting step, at the forms user's place of business, prior to mailing. This die cutting process is shown in FIG. 25.

The completely printed form 141 as shown in FIG. 14 is advanced from printer 309 as depicted in FIG. 23 to die 313 as shown in FIG. 25. There, tractor feed holes 152 engage with pins 315, 316, etc. on die 313. The rotary cutting blades 329 and 330, engraved into the circumference of die 313, sever the trim areas 153 from form 141. The die 313 also imparts line of weakness perforations 156 and 158, and folding crease 328. Die 313 and anvil roll 314 can be machined as a matched set male/female device so that folding crease 328 is more pronounced. Raised surface 318 on die 313 is an example of a crease imparting device. Raised surface 317 is an example of a perforation imparting device. The exact location of these raised and/or sharpened areas on die 313 corresponds to the design of form 141. Finally, a raised cutting blade such as blade 318 severs the form 141 from the continuous web.

Figure 26:
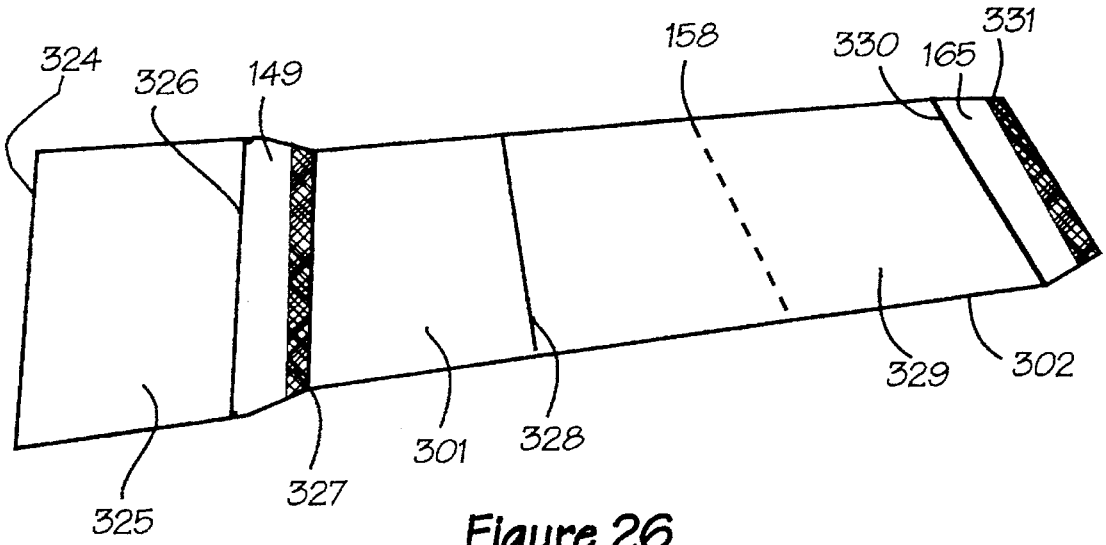
FIG. 26 is a perspective view of the envelope/business form of FIG. 25 as it enters the stuffer.
Figure 26A:
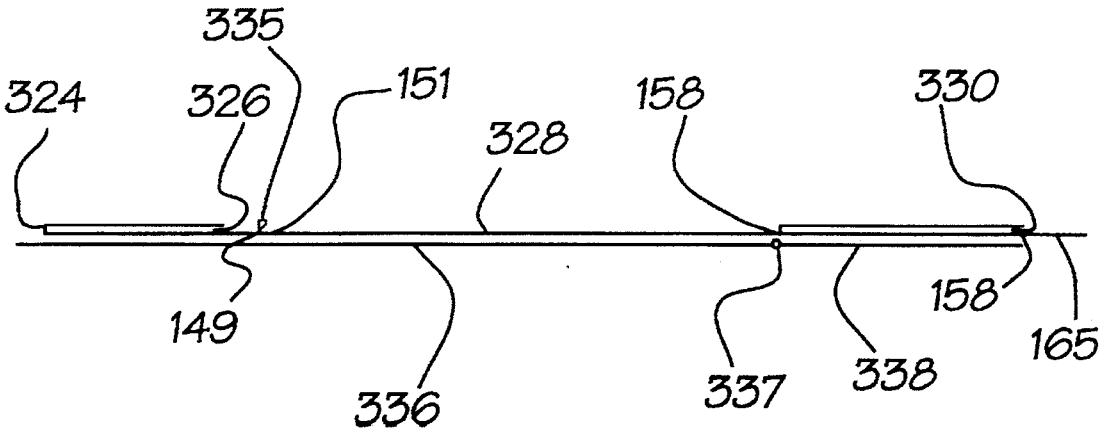
FIG. 26*a* is a side view of the envelope/business form of FIG. 26 before process has begun.
Figure 26B:
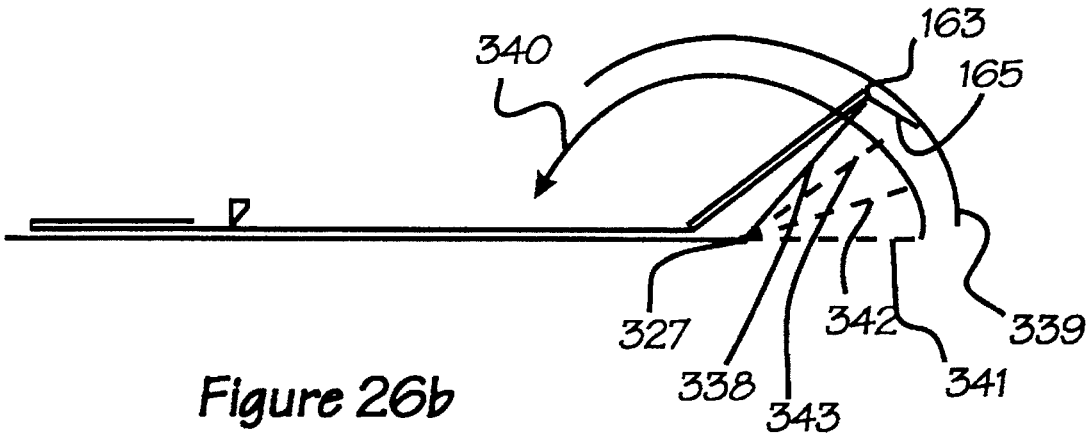
FIG. 26*b* is a side view of the process of folding back the flap on the return reply envelope.
Figure 26C:
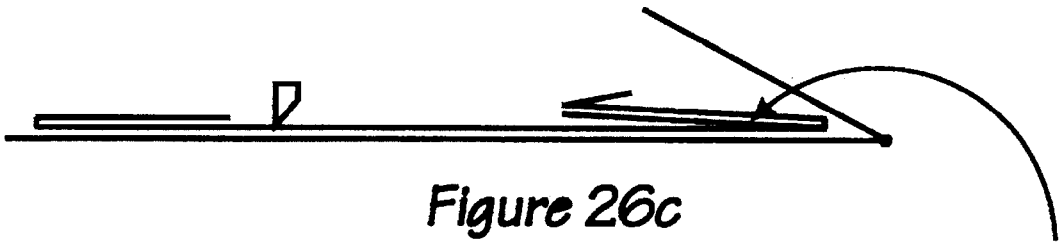
FIG. 26*c* is a side view of the flap of the return reply envelope at the completion of the cycle of FIG. 26*b;*

FIG. 26 shows the form 141 with the face of envelopes 300 and 302, and the face of invoice 301 facing downwardly. The process of folding and inserting will now be described. As form 141 exits die 313, it is fed under bursting bar 335 as seen in FIG. 26*a*. The form 141 is fed continuously along equipment surface 336 until line of weakness 158 is superimposed directly above pivot 337. Form 141 is situated on surface 336 with opening 326 of envelope 300 and opening 330 of envelope 302 facing upward. Swing plate 338, having integral vacuum ports (not shown) and pivoting about hinge 337 from its rest position 341, urges envelope 302 upwardly so that flap 165 comes in contact with arc bar 339, bending flap 165 downwardly at fold line 163. Swing arm 338 continues its arc through positions 342 and 343, pushing envelope 302 in the direction of 340. Upon completion of this arcing movement, swing arm 338 will have rotated approximately 180°, resulting in flap 165 touching the face of envelope 302 as depicted in FIG. 26*c*. Swing arm 338 then returns to its original position 341.

Figure 26D:
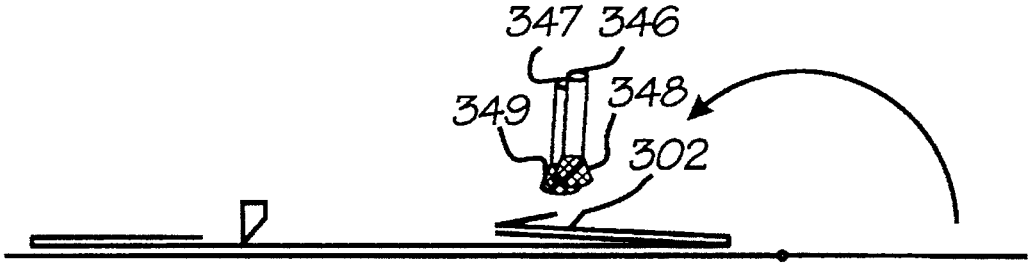
FIG. 26*d* is a side view of vacuum tubes as they engage the return reply envelope to begin the process of loading it into the mailing envelope.

Vacuum tubes 346 and 347 shown in FIG. 26*d*, with attached rubber suckers 348 and 349, descend upon flap 165 and the face of envelope 302. The movement of vacuum tubes 346 and 347 is controlled by a suitable mechanical linkage (not shown). The exact mechanical actuating means by which vacuum tubes 346 and 347 are caused to move is a matter of design choice well known to the skilled artisan. Suction is applied to both flap 165 and envelope 302, thereby enabling vacuum tubes 346 and 347 to manipulate said envelope 302 toward its eventual insertion into envelope 300. Vacuum tubes 346 and 347 with envelope 302 and flap 165 held in place by vacuum, move slightly upward and in a path toward the opening 326 of envelope 300.

Figure 26E:
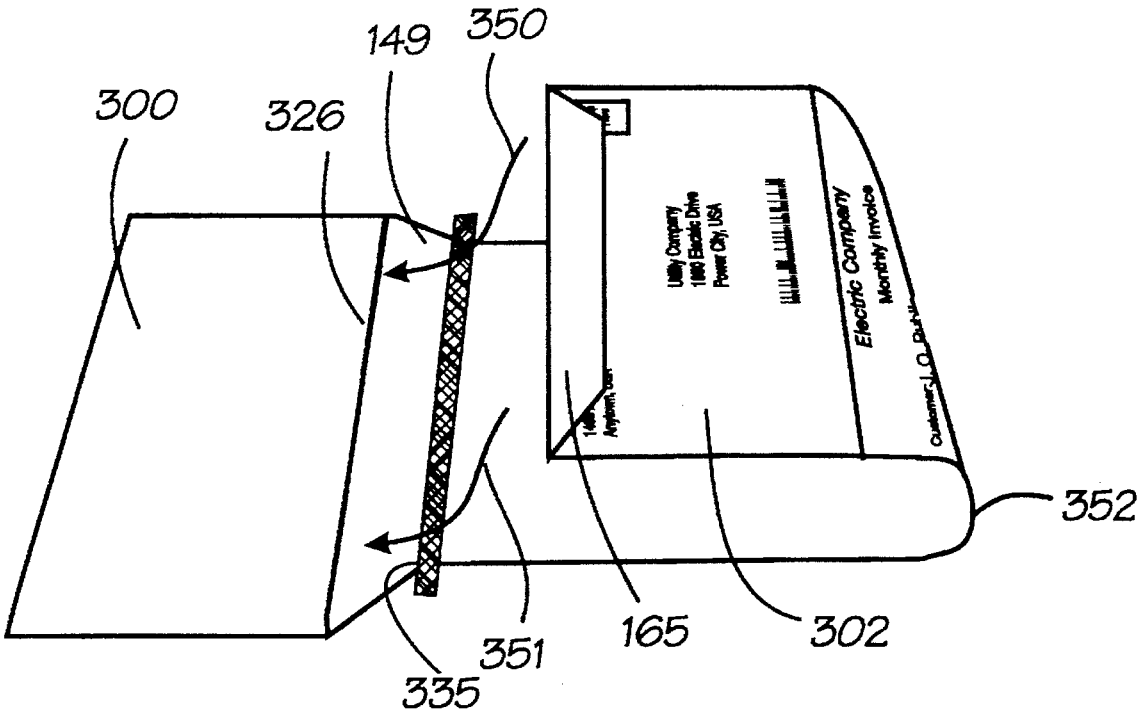
FIG. 26*e* is a perspective view of the return reply envelope as it begins the backwards and downwards path toward the mailing envelope.

FIG. 26*e* shows an unobstructed and somewhat exaggerated view of the arc 352 being formed in invoice 301 by the movement of envelope 302 toward the opening 326 of envelope 300. The vacuum tubes 346 and 347 will ultimately move flap 165 and envelope 302 in the direction of arrows 350 and 351.

Figure 26F:
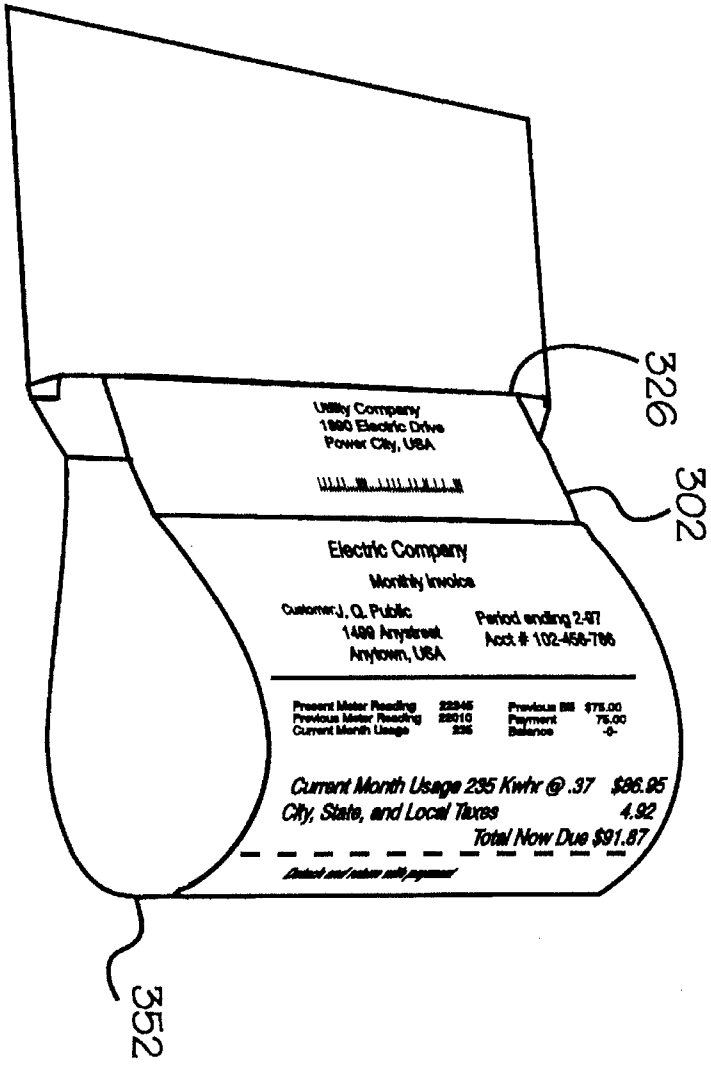
FIG. 26*f* is a perspective view of the return reply envelope partially inserted into the mailing envelope.
Figure 26G:
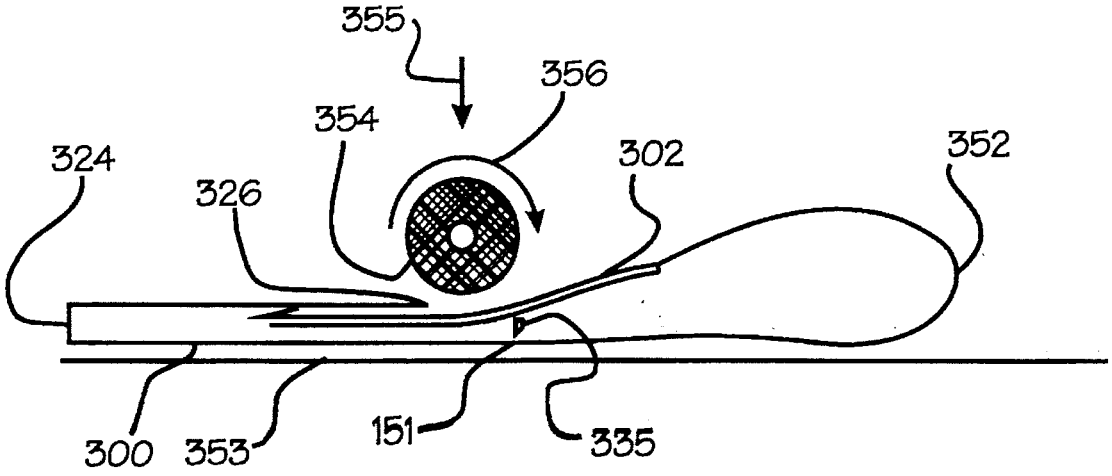
FIG. 26*g* is a side view of the return reply envelope as it is rolled further into the mailing envelope.

The vacuum tubes 346 and 347 descend toward opening 326, said opening being forced open by blasts of compressed air from compressed air jets (not shown) located in burster bar 335. FIG. 26*f* shows envelope 302 partially inserted into opening 326 of envelope 300. After insertion of flap 165 into opening 326, vacuum tubes 346 and 347 release the negative vacuum pressure holding said flap to rubber suckers 348 and 349, and vacuum tubes 346 and 347 retreat to their original position.

To further urge envelope 302 into envelope 300, rubber roller 354 descends in the direction 355 to contact envelope 302 in the area between burster bar 335 and opening 326. Roller 354, driven by suitable means (not shown) is rotated in the direction 356 until envelope 302 has been fully inserted into envelope 300 and come into contact with envelope bottom 324. Envelope 300 is prevented from moving along with envelope 302 due to burster bar 335 applying a slight downward clamping pressure onto separation line 151.

Figure 26H:
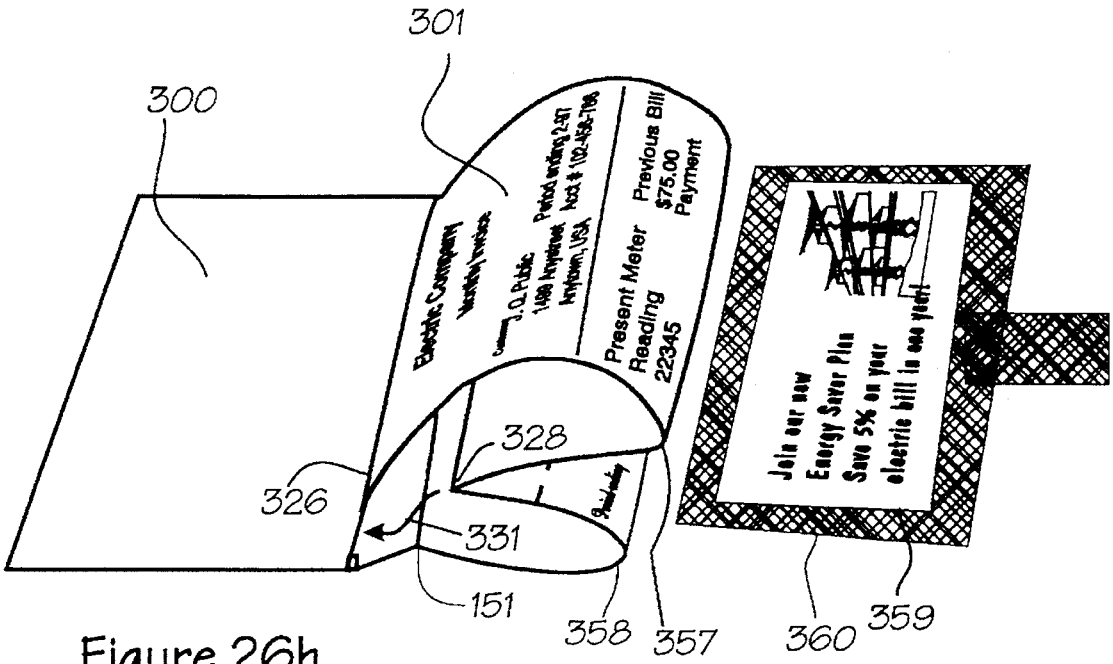
FIG. 26*h* is a perspective view of the hybrid envelope/business form of FIG. 14 with the return reply envelope fully inserted into the mailing envelope and an insertion ram moving toward invoice.
Figure 26I:
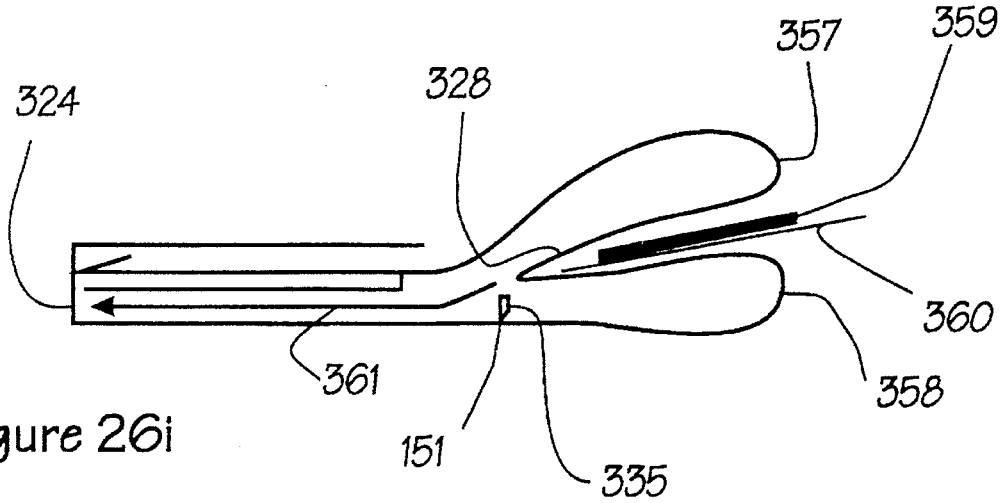
FIG. 26*i* is a side view of the insertion ram forcing the half fold of the invoice toward the mailing envelope.

To urge invoice 301 into envelope 300, insertion ram 360 of FIG. 26*h* is shown holding supplemental printed advertising materials 359. Ram 360 moves toward bend 352, thereby pushing invoice 301 at folding crease line 328 in the direction of 331.

As shown in the side view of FIG. 26*i*, insertion ram 360 continues pushing crease 328 toward envelope 300 in direction 361. Once crease 328 is inserted approximately half way into envelope 300, burster bar 335 descends with substantially its complete force applied along separation line 151, thereby bursting crease 151 and severing trailing edge 362 from envelope 300. The insertion ram continues to push crease 328 into envelope 300 until it reaches envelope bottom 324. Upon the retreat of insertion ram 360, advertising materials 359 are ejected into envelope 300 by means of air pressure blasts from ports (not shown) formed within insertion ram 360.

The envelope 300 is now loaded and may be closed and sealed using conventional envelope sealing equipment. Such equipment is well known to those skilled in the art of mass mailing envelope stuffing and sealing technology. The above mentioned method will work on any design of form 141 as depicted in FIG. 14 where one half the length of invoice 301, as measured between perforation 235 and crease 151, is equal to or less than the distance between fold line 146 on envelope 300 and bottom 324.

When one half the length of invoice 301 is greater than the height of envelope 300, as measured from bottom 324 to fold line 146, another folding and insertion method must be used. Such a method is shown in FIGS. 28*a*, 28*b*, 28*c*, 28*d*, and 28*e*.

Figure 28A:
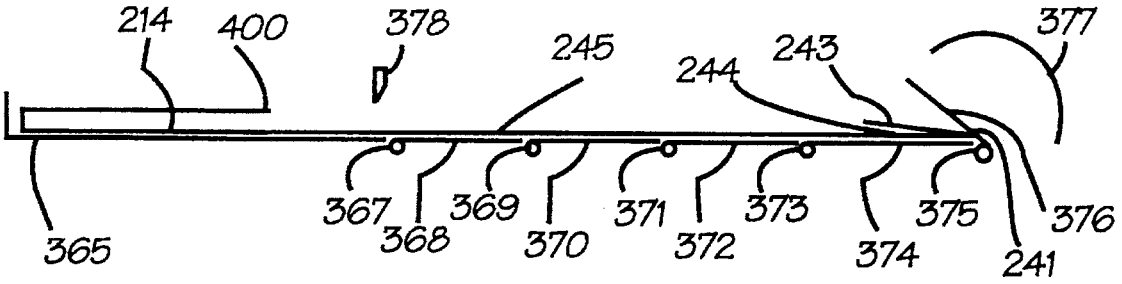
FIG. 28*a* is a side view of the hybrid form of FIG. 17 as it begins the first stage of the folding process.
Figure 28B:
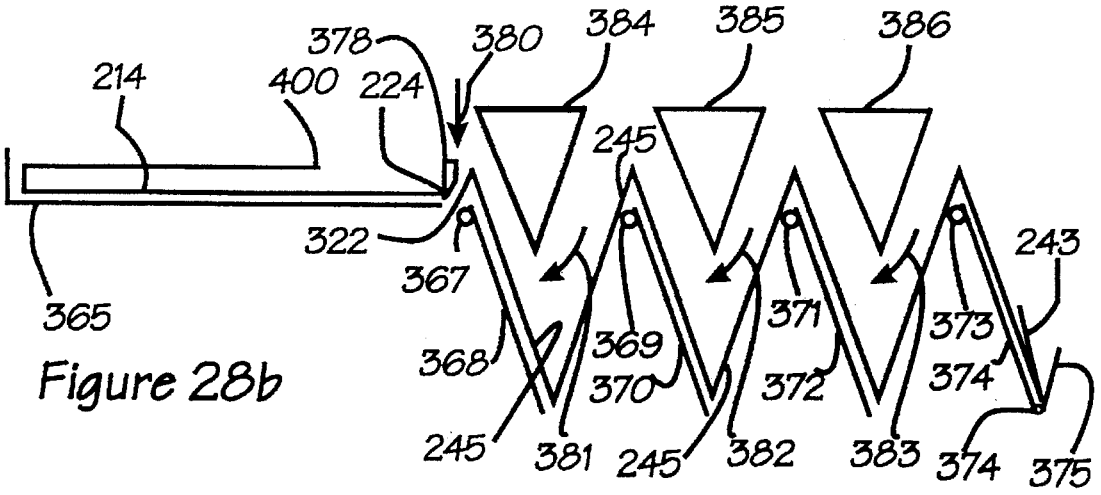
FIG. 28*b* is a side view of the process of folding pleats into the form of FIG. 28*a;*

The folding of form 245 as illustrated in FIG. 17 will now be described. Form 245 is die cut in substantially the same manner, but with a different die, as described previously for form 141. Subsequent to die cutting, form 245 as depicted in FIG. 28*a* is fed onto surface 365 and advanced until fold line 241 is superimposed directly over pivot hinge 375. Rather than lifting the entire envelope as was done to envelope 302, swing arm 376 rotates about pivot hinge 375 following arc 377, folding only flap 243 against the back side of envelope 244. As swing arm 376 returns to its original position, burster bar 378 descends in the direction of arrow 380 as seen in FIG. 28*b* onto the top of flap crease 224, severing crease 224 from the trailing edge 322.

Next, swing arm 368, containing vacuum ports (not shown) applies negative vacuum pressure to the portion of invoice 225 superimposed directly above. With said invoice portion held in place by vacuum, swing arm 368 rotates, pivoting about hinge 367 following path 381, followed in turn by each consecutive swing arm 370, pivoting about hinge 369 along arc 382, etc. until each swing arm has retreated to the position shown in FIG. 28*b*. To aid in the forming of sheet 229 into an accordion shape, forming diamonds 384, 385, and 386 descend onto form 245, assisting the retreat of each swing arm. Upon completion of the forming of said swing arms, forming diamonds 384, 385, etc. retract to their original position.

Figure 28C:
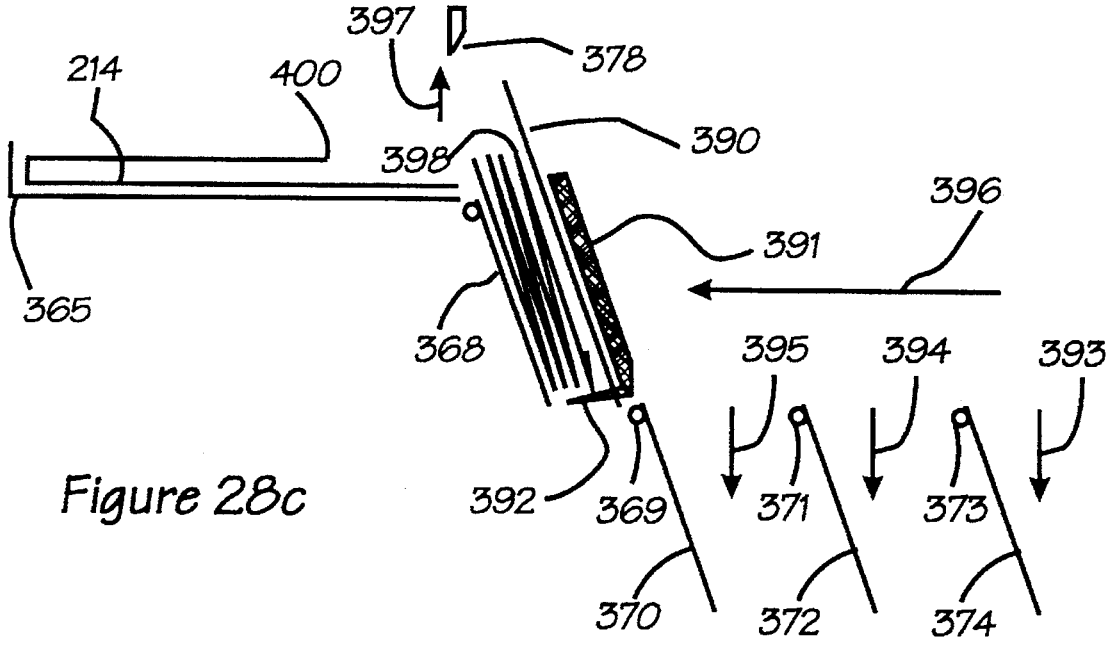
FIG. 28*c* is a side view of the process of gathering the folded pleats formed in FIG. 28*b;*
Figure 28D:
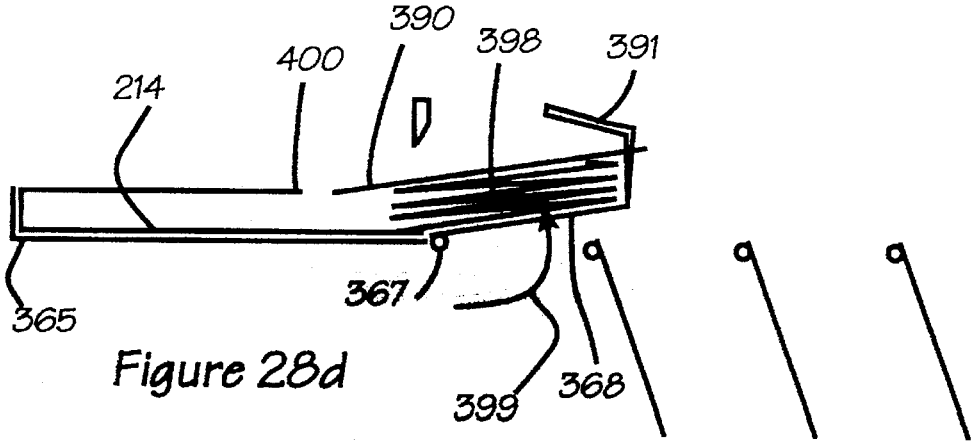
FIG. 28*d* is a side view of the gathered pleats of FIG. 28*c* being rotated upwards and in an arc toward the mailing envelope.

Then, swing arm 374 and pivot hinge 373 moves downwardly in direction 393 as shown in FIG. 28*c* in order to allow guide plate 390 and insertion ram 391 to move in the direction of arrow 396 so as to gather each formed pleat 398. Each successive swing arm and pivot hinge moves down until all pleats are gathered against swing arm 368. At this point burster bar 378 has moved upwardly in direction 397. Swing arm 368, guide plate 390 and insertion ram 391 then rotate about pivot hinge 367 in arc 399 to position form 245, now folded with pleats 398 for insertion into envelope 214. Guide plate 390 moves in direction 402 (See FIG. 28*e*) and lifts opening 400 of envelope 214 to aid in the insertion of form 398. Insertion ram 391 moves in direction 401, urging form 398 into envelope 214.

Figure 29:
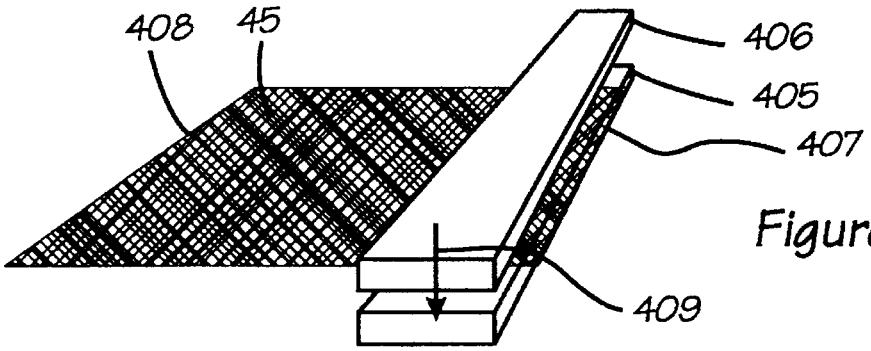
FIG. 29 is a perspective view of the pleating web entering the gusset forming members.

Referring now to FIG. 29, the operation of pleating members 405 and 406 will be described and differentiated from the pleating process depicted in FIGS. 11, 12, and 13. The pleating members in FIGS. 11, 12, and 13 move over the web in direction 136 and rotate in the direction 139 to form a double bottom gusset in web 41. Upon completion of the operation, pleating members 134 and 133 retract from web 41 in the direction of 140. The pleating operation described in FIGS. 11, 12, and 13 occurs on web 41 before it is severed by the action of drum 42 as best seen in FIG. 1.

Figure 30:
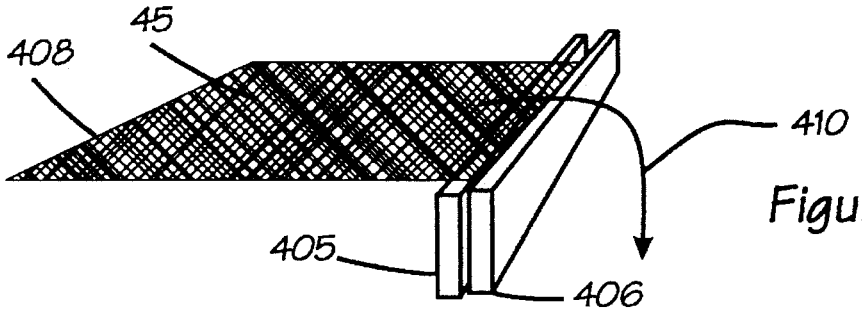
FIG. 30 is a perspective view of the partial rotation of the gusset forming members of FIG. 29.
Figure 32:
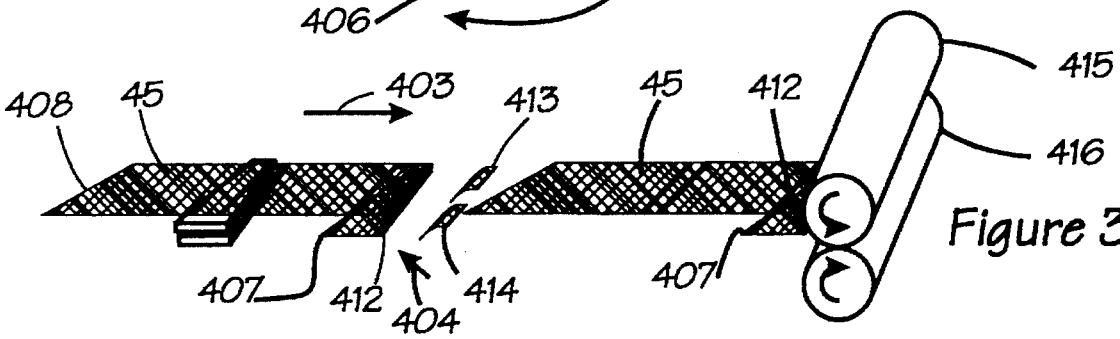
FIG. 32 is a perspective view of the finished bottom gusset as it proceeds toward guide plates and nip rollers.
Figure 33:
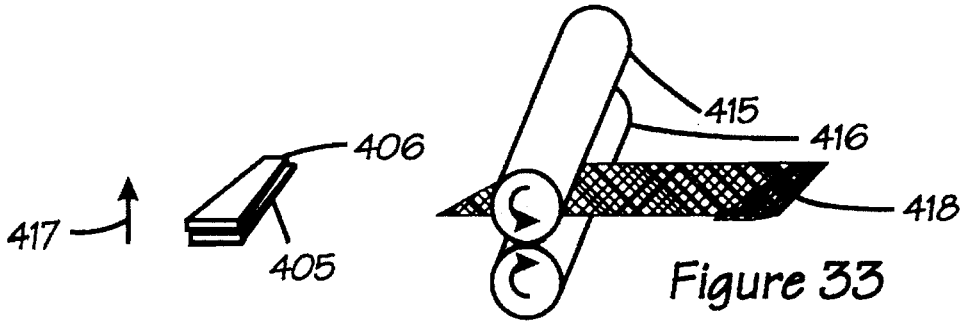
FIG. 33 is a perspective view of the finished bottom gusset of FIG. 32 as it exits the nip rollers.
Figure 34:
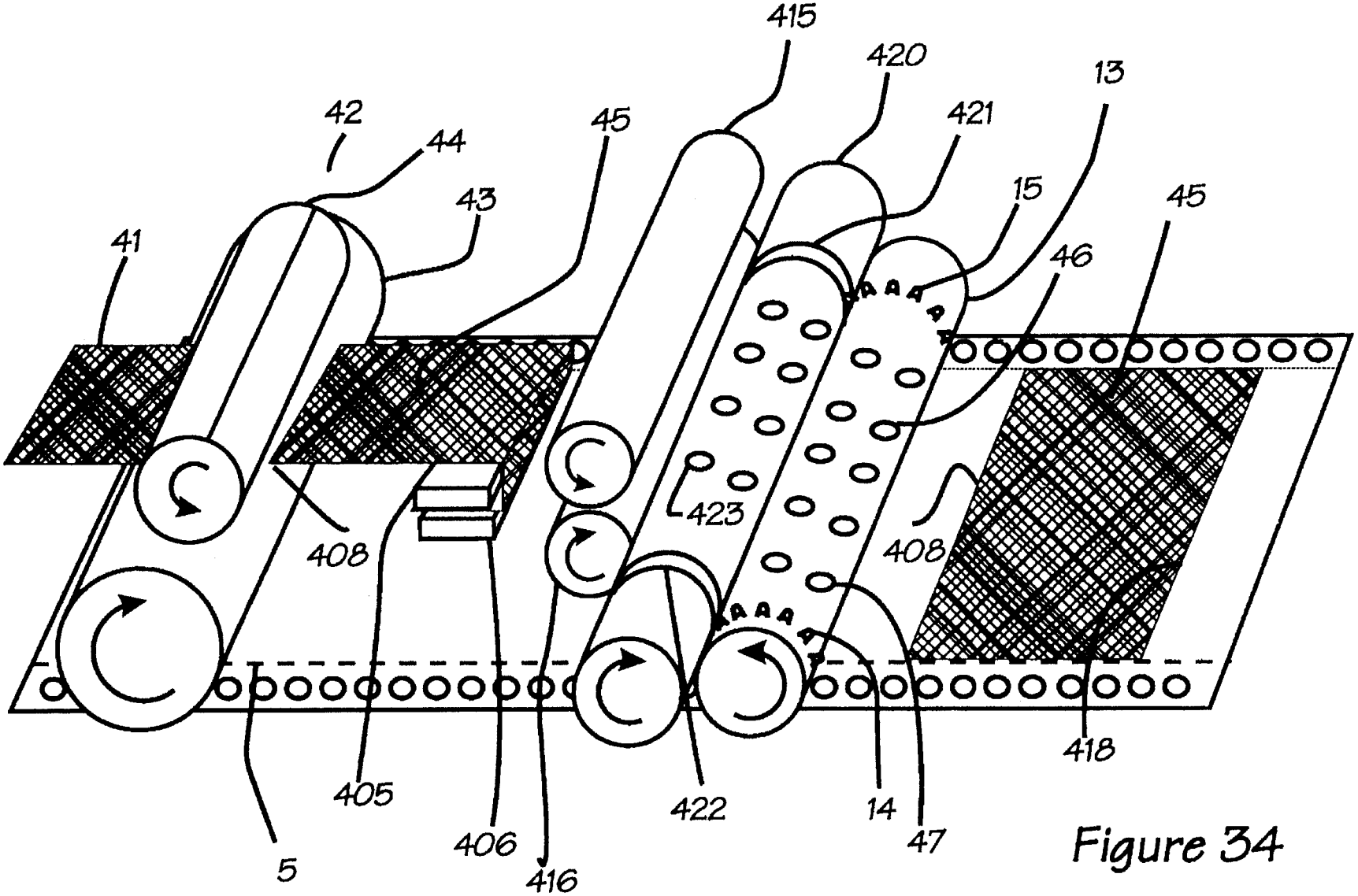
FIG. 34 is a perspective view of the gusset placement process of FIG. 1, showing the placement of the gusset in more detail.

In contrast, the pleating operations described in FIGS. 29, 30, 31, 32, and 33 occur after piece part 45 is severed from web 41 by die 42 as illustrated in FIG. 34. The leading edge 407 of piece part 45 moves between pleating members 405 and 406 as best seen in FIG. 29, such movement being controlled by the motion control logic 23 and stepper motor 50 which is attached to die 42 in FIG. 1. As mentioned previously for the formation of a double bottom gusset FIGS. 11, 12, 13, web 24 must be advanced at an increased rate for a short period in relation to web 5 in order to allow sufficient material to enter pleating members 406 and 405. After the proper length of piece part 45 is advanced to a region which is adjacent to said pleating members 405 and 406, web 24 may return to its previous rate, while member 406 moves downward toward 405 in the direction 409 to pinch piece part 45 between the pleating members 405 and 406. With leading edge 407 being firmly clamped between member 405 and 406, the pleating members 405 and 406 then rotate in the direction of arrow 410 as seen in FIG. 30, and continue in the direction of arrow 411 (see FIG. 31).

Upon completion of the rotation step, the pleating members 405 and 406 release pressure on part 45 and it is advanced in the direction indicated by arrow 403 illustrated in FIG. 32. New leading edge 412 engages guides 413 and 414 so as to deflect leading edge 412 in the direction indicated by arrow 404. Piece part 45 then moves into nip rollers 415 and 416, where the crease is "set". Upon completion of the pleating cycle, pleating members 405 and 406 move upward in the direction of arrow 417 and open, allowing the next cycle to begin.

Next, the bottom gusset forming process and the application of the second web to the first web will be described. FIG. 34 shows a more detailed and modified view of the printing press depicted in FIG. 1. The manufacturing process has been modified in this figure to accommodate a different bottom gusset forming procedure. The bottom gusset formation process described previously herein, and illustrated in FIGS. 11, 12, and 13, imparted a double fold to the bottom of the web 41 depicted in FIG. 1. This alternative bottom gusset formation process imparts a single fold to the web 41, as is commonly found in the envelope industry.

Upon exiting the pleat gathering rollers 39 and 40, as may be seen in FIG. 1, such rollers 39 and 40 being driven by a stepper motor and controlled by motion control logic (neither of these latter two components being shown for the sake of simplicity in the illustration), the pleated web 41 is then advanced through die cut rollers 42 and 43 as shown in FIG. 34. Die 42 severs piece part 45 from web 41 and feeds piece part 45 into a region adjacent to pleating members 405 and 406. The bottom gusset formation operation is described in detail previously herein and is illustrated in FIGS. 29–33.

The piece part is rolled through rollers 415 and 416, such rollers driven by a stepper motor (not shown) and controlled by motion control logic (not shown), and delivered to roller 420. Roller 420 holds piece part 45 in place by means of a vacuum supplied by vacuum ports 423, etc., and transfers piece part 45 to positioning roller 13. Position roller 13 rolls piece part 45 onto web 5 in precisely the exact, desired location. Such location is determined by the engagement of pins 14, 15, etc., into tractor feed holes 7 which have been previously punctured in web 5. The magnetic lobes on the end of roller 13 and the sensing mechanisms of the motion control logic have been described previously herein. Roller 420 contains two grooves 421 and 422 to permit the pins 14, 15, etc., on position roller 13 to rotate without interference.

The spacing of piece part 45 onto web 5 is determined according to customer specifications. Referring again to FIG. 14, the envelopes may be assembled with a gap of up to eight or more inches. FIG. 14 also shows two distinctly different width envelopes. This is necessary so that envelope 302 may be inserted into envelope 300. To accomplish the formation of envelopes having these different widths requires the addition of a third and separate supply web 24 of material (not shown), a second set of side pleat forming rollers as shown in FIGS. 3*a*, 3*b*, 3*c*, and 3*d*, a second set of bottom gusset pleating members of either the design shown in FIGS. 11, 12, and 13, or the type shown in FIGS. 29–33, a second die cut station 42, a second set of nip rollers 415 and 416 as seen in FIG. 33, and additional motion control software commands and stepper motors.

Similar manufacturing methods are utilized in order to apply pockets to business forms as shown in FIGS. 21 and 22. The process of applying a set of multipart carbon or carbonless business forms to web 5 will now be described. This construction would be desirable where the sending organization wishes to keep hard copies of the sent document.

Figure 35:
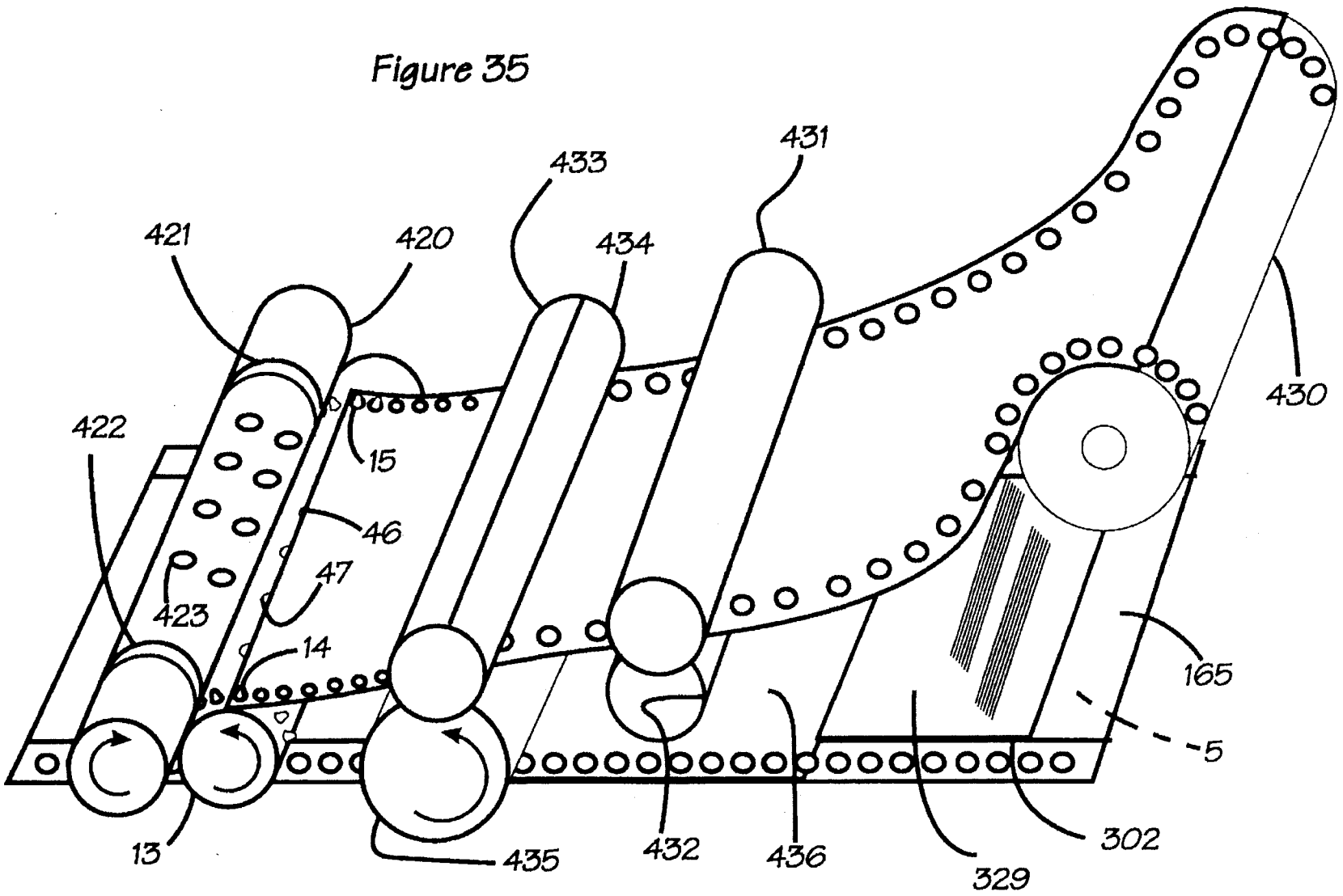
FIG. 35 is a perspective view of the process of transferring a multipart carbonless form to the web.

Referring to FIG. 35, roll 430 represents a continuous series of preprinted multipart carbon or carbonless business forms, with plies of said forms adhesively attached at the marginal edges, as is commonly practiced in the business forms industry. Forms 430 may be supplied in either roll or fan fold format.

Form 430 is moved forward by the rotation of nip rollers 431 and 432, such rotation being controlled by motion control logic 23 as depicted in FIG. 1. Die 433, upon which is mounted cutting blade 434, severs a predetermined length from form 430 and advances it along staging platform 437, in the direction of positioning roller 13.

Staging platform 437 is machined with grooves 441 and 442 to allow for the rotation of pins 14 and 15 without interference. Staging platform 437 resides above position roller 13 so that pins 14 and 15, etc. cannot come into contact with the awaiting form 443. Upon signals from logic 23, solenoid 439 exerts a downward force onto engagement roller assembly 438, thereby forcing staging platform 437 to pivot about hinge 445 and causing the prepunched tractor feed holes of 430 to engage with pins 14, 15, etc.

As with the transfer of gusset part 45 onto web 5, positioning roller 13 holds part 443 in place with a vacuum, supplied through ports 46, 47, etc. Upon contact of form 443 with web 5, positioning roller 13 releases said vacuum pressure and applies compressed air to the back of form 443 to aid in the transfer of form 443 to web 5. Form 443 may be adhesively attached to web 5 with patterns of adhesive dispensed from applicators 22 and 905, or may be crimped to web 5 using conventional crimping methods well known to those skilled in the art of business forms making.

The exact location or placement of form 436, as seen in FIG. 35, onto web 5 is a matter of design choice and can be determined by the forms customer. When imprinted by the sending organization, the multipart form would be imprinted using impact methods such as dot matrix, so that the carbon or carbonless feature of the multipart form can be activated. After imprinting, the tractor feed area will be die cut from the form as described earlier, and the multipart imprinted form can be retrieved by any suitable method and stored as hard copy evidence of the transaction. The remainder of the manufacturing process continues as previously described herei n and the final product may be fan folded or placed on rolls.

Figure 1A:
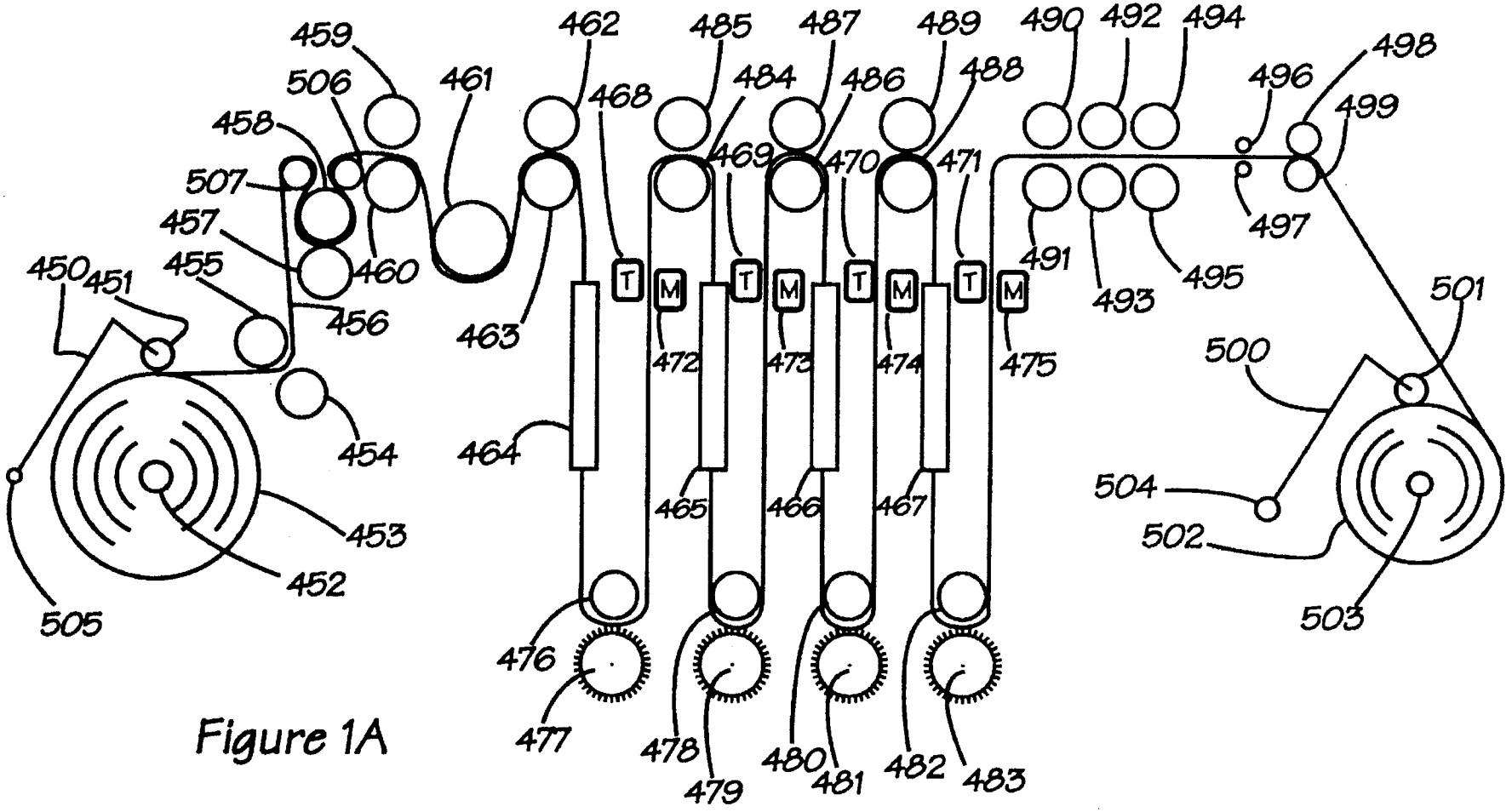
FIG. 1A is a schematic view of a press registration system constructed in accordance with the principles of the present invention.
Figure 1C:
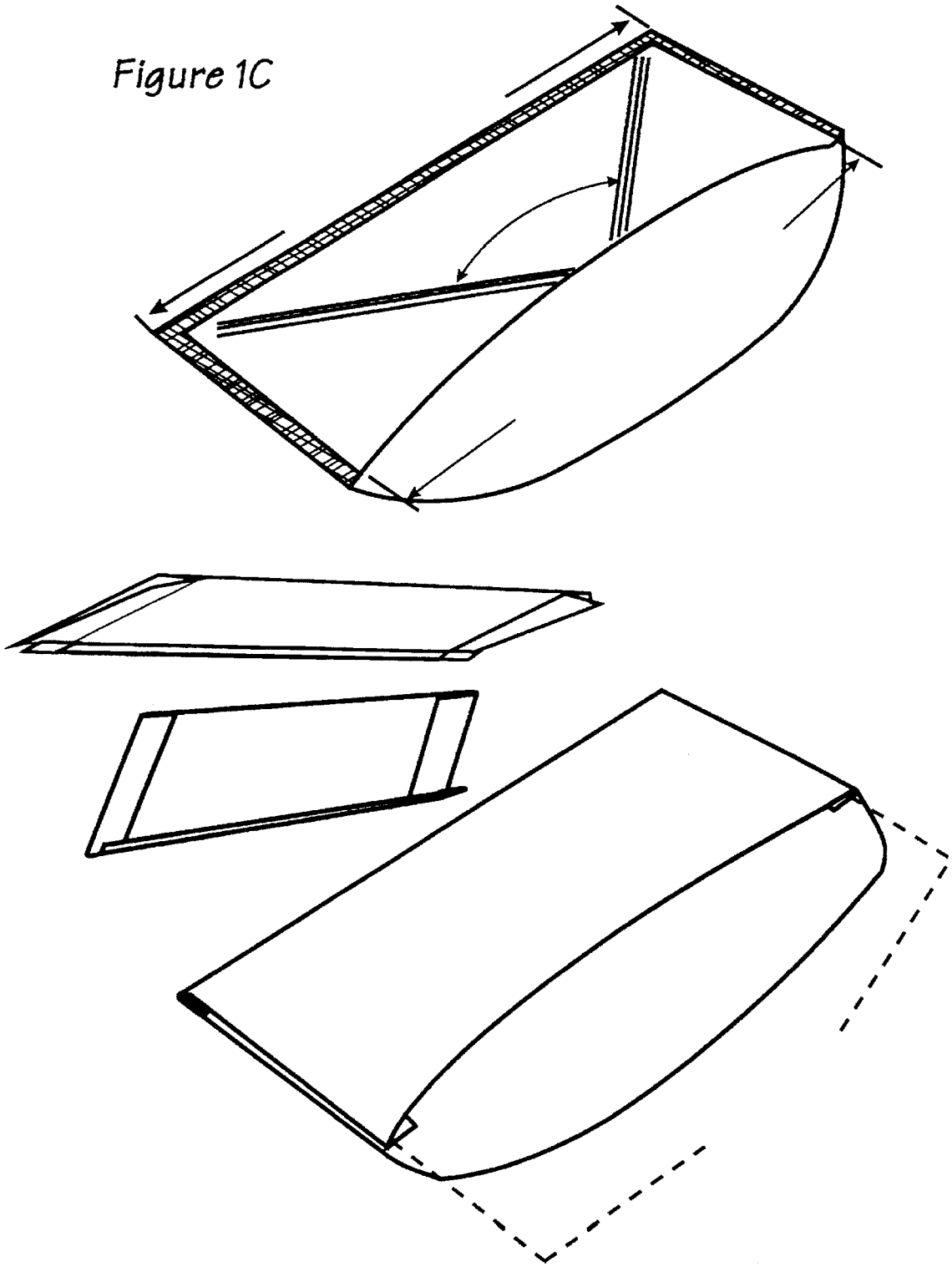
FIG. 1C is a perspective view of a pouch and an envelope.

The press registration system of FIG. 1A will now be described. The printing press shown in FIG. 1A is a generic flexographic press. However, the registration methods described herein may also be utilized on web offset, rotogravure, and all other such devices that must register a web to finishing operations. Such devices include, but are not limited to, plastic bag making machines, rewind and slitting machines, web fed punch machines including those which operate with reciprocal motion, and all other machines which perform repetitive processes upon a web.

Referring now to FIG. 1A, a full roll of web material 453 is shown on spindle 452. Said web roll 453 has in contact with the outer circumference thereon a roll follower 451, said follower roll 451 being mechanically attached to follower arm 450. Follower arm 450 with attached roller 451 is placed in contact with the circumference of feed roll 453 by the press operator subsequent to the placement of feed roll 453 onto spindle 452.

Follower arm 450 and attached roller 451 serve to constantly monitor the outer diameter of feed roll 453 by rotating about shaft 505, said shaft being attached to an absolute position optical encoder (not shown) or similar position sensing device. State of the art press designs incorporate the use of a similar follower arm. As stated earlier however, the purpose of said follower arm in those applications is to provide diameter feedback information to the feed roll braking system. Such is not the intended purpose of follower arm 450 in the preferred embodiment.

Upon loading feed roll 453 onto spindle 452, the press operator will enter pertinent data into a data entry keypad (not shown). The actual design of said keypad is a matter of design choice and said data may, in fact, be entered into the press motion control logic 23 by way of an ordinary computer keyboard. The pertinent data required by motion control logic 23 includes, but is not limited to, the published thickness of the feed roll web material, type of material (paper, plastic film, pressure sensitive label stock, etc.) such thickness being commonly referred to as "caliper" by those skilled in the art, estimated feet of web material to be used during the entire operation, desired web tension in pounds per square inch, and approximate projected press operating speeds.

Follower arm 450 pivots about the axis of shaft 505, said shaft 505 being mechanically connected to an optical encoding device (not shown). The optical encoding device provides an absolute reference signal to motion control logic 23, thereby informing control logic 23 of the exact diameter of feed roll 453 at all times. The press operator will then thread the press, drawing web material 456 manually from feed roll 453. Web material 456 is threaded through web guides 455 and 454, the purpose therein being to monitor and correct lateral movement of said web 456 through the press.

The web 456 is then threaded around idler roll 507, between meter rolls 457 and 458, and around idler roll 506. Meter roll 458 consists of vacuum holes (not shown) which pull web 456 toward meter roll 457, thereby increasing contact area. This arrangement is substantially different from the prior art of meter or nip rolls. The wrapping arrangement of FIG. 1A results in approximately a 300° contact area. This wrapping technique and increased contact area, combined with the normal contact area formed by matching meter roll 457 results in the highly reliable feed of web 456. Nip rolls are designed to grip the web and to transport the web. However, rather than propel said nip rollers by way of rotary motion derived from the main drive shaft, meter rolls 457 and 458 are powered by either stepper or intelligent position sensing servo motors (not shown), said motors receiving pulse or voltage signals from motion control logic 23. The process of determining the rate or frequency of such signals will be described herein.

The web 456 is threaded between caliper gauge 459 and gauging cylinder 460. Caliper gauge 459 is connected electrically to motion control logic and transmits a steady stream of data pertaining to the variations in thickness of incoming web 456. Caliper gauges are commonly available and may be obtained from Vollmer American, Incorporated, 5 Lime Kiln Road, Canaan, Conn. 06018.

Motion control logic 23 utilizes said thickness data to calculate the amount of remaining material on feed roll 453 and the feed rate thereof per feed roll revolution, to determine proper plate to web contact distances for transferring ink at optimum clarity, and to determine if minor adjustments to feed roll rate of rotation is indicated by variances in feed material caliper. Rewind rates for the stepper or servo motor (not shown) which powers rewind spindle 503 may also be influenced by material caliper.

The web is then threaded around web tension transducer 461, said transducer providing a constant stream of data to motion control logic 23 via electrical connections (not shown) regarding the tension being exerted upon the web. Tension transducers are commonly available from I.S.R. Transducer Division, 17150 Newhope Street, Fountain Valley, Calif. 92708. Control logic 23 utilizes said data to manipulate the rate of rotation of meter rolls 457, 458, 498 and 499 and to influence the rate or rotation of feed roll 453.

Web material 456 then enters the printing area between the print cylinder and attached printing plate 462 and impression cylinder 463. Components necessary for the transfer of ink from the ink receptacle to the plate are not shown. Such components and processes are well known to those skilled in the art.

Subsequent to ink transfer from plate 462 to web 456, said web enters dryer 464. State of the art ink dryers operate with many different methods including hot or room temperature air directed against said web at high velocities, infrared heat directed at the web, and ultraviolet rays directed at the web. The exact method of ink drying is immaterial. It is important to note that some ink formulations dry faster or more completely with varying combinations of heat and/or air velocity. It is also important to note that the degree of drying required after the application of ink from different ink stations is not consistent.

The current invention provides for the constant monitoring of web temperature and moisture content upon exiting dryers 464, 465, 466, and 467. Temperature sensors 468, 469, 470, and 471 provide a constant stream of data to motion control logic 23 pertaining to the temperature of web 456 as it exits each ink dryer. Moisture sensors 472, 473, 474 and 475 provide a similar data stream to logic 23 pertaining to the moisture content of said web. Temperature and moisture content sensors are known and can be obtained from W/W Engineering Company, 4323 West 32 nd Street, Chicago, Ill. 60623, and Emerson Apparatus, 170 Anderson Street, Portland, Me. 04101, respectively. Control logic 23, being preprogrammed with operating limitations of said web 456 prior to the initiation of press operation, can determine the proper amounts of air velocity, heat, or lack thereof to be applied to web 456 in each of the dryers 464, 465, 466, and 467. Control logic 23 can also utilize data from said temperature and moisture sensors to adjust web tension in order to prevent stretching. This is an especially important feature when performing press operations with plastic films which are easily susceptible to web stretching, especially upon exiting a heated ink dryer apparatus.

In order to adjust the web tension to new values, control logic 23 can vary the signals to the stepper or servo motors attached to meter rolls 457, 458, 498 and 499, commanding them to either advance or retard the rate of rotation.

The web material 456 proceeds through each printing station 484, 485, 486, 487, 488 and 499. Print to print registration is maintained and web movement detected by way of either of two methods.

The preferred method, shown partially employed in FIG. 1, utilizes tractor feed holes punched into the web 456 at the beginning of the press operation. When using tractor feed holes in a process as shown in FIG. 1A, the tractor feed punch unit would be located subsequent to infeed meter rollers 457 and 458 and prior to caliper gauge 459. A positioning roller 13 as depicted in FIG. 1 with an attached optical encoder or Hall Effect device would replace star wheels 477, 479, 481 and 483 shown in FIG. 1A. Such positioning rollers 13 would engage with the tractor feed holes in moving web 456, forcing said positioning rollers to rotate at the exact speed of the web, thereby providing reference signals to motion control logic 23.

In an alternative, but equally effective embodiment, where tractor feed holes are undesired, star wheels 477, 479, 481 and 483 penetrate web 456, forcing said star wheels to rotate at the exact speed of the web, such star wheels mechanically connected to optical encoding or Hall Effect sensing devices (not shown), thereby providing reference signals to motion control logic 23. To ensure positive penetration with web 456, idler rollers 476, 478, 480 and 482 are provided with grooves filled with a pliant material (not shown), said material allowing each star wheel to penetrate web 456 without damaging the sharp protrusions contained thereon. The grooves contained on idler rollers 476, 478, 480, and 482 are similar in purpose to grooves 51 and 52 on anvil roll 45 of FIG. 1. Star wheels 477, 479, 481, and 483 contact web 456 along a marginal edge to avoid destructive penetration marks in the "live" area of the web.

The reference pulse signals provided by the rotating positioning rollers 13, or the rotating star wheels 476, 478, 480, and 482 enable control logic 23 to calculate actual material flow and the rate thereof. Control logic 23 can also compare the reference signals from each positioning or star wheel to detect discrepancies, such discrepancies being a sign of web stretch, advance, retard, or, in the worst case, web breakage. As in the process shown in FIG. 1 and described herein, the reference signals are also used to enable control logic 23 to properly issue timing commands to stepper motors, said stepper motors driving dies 490, 492, and 494 FIG. 1A.

In order to maintain critical plate to plate and plate to die registration, stepper motors or intelligent servo motors provide the motive energy for plate cylinders 462, 485, 487, 489, and dies 490, 492, and 494. The stepper or servo motors on said plate cylinders and dies are equipped with absolute optical encoders (not shown). Optical encoders are well known. Optical encoders commonly contain an apertured disk and a photo interrupter device. The apertured disk is mechanically attached to a shaft and rotates at the speed of the shaft. The rotation of the apertured disk through the photo interrupter devices produces a series of equally timed pulses which are fed to a logical device for interpretation. An example of such a device is disclosed in U.S. Pat. No. 5,013,988, issued to Sakano. Sakano discloses an optical encoder utilizing a detecting disk, two light emitting diodes, and light detecting elements, thereby producing absolute and incremental reference signals in high speed applications.

The apertured code disk in the Sakano invention differs substantially from the code disks contained in incremental encoding devices. The apertured slits contained in state of the art incremental optical encoders are all of equal width, providing a fixed duration of optical signal cycling at a given rotation. The Sakano invention contains a code wheel with apertured slits of equal size and slits of varying size to provide absolute reference signals. The photo diode receptor devices and control circuitry contained in the Sakano invention relay not only the pulse to the control logic, but the duration of the pulse as well, such duration commonly referred to as dwell. Thus, by deciphering dwell times, the control logic can determine the exact location of the monitored shaft.

Referring again to FIG. 1A, printing plates are mounted on plate cylinders 462, 485, 487 and 489 with the leading edge of the plate in alignment with start position "Alpha" on attached stepper motor. In use, each print cylinder driving stepper motor reports its absolute position to motion control logic 23. With this information, control logic 23 can command an electrical solenoid (not shown) or servo motor to lift a plate cylinder off of web 456, cease or slow rotation of said plate cylinder and then resume proper rotation and contact with web 456. Motion control logic is receiving a steady data stream from caliper gauge 459, so proper plate to web alignment can be maintained when said solenoid or servo is commanded to return said plate cylinder to web.

The same registration process is used to locate printed information in the correct location for die cutting operations. Dies 490, 492, and 494 are rotationally driven by stepper motors containing the encoder described previously. The printed and die cut web 456 then travels between a second caliper gauge 496 and gauging roller 497. The web 456 is pulled from die caliper gauge 496 by stepper driven meter rolls 498 and 499.

Finally, web 456 is rewound onto rewind roll 502, said rewind roll being monitored by follower arm 500 and attached roller 500. Spindle 503 is equipped with a roller bearing one way clutch assembly (not shown) to prevent backwards rotation. Such one way roller bearing clutches are commercially available. Follower arm 500 is mechanically attached to shaft 504 which is in turn attached to the optical encoder (not shown) to transmit the absolute rewind roll diameter to control logic 23.

The motion control logic is capable of detecting out of round feed rolls and allowing the press to operate using such normally unusable material. As mentioned earlier, an out of round roll acts like a cam against follower arm 450. However, since the follower arm of the present invention serves only to relay feed roll diameter data to motion control logic, a repeated cam like movement of follower arm 450 will set a "pattern alarm" in the motion control logic. Once set, the motion control logic can anticipate the momentary accelerated payout of material associated with the out of round portion of the roll. Control logic 23 can momentarily decrease the pulse signals sent to the feed roll driving stepper or servo motor (not shown) to compensate for the increased feed characteristics of said out of round feed roll. Since no hold back force is activated, web tension remains constant.

The current invention avoids the registration problems caused by web shift and due to tension variations by powering the feed roll 453 and rewind roll 502 with a stepper or servo motor device (not shown). The motion control logic 23, knowing the exact diameter of feed roll 453 and rewind roll 502, the incoming and exiting caliper of said web 456, current web tension from transducer 461, the exact rate of material flow past positioning roller 13 or star wheels 477, 479, 481, and 483, and being in control of the rate of rotation of feed roll 453, rewind roll 502, incoming meter rolls 457 and 458, and exiting meter rolls 498 and 499, and being initially programmed with the desired rewind tensions and operating characteristics of said web material 453, can logically control the entire manufacturing process, including adjusting dryer temperature and air velocity, plate to plate and plate to die registration using absolute positioning, and said motion control logic can make efficiency recommendations to the press operator.

Figure 39:
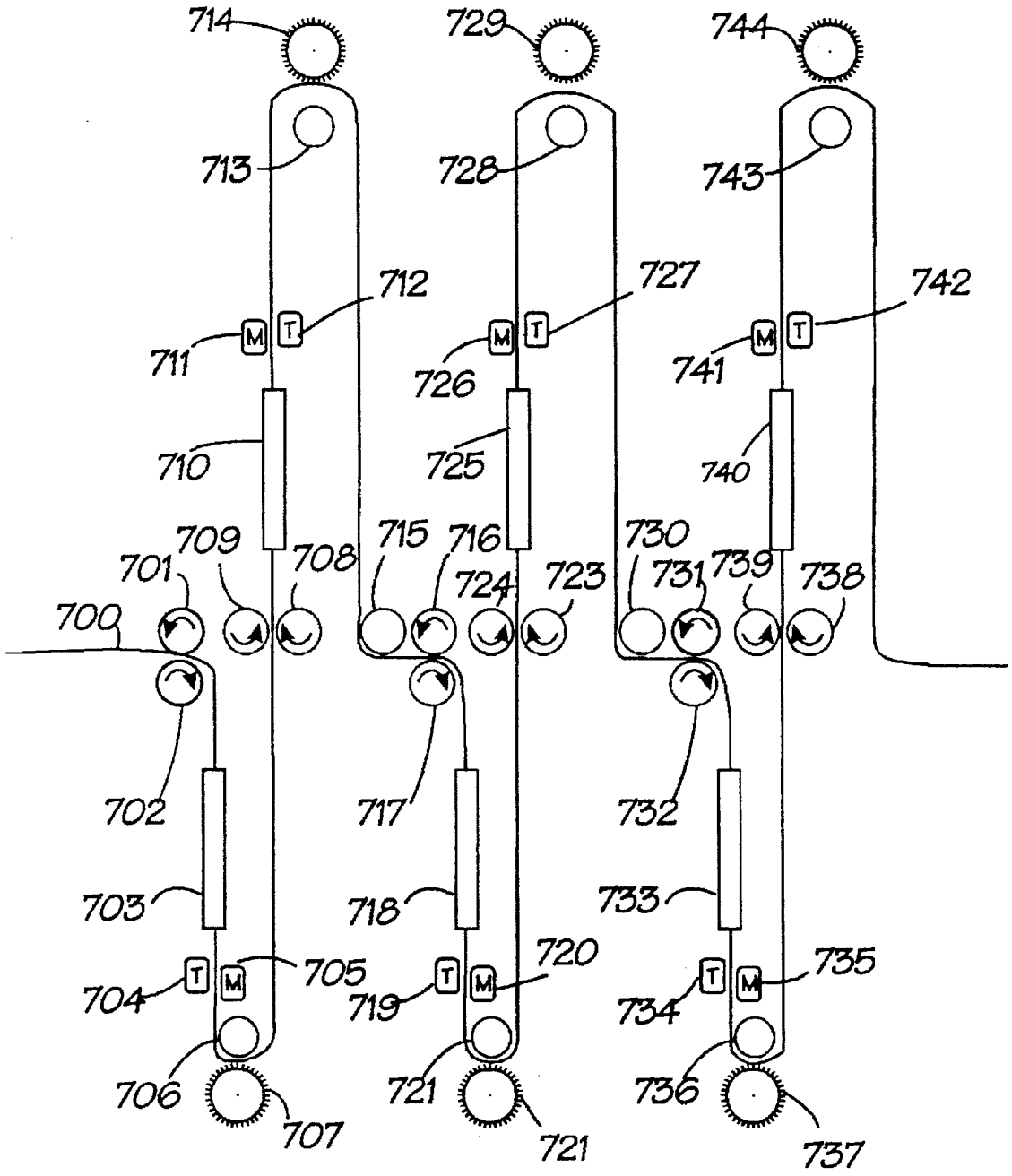
FIG. 39 is a schematic view of a press incorporating printing on the reverse side of the web without the use of a web reverse device, constructed in accordance with the principles of the present invention.

The disadvantage of a web reverse device have been previously disclosed. FIG. 39 depicts a highly advantageous adaption of the press described in FIG. 1A, by eliminating the need for a web reverse device. Referring now to FIG. 39, web material 700 exits roll 461 FIG. 1A to proceed to printing cylinder 701. Upon print cylinder 701 is mounted a printing plate (not shown) to transfer ink from an inking device (not shown) onto the top side of web 700. Print cylinder 701 rotates in counterclockwise direction, pressing web against impression cylinder 702 and accomplishing ink transfer. Web 700 then enters dryer 703 and passes across temperature sensor 704 and moisture sensor 705. Web 700 passes around idler roller 706 and comes in contact with position sensor 707.

In a normal press, web 700 would then proceed to each subsequent printing station for the additional application of ink to the top surface of the web material. Only after all preferred ink applications are accomplished on the top surface of the web, would the web then be turned by a web reverse device, whereupon the underside of the web would receive applications of ink. The current invention eliminates the necessity of applying consecutive ink applications to the top surface and then to the underside surface.

After exiting position sensor 707 web 700 proceeds directly to print cylinder 708 and impression cylinder 709. Print cylinder 708 contains a printing plate (not shown) to transfer ink images onto the underside of web 700. From print cylinder 708 web 700 proceeds through dryer 710, moisture sensor 711, temperature sensor 712, position sensor 714 and around idler 713, whereupon it begins a downward travel toward idler 715 and the application of a second color of ink to the top side of web 700. The process repeats itself until all colors of ink are applied to both sides of web 700 at which time web 700 is routed into the finishing operations as shown in FIG. 1A.

By eliminating the web reverse device, this embodiment affords numerous advantages including faster set up time and more accurate registration, both printing plate to printing plate, and printing plates to finishing tools.

Position sensors 707, 721, 737, 714, 729, and 744 FIG. 39 supply constant web movement information to motion control logic 23 FIG. 1. Moisture sensors 705, 720, 735, 711, 726, and 741, along with temperature sensors 704, 719, 734, 712, 727, and 742 provide feedback to motion control logic 23 so that air temperature and air velocity within dryers 703, 718, 733, 710, 725, 740 can be properly maintained to provide optimum drying without web heat buildup. It is important to note that unlike conventional presses, the data received from the multitude of moisture and temperature sensors enable the motion control logic to vary the drying parameters to each individual dryer. Thus, dryers toward the end of the press may actually cool the web to counteract the effects of heat buildup. Such individualized drying parameters not only ensure optimum drying, but also reduce energy consumption.

The press features disclosed in FIGS. 1, 1A, and 39 may be incorporated in whole or in part into a single press. When incorporated in whole, the present invention provides a method for eliminating web movement at the feed roll, making minor adjustments to the printing and finishing operations that may be required due to web shift from ink absorption and heat accumulation, maintaining print registration one plate to another and from printing plates to finishing tools, eliminating the need for a web reverse device, and for maintaining accurate rewind tension at the finishing end of the press.

Figure 3A:
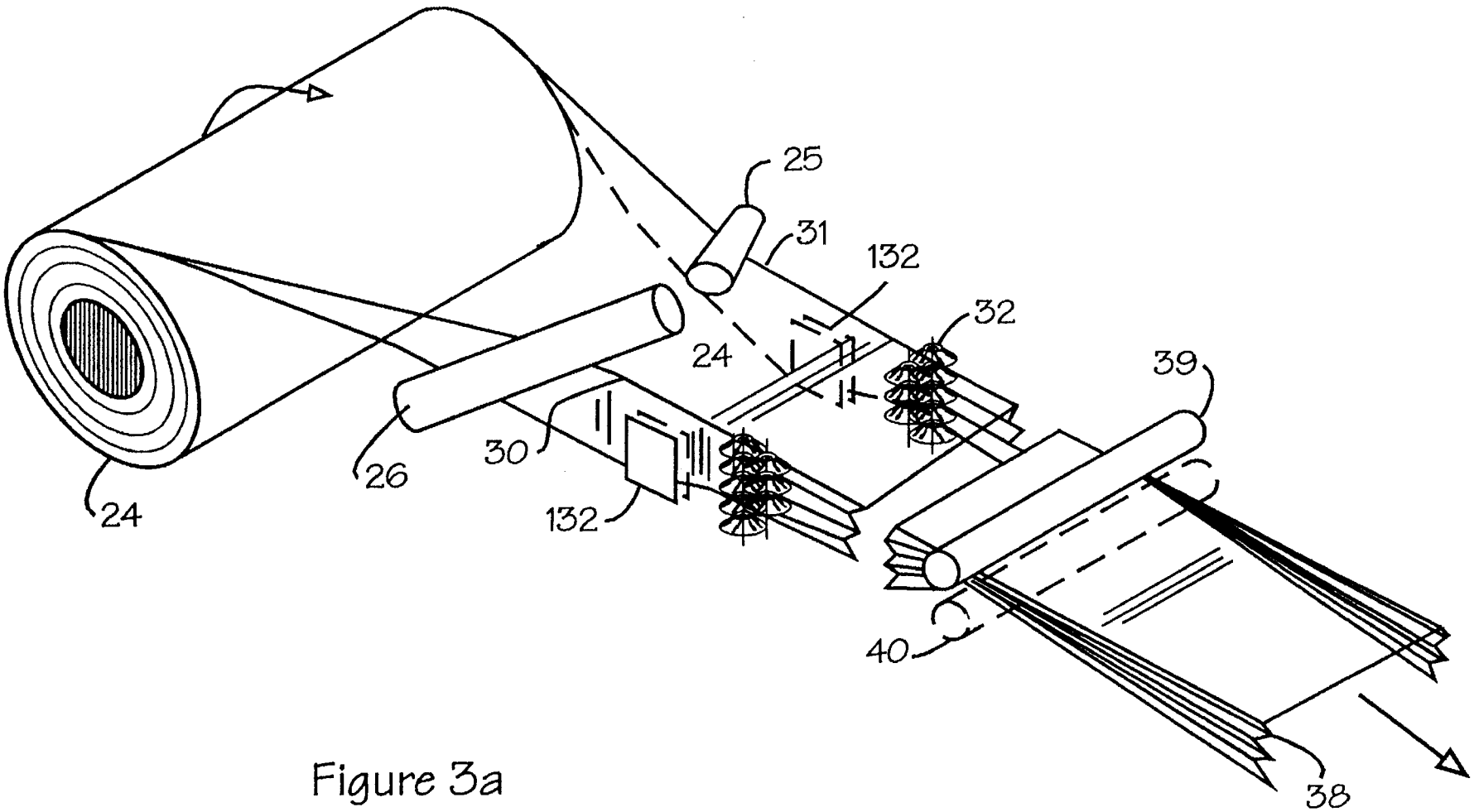
FIG. 3*a* is a pictorial detail of the crease rollers and pleating rollers as depicted in the apparatus of FIG. 1.

The following list of elements and their associated identifying numerals is presented below to simplify location of components referred to herein:

| | | |
|---|---|---|
| 1 | Printing press & method of manufacture-generally | FIG. 1 |
| 2 | Main supply roll of material | FIG. 1 |
| 3 | Printed side of main web, after turn bar facing down | FIG. 1 |
| 4 | Finished envelope on main web | FIG. 1 |
| 5 | Main web as it comes off main roll | FIG. 1 |
| 6 | Web Guide | FIG. 1 |
| 7 | Web Guide | FIG. 1 |
| 8 | Print station | FIG. 1 |
| 9 | Print station | FIG. 1 |
| 10 | Print station | FIG. 1 |
| 11 | Male portion tractor-feed punch device | FIG. 1 |
| 12 | Female portion tractor-feed punch device | FIG. 1 |
| 13 | Position roller with protruding pins | FIG. 1 |
| 14 | Tractor pins on positioning roller | FIG. 1 |
| 15 | Tractor pins on positioning roller | FIG. 1 |
| 16 | Tractor feed holes punched in main web | FIG. 1 |
| 17 | Tractor feed holes punched in main web | FIG. 1 |
| 18 | First 45° bar on web reverse unit | FIG. 1 |
| 19 | Second 45° bar on web reverse unit | FIG. 1 |
| 20 | Turn-about roller | FIG. 1 |
| 21 | Main web on its back side | FIG. 1 |
| 22 | Adhesive application station or remoistenable | FIG. 1 |
| 23 | Motion control circuitry | FIG. 1 |
| 24 | Web of paper prior to pleating | FIG. 1 |
| 25 | 45° angle 1st pleat roller | FIGS. 1, 3a, c, d |
| 26 | 45° angle 1st pleat roller | FIGS. 1, 3a, c, d |
| 27 | Underside of web 24 | FIGS. 1, 3c, d |
| 28 | Cantilevered roller | FIG. 3c |
| 29 | Cantilevered roller | FIG. 3c |
| 30 | Pointing to right hand 90° fold in pleating web | FIG. 3a, d |
| 31 | Pointing to left hand 90° fold in pleating web | FIG. 3a, d |
| 32 | Diamond shaped pleating rollers | FIG. 1, 3a, b |
| 33 | Diamond shaped pleating rollers | FIG. 1, 3a, b |
| 34 | Diamond shaped pleating rollers | FIG. 1, 3b |
| 35 | Diamond shaped pleating rollers | FIG. 3b |
| 36 | Diamond shaped pleating rollers | FIG. 3b |
| 37 | Diamond shaped pleating rollers | FIG. 3b |
| 38 | Pleated web as it enters pleating set rollers | FIG. 1 |
| 39 | Pleat gathering roller top | FIG. 1, 3a |
| 40 | Pleat gathering roller bottom | FIG. 1, 3a |
| 41 | Pleated web before die cutting | FIG. 1, 3a |
| 42 | Die cutting assembly-generally | FIG. 1 |
| 43 | Anvil roll | FIG. 1 |
| 44 | Die | FIG. 1 |
| 45 | Gusset part individually, suction to anvil roll | FIG. 1 |
| 46 | Vacuum hole in positioning roller 13 | FIG. 1 |
| 47 | Vacuum hole in positioning roller 13 | FIG. 1 |
| 48 | Magnetic reference | FIG. 1 |
| 49 | Sensor-reluctor | FIG. 1 |
| 50 | Stepper motor attached to die assembly | FIG. 1 |
| 51 | Grooves in anvil roll | FIG. 1 |
| 52 | Grooves in anvil roll | FIG. 1 |
| 53 | Envelope loader/imprinter- generally | FIG. 10 |
| 54 | Web guide envelope loader | FIG. 2 |
| 55 | Surface traveling area for envelope | FIG. 10 |
| 56 | Supply roll of thermal ribbon for imprinting-loader | FIG. 2, 10 |
| 57 | Thermal ribbon on envelope loader | FIG. 2, 10 |
| 58 | Dancer tension control roller envelope loader | FIG. 2 |
| 59 | Dancer tension control roller envelope loader | FIG. 2 |
| 60 | Web guide on envelope loader | FIG. 2 |
| 61 | Thermal print head-envelope loader | FIG. 2 |
| 62 | Used thermal ribbon-envelope loader | FIG. 2 |
| 63 | Peel bar-envelope loader | FIG. 2 |
| 64 | Thermal ribbon take-up spool- envelope loader | FIG. 2 |
| 65 | Pin feed drive assembly-envelope loader | FIG. 2 |
| 66 | Queue area-envelope loader | FIG. 2, 10 |
| 67 | Die cut station-envelope loader | FIG. 2, 10 |
| 68 | Die-envelope loader | FIG. 2 |

-continued

Figure 8:
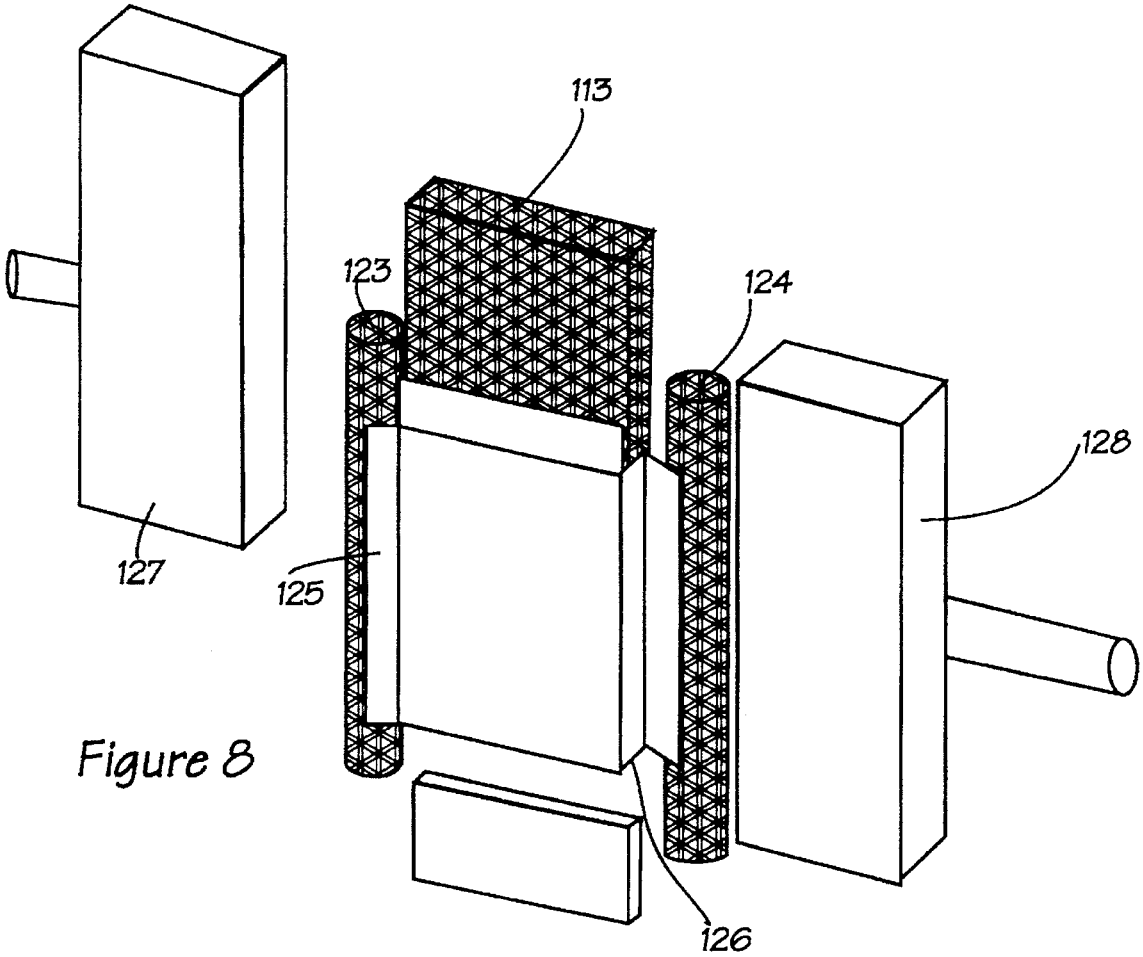
FIG. 8 is a pictorial representation of a third step in assembling a box as utilized by the apparatus depicted in FIG. 4.

| | | |
|---|---|---|
| 69 | Individually cut envelope-envelope loader | FIG. 2 |
| 70 | Insertion ram-envelope loader | FIG. 2 |
| 71 | Product to be loaded-envelope loader | FIG. 2 |
| 72 | Product to be loaded | FIG. 2 |
| 73 | Product to be loaded | FIG. 2 |
| 74 | Product to be loaded | FIG. 2 |
| 75 | Product partially inserted into envelope | FIG. 2 |
| 76 | Supply roll-raw stock for box making | FIG. 4 |
| 77 | Web of box material | FIG. 4 |
| 78 | Web guide-box press | FIG. 4 |
| 79 | Print station-box preas | FIG. 4 |
| 80 | Print station-box press | FIG. 4 |
| 81 | Print station-box press | FIG. 4 |
| 82 | Web guide-box press | FIG. 4 |
| 83 | Web reversal unit-box press | FIG. 4 |
| 84 | First 45° angle bar-reverse unit-box press | FIG. 4 |
| 85 | Vertical transition roller-box press | FIG. 4 |
| 86 | Second 45° angle bar-reverse unit-box press | FIG. 4 |
| 87 | Web guide-box press | FIG. 4 |
| 88 | Web guide-box press | FIG. 4 |
| 89 | Web guide-box press | FIG. 4 |
| 90 | Pattern adhesive applicator-box press | FIG. 4 |
| 91 | Tractor-feed punch unit-box press | FIG. 4 |
| 92 | Tractor-feed hole in box web | FIG. 4 |
| 93 | Tractor-feed hole in box web | FIG. 4 |
| 94 | Pattern of adhesive on box | FIG. 4 |
| 95 | Web guide-box loader | FIG. 5 |
| 96 | Work surface-box loader | FIG. 5 |
| 97 | Box loader-generally | FIG. 5 |
| 98 | Thermal ribbon supply roll-box loader | FIG. 5 |
| 99 | Thermal ribbon-box loader | FIG. 5 |
| 100 | Web guide-box loader | FIG. 5 |
| 101 | Dancer roller for thermal ribbon-box loader | FIG. 5 |
| 102 | Dancer roller for thermal ribbon-box loader | FIG. 5 |
| 103 | Thermal print head-box loader | FIG. 5 |
| 104 | Bar code on box | FIG. 9 |
| 105 | Peel bar-box loader | FIG. 5 |
| 106 | Used thermal ribbon-box loader | FIG. 5 |
| 107 | Roll of used thermal ribbon-box loader | FIG. 5 |
| 108 | Pin feed drive unit-box loader | FIG. 5 |
| 109 | Rotary die-box loader | FIG. 5 |
| 110 | Cut box blank-box loader | FIG. 5, 6 |
| 111 | Pivot point-box loader | FIG. 5 |
| 112 | Cavity-box loader | FIG. 5 |
| 113 | Forming ram-box loader | FIG. 6 |
| 114 | Front of box | FIG. 6 |
| 115 | Back of box | FIG. 6 |
| 116 | Fold assist roller | FIG. 6 |
| 117 | Fold assist roller | FIG. 6 |
| 118 | Side of cavity-box loader | FIG. 5 |
| 119 | Side of cavity-box loader | FIG. 5 |
| 120 | Vacuum port on ram-box loader | FIG. 5 |
| 121 | Vacuum port on ram-box loader | FIG. 5 |
| 122 | Vacuum port on ram-box loader | FIG. 5 |
| 123 | Forming rollers | FIG. 8 |
| 124 | Forming rollers | FIG. 8 |
| 125 | Box sides being folded | FIG. 8 |
| 126 | Box sides being folded | FIG. 8 |
| 127 | Heat seal bar | FIG. 8 |
| 128 | Heat seal bar | FIG. 8 |
| 129 | Incoming parts-box loader | FIG. 5 |
| 130 | Incoming parts-box loader | FIG. 5 |
| 131 | Parts slide-box loader | FIG. 5 |
| 132 | Web guide pleating web envelopes | FIG. 3a, b, d |
| 133 | Top pleating bar for bottom gusset | FIG. 11, 13 |
| 134 | Bottom pleating bar for bottom gusset | FIG. 11, 13 |
| 135 | Rotating disk for bottom gusset | FIG. 11, 13 |
| 136 | Direction of inward travel for gusset bars | FIG. 11 |
| 137 | Slot of insertion for gusset bar into disk | FIG. 11 |
| 138 | Insertion disk to stabilize gusset bars | FIG. 11, 12, 13 |
| 139 | Direction of rotation of gusset bars | FIG. 12 |
| 140 | Direction of outward travel on completion of gusset | FIG. 13 |
| 141 | Hybrid w/ 2 envelopes & invoice-generally | FIG. 14 |
| 142 | Recipient's POSTNET bar code on mailing envelope | FIG. 14 |
| 143 | Recipient's address on mailing envelope | FIG. 14 |
| 144 | FIM bar code on mailing envelope | FIG. 14 |
| 145 | Postage indicia on mailing envelope | FIG. 14 |
| 146 | Fold line for flap on mailing envelope | FIG. 14 |

-continued

| | | |
|---|---|---|
| 147 | Promotional message on front flap of mailing envelope | FIG. 14 |
| 148 | Return address on mailing envelope | FIG. 14 |
| 149 | Flap of mailing envelope | FIG. 14 |
| 150 | Personalized message on back of mailing envelope | FIG. 14 |
| 151 | Line of weakness at top of flap of mailing envelope | FIG. 14 |
| 152 | Tractor feed hole in hybrid form | FIG. 14 |
| 153 | Waste (trim) area of hybrid form | FIG. 14 |
| 154 | Reply coupon-generally | FIG. 14 |
| 155 | Bar code on reply coupon | FIG. 14 |
| 156 | Line of weakness to detach coupon | FIG. 14 |
| 157 | Personalized info on face of invoice | FIG. 14 |
| 158 | Line of weakness separating reply envelope from invoice | FIG. 14 |
| 159 | Return POSTNET bar code | FIG. 14 |
| 160 | Reply address | FIG. 14 |
| 161 | Personalized customer return address on reply envelope | FIG. 14 |
| 162 | Postage indicia on reply envelope | FIG. 14 |
| 163 | Folding line for flap of reply envelope | FIG. 14 |
| 164 | Customer account # bar code on flap of reply envelope | FIG. 14 |
| 165 | Flap, generally, of reply envelope | FIG. 14 |
| 166 | Hybrid form of invoice and mailing envelope only | FIG. 15 |
| 167 | Mailing envelope, generally | FIG. 15 |
| 168 | Recipient's POSTNET bar code | FIG. 15 |
| 169 | Recipient's address | FIG. 15 |
| 170 | FIM bar code on mailing envelope | FIG. 15 |
| 171 | Postage indicia on mailing envelope | FIG. 15 |
| 172 | Promotional message on mailing envelope | FIG. 15 |
| 173 | Sender's return address-mailing envelope | FIG. 15 |
| 174 | Fold line for flap-mailing envelope | FIG. 15 |
| 175 | Personalized message on flap of mailing envelope | FIG. 15 |
| 176 | Flap of mailing envelope-generally | FIG. 15 |
| 177 | Line of weakness at top of flap on mailing envelope | FIG. 15 |
| 178 | Tractor feed hole in hybrid form | FIG. 15 |
| 179 | Waste (trim) area on hybrid form | FIG. 15 |
| 180 | Reply coupon on invoice | FIG. 15 |
| 181 | Customer's bar code account number on coupon | FIG. 15 |
| 182 | Line of weakness to detach coupon | FIG. 15 |
| 183 | Personalized information on face of invoice | FIG. 15 |
| 184 | Invoice, generally | FIG. 15 |
| 185 | Hybrid w/O.E Catalog, invoice and reply #10 | FIG. 16 |
| 186 | O.E. Catalog-generally | FIG. 16 |
| 187 | Recipient's POSTNET bar code on mailing envelope | FIG. 16 |
| 188 | Recipient's address on mailing envelope | FIG. 16 |
| 189 | FIM bar code on mailing envelope | FIG. 16 |
| 190 | Postage indicia on mailing envelope | FIG. 16 |
| 191 | Fold line for flap on mailing envelope | FIG. 16 |
| 192 | Promotional message on front flap of mailing envelope | FIG. 16 |
| 193 | Return address on mailing envelope | FIG. 16 |
| 194 | Flap of mailing envelope | FIG. 16 |
| 195 | Personalized message on back of mailing envelope | FIG. 16 |
| 196 | Line of weakness at top of flap of mailing envelope | FIG. 16 |
| 197 | Tractor feed hole in hybrid form | FIG. 16 |
| 198 | Waste (trim) area of hybrid form | FIG. 16 |
| 199 | Reply coupon-generally | FIG. 16 |
| 200 | Bar code on reply coupon | FIG. 16 |
| 201 | Line of weakness to detach coupon | FIG. 16 |
| 202 | Personalized info on face of invoice | FIG. 16 |
| 203 | Personalized advertisement-generally | FIG. 16 |
| 204 | Line of weakness separating reply envelope from invoice | FIG. 16 |
| 205 | Return POSTNET bar code | FIG. 16 |
| 206 | Reply address | FIG. 16 |
| 207 | Personalized customer return address on reply envelope | FIG. 16 |
| 208 | FIM bar code reply envelope | FIG. 16 |
| 209 | Postage indicia on reply envelope | FIG. 16 |
| 210 | Folding line for flap of reply envelope | FIG. 16 |
| 211 | Customer account # bar code on | FIG. 16 |

-continued

| | | |
|---|---|---|
| | flap of reply envelope | |
| 212 | Flap-generally- of reply envelope | FIG. 16 |
| 213 | Reply envelope-generally | FIG. 16 |
| 214 | Mailing envelope- generally | FIG. 17 |
| 215 | Recipient's POSTNET bar code on mailing envelope | FIG. 17 |
| 216 | Recipient's address on mailing envelope | FIG. 17 |
| 217 | FIM bar code on mailing envelope | FIG. 17 |
| 218 | Postage indicia on mailing envelope | FIG. 17 |
| 219 | Fold line for flap on mailing envelope | FIG. 17 |
| 220 | Promotional message on front flap of mailing envelope | FIG. 17 |
| 221 | Return address on mailing envelope | FIG. 17 |
| 222 | Flap of mailing envelope | FIG. 17 |
| 223 | Personalized message on back of mailing envelope | FIG. 17 |
| 224 | Line of weakness at top of flap of mailing envelope | FIG. 17 |
| 225 | Second invoice sheet-generally | FIG. 17 |
| 226 | Personalized data on second invoice sheet | FIG. 17 |
| 227 | Tractor feed hole in hybrid form | FIG. 17 |
| 228 | Waste (trim) area of hybrid form | FIG. 17 |
| 229 | Line of weakness between invoice 1 & 2 | FIG. 17 |
| 230 | Reply coupon-generally | FIG. 17 |
| 231 | Bar code on reply coupon | FIG. 17 |
| 232 | Line of weakness to detach coupon | FIG. 17 |
| 233 | Personalized info on face of invoice | FIG. 17 |
| 234 | First invoice -generally | FIG. 17 |
| 235 | Line of weakness separating reply envelope from invoice | FIG. 17 |
| 236 | Return POSTNET bar code | FIG. 17 |
| 237 | Reply address | FIG. 17 |
| 238 | Personalized customer return address on reply envelope | FIG. 17 |
| 239 | FIM bar code reply envelope | FIG. 17 |
| 240 | Postage indicia on reply envelope | FIG. 17 |
| 241 | Folding line for flap of reply envelope | FIG. 17 |
| 242 | Customer account # bar code on flap of reply envelope | FIG. 17 |
| 243 | Flap-generally of reply envelope | FIG. 17 |
| 244 | Reply envelope-generally | FIG. 17 |
| 245 | Two-page invoice form with mailing & reply envelope | FIG. 17 |
| 246 | Series of unprinted envelopes in tractor feed general | FIG. 18 |
| 247 | Envelope 1 in series of 4 | FIG. 18 |
| 248 | Envelope 2 in series of 4 | FIG. 18 |
| 249 | Envelope 3 in series of 4 | FIG. 18 |
| 250 | Envelope 4 in series of 4 | FIG. 18 |
| 251 | Bottom edge of envelope | FIG. 18 |
| 252 | Face imprint area of envelope | FIG. 18 |
| 253 | Flap fold line | FIG. 18 |
| 254 | Flap generally | FIG. 18 |
| 255 | Line of weakness and top of flap | FIG. 18 |
| 256 | Tractor-feed hole | FIG. 18 |
| 257 | Waste (trim) area | FIG. 18 |
| 258 | Loan payment envelope form generally | FIG. 19 |
| 259 | Bottom edge of loan payment envelope | FIG. 19 |
| 260 | POSTNET bar code | FIG. 19 |
| 261 | Envelope generally | FIG. 19 |
| 262 | Mailing address | FIG. 19 |
| 263 | FIM code | FIG. 19 |
| 264 | Postage indicia | FIG. 19 |
| 265 | Fold line for flap | FIG. 19 |
| 266 | Customer account info in bar code format | FIG. 19 |
| 267 | Flap generally | FIG. 19 |
| 268 | MICR code | FIG. 19 |
| 269 | Line of weakening between envelope and receipt stub | FIG. 19 |
| 270 | Receipt stub generally | FIG. 19 |
| 271 | Top edge of receipt stub | FIG. 19 |
| 272 | Variable payment information on stub | FIG. 19 |
| 273 | Staples (3) | FIG. 19 |
| 274 | Coupon book | FIG. 19 |
| 275 | Direction of tear from stub | FIG. 20 |
| 276 | Remaining envelopes in coupon book | FIG. 20 |
| 277 | Credit card mailer generally | FIG. 21 |
| 278 | Imprintable sheet-generally | FIG. 21 |
| 279 | Variable imprinted information | FIG. 21 |
| 280 | Credit card pocket -left | FIG. 21 |

-continued

| | | |
|---|---|---|
| 281 | Credit card pocket -right | FIG. 21 |
| 282 | Credit card- right | FIG. 21 |
| 283 | Credit card-left | FIG. 21 |
| 284 | Tractor feed hole | FIG. 21 |
| 285 | Waste (trim) area | FIG. 21 |
| 286 | Imprintable form-generally | FIG. 22 |
| 287 | Bar code shop order | FIG. 22 |
| 288 | Multi-gusseted pocket for eyeglass frame | FIG. 22 |
| 289 | Eyeglass frame inserted into pocket | FIG. 22 |
| 290 | Multi-gusseted pocket for left lens | FIG. 22 |
| 291 | Multi-gusseted pocket for right lens | FIG. 22 |
| 292 | Optical lens inserted into right pocket | FIG. 22 |
| 293 | Optical lens inserted into left pocket | FIG. 22 |
| 294 | Variable imprinted information | FIG. 22 |
| 295 | Tractor feed hole | FIG. 22 |
| 296 | Waste (trim) area | FIG. 22 |
| 297 | Pocket form generally | FIG. 22 |
| 298 | Printing process generally | FIG. 23 |
| 299 | Box of blank or partially printed forms | FIG. 23 |
| 300 | Mailing envelope generally | FIG. 23 |
| 301 | Invoice generally | FIG. 23 |
| 302 | Reply envelope generally | FIG. 23 |
| 303 | Data cable into 1st printer | FIG. 23 |
| 304 | Front printer panel | FIG. 23 |
| 305 | First printer | FIG. 23 |
| 306 | Bar code or MICR scanner | FIG. 23 |
| 307 | Data cable 2nd printer | FIG. 23 |
| 308 | Rear panel 2nd printer | FIG. 23 |
| 309 | Second printer | FIG. 23 |
| 310 | Printing on back side of flap 165 | FIG. 24 |
| 311 | Printing on back side of invoice 301 | FIG. 24 |
| 312 | Printing on back side of coupon 154 | FIG. 24 |
| 313 | Rotary die | FIG. 25 |
| 314 | Anvil roll | FIG. 25 |
| 315 | Tractor-feed pin | FIG. 25 |
| 316 | Tractor-feed pin | FIG. 25 |
| 317 | Perforation blade | FIG. 25 |
| 318 | Crease blade | FIG. 25 |
| 319 | Grooves in anvil roll to allow pins to rotate | FIG. 25 |
| 329 | Engraved shape blade | FIG. 25 |
| 321 | Engraved shape blade | FIG. 25 |
| 324 | Bottom edge of envelope 300 | FIG. 26 |
| 325 | Gusset on envelope 300 | FIG. 26 |
| 326 | Gusset opening of envelope 300 | FIG. 26, 24 |
| 327 | Remoistenable or heat activated adhesive flap 149 | FIG. 26, 1 |
| 328 | Crease-fold line midway on invoice 301 | FIG. 26 |
| 329 | Gusset on envelope 302 | FIG. 26 |
| 330 | Gusset opening of envelope 302 | FIG. 26 |
| 331 | Remoistenable adhesive on envelope 302 | FIG. 26 |
| 335 | Bursting knife | FIG. 26a |
| 336 | Loader work surface | FIG. 26a |
| 337 | Hinge pivot | FIG. 26a |
| 338 | Swing arm | FIG. 26a |
| 339 | Flap bender | FIG. 26b |
| 340 | Direction of rotation for swing arm | FIG. 26b |
| 341 | Original position of swing arm before operation | FIG. 26b |
| 342 | Partial arc of swing arm | FIG. 26b |
| 343 | Partial arc of swing arm | FIG. 26b |
| 346 | Vacuum tube | FIG. 26d |
| 347 | Vacuum tube | FIG. 26d |
| 348 | Rubber sucker | FIG. 26d |
| 349 | Rubber sucker | FIG. 26d |
| 350 | Direction of travel toward mailing envelope 300 | FIG. 26e |
| 351 | Direction of travel toward mailing envelope 300 | FIG. 26e |
| 352 | 180° bend in invoice as it travels toward 300 | FIG. 26e |
| 353 | Bed of loader | FIG. 26g |
| 354 | Inserter roller | FIG. 26g |
| 355 | Direction of downward movement of 354 roller | FIG. 26g |
| 356 | Direction of rotation of 354 roller | FIG. 26g |
| 357 | Fold curve | FIG. 26h |
| 358 | Fold curve | FIG. 26h |
| 359 | Advertisements | FIG. 26h |
| 360 | Inserter bar with advertisements | FIG. 26h |

-continued

Figure 26J:
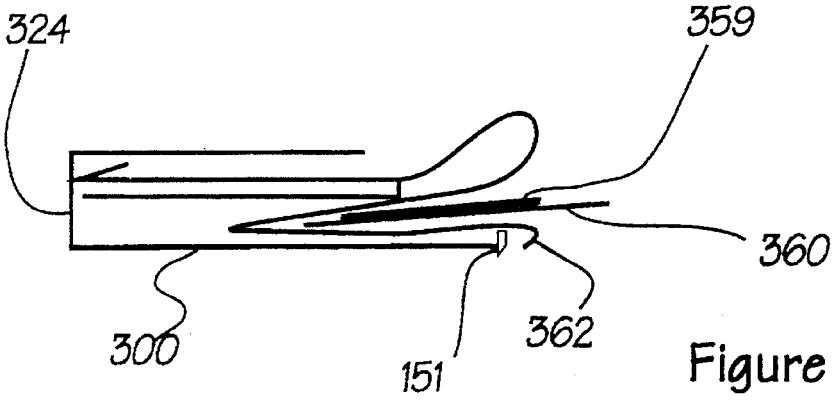
FIG. 26*j* is a side view of the insertion ram, with advertising materials, pushing the invoice into the mailing envelope as it is severed from the top of the mailing envelope flap.
Figure 27:
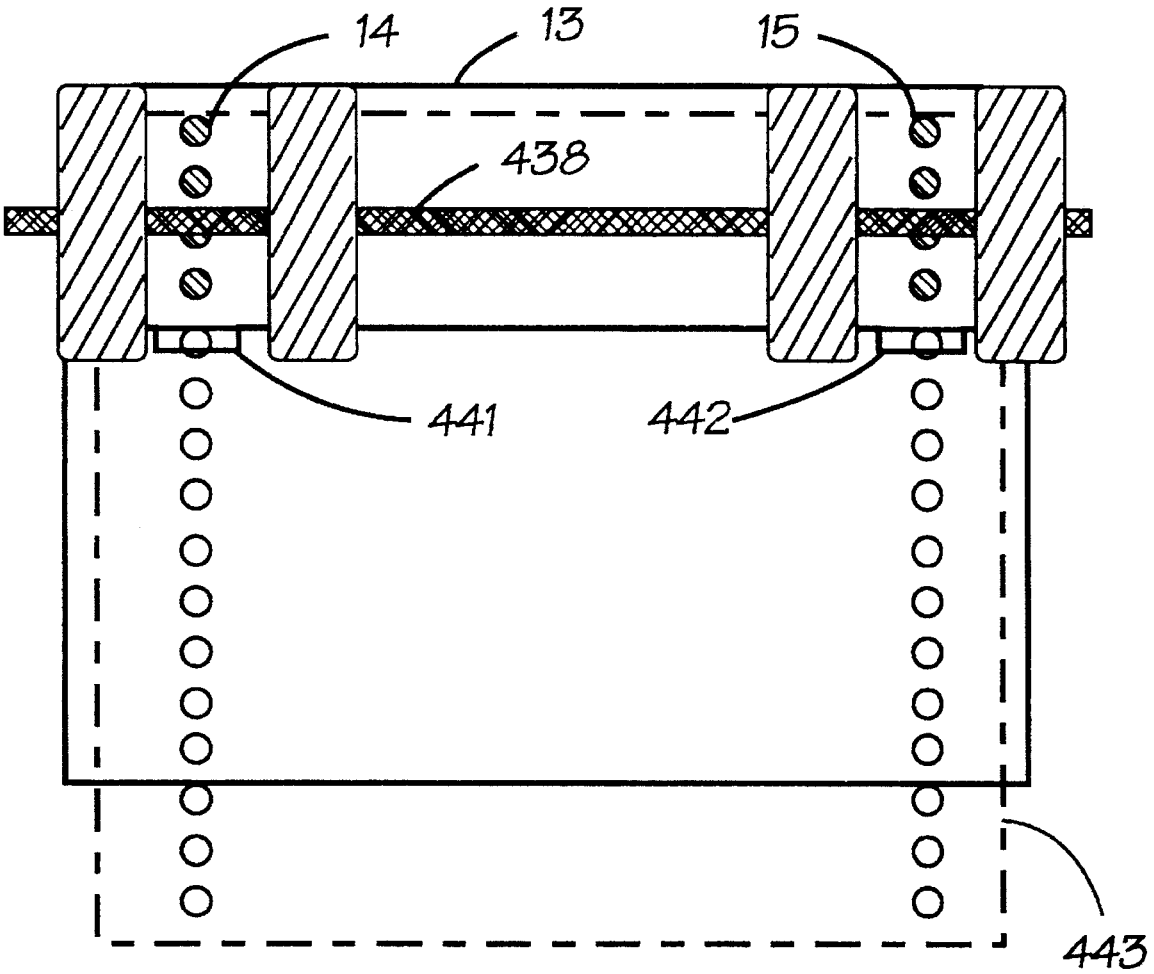
FIG. 27 is a plan view of an apparatus built in accordance with the principles of the present invention useful for transferring a multipart carbonless form to the web.
Figure 28E:
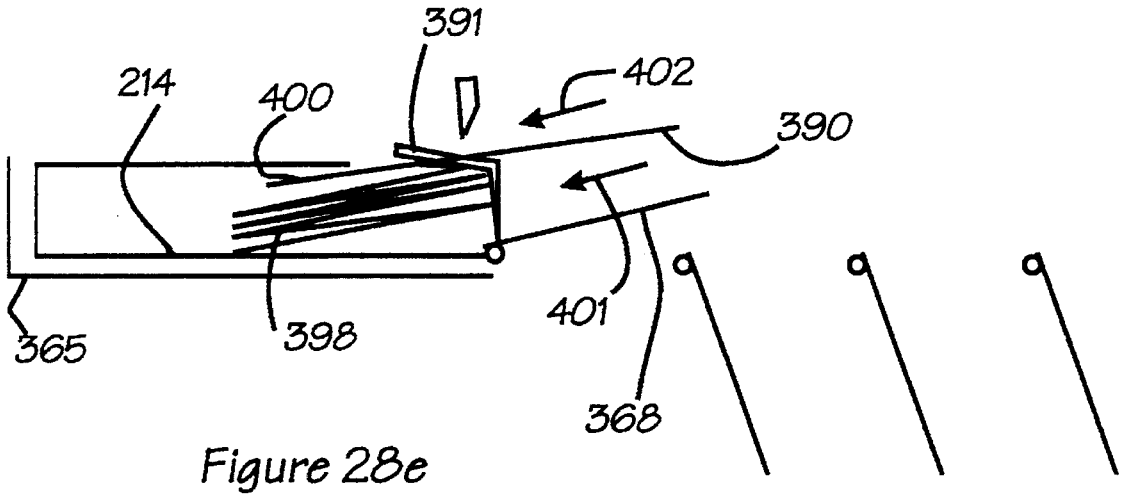
FIG. 28*e* is a side view of the process of insertion of the folded invoice and return reply envelope of FIG. 17 into the mailing envelope.
Figure 31:
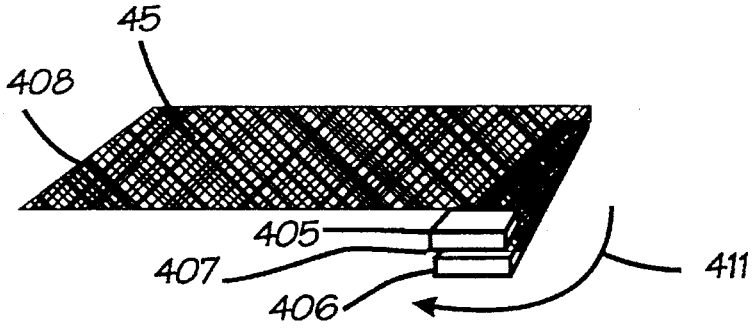
FIG. 31 is a perspective view of the formed gusset upon the completion of the rotation of the members of FIG. 30.
Figure 36:
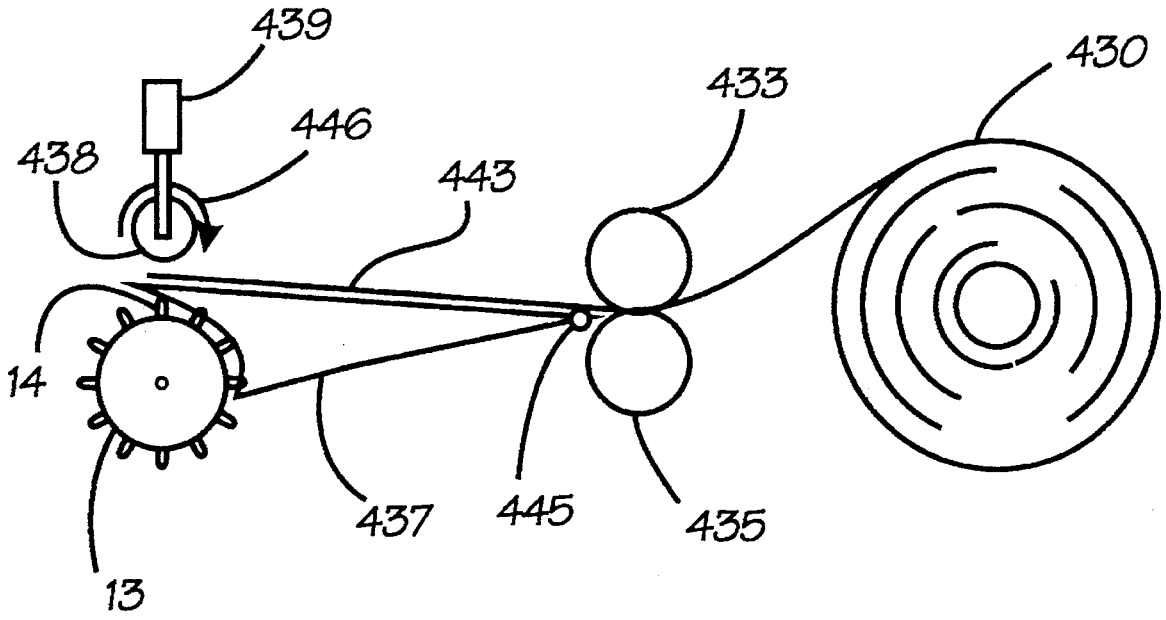
FIG. 36 is a side view of the process of FIG. 35 shown in more detail.

| | | |
|---|---|---|
| 361 | Direction of travel of inserter bar | FIG. 26i |
| 362 | Free edge of trailing edge of invoice after cut | FIG. 26j |
| 365 | Bed of loader for two page invoice | FIG. 28a |
| 367 | Pivot point | FIG. 28a |
| 368 | Vacuum plate | FIG. 28a |
| 369 | Pivot point | FIG. 28a |
| 370 | Vacuum plate | FIG. 28a |
| 371 | Pivot point | FIG. 28a |
| 372 | Vacuum plate | FIG. 28a |
| 373 | Pivot point | FIG. 28a |
| 374 | Vacuum plate | FIG. 28a |
| 375 | Pivot point | FIG. 28a |
| 376 | Vacuum plate for flap folding | FIG. 28a |
| 377 | Direction of rotation | FIG. 28a |
| 378 | Bursting blade | FIG. 28a |
| 380 | Direction of downward travel busting blade | FIG. 28b |
| 381 | Direction of rotation vacuum plate | FIG. 28b |
| 382 | Direction of rotation vacuum plate | FIG. 28b |
| 383 | Direction of rotation vacuum plate | FIG. 28b |
| 384 | Diamond forming bar | FIG. 28b |
| 385 | Diamond forming bar | FIG. 28b |
| 386 | Diamond forming bar | FIG. 28b |
| 390 | Guide plate | FIG. 28c |
| 391 | Insertion ram | FIG. 28c |
| 392 | Hook ledge on insertion ram | FIG. 28c |
| 393 | Direction of travel | FIG. 28c |
| 394 | Direction of travel | FIG. 28c |
| 395 | Direction of travel | FIG. 28c |
| 396 | Direction of travel insertion ram | FIG. 28c |
| 397 | Direction of travel bursting blade | FIG. 28c |
| 398 | Folded invoices and envelope | FIG. 28c |
| 400 | Opening on envelope 214 | FIG. 28a, b, c |
| 401 | Direction of movement for insertion ram | FIG. 28e |
| 402 | Direction of movement for guide plate | FIG. 28e |
| 403 | Direction of travel | FIG. 32 |
| 404 | Direction of travel leading edge gusset | FIG. 32 |
| 405 | Bottom pleating bar | FIG. 29 |
| 406 | Top pleating bar | FIG. 29 |
| 407 | Leading edge gusset part | FIG. 29 |
| 408 | Trailing edge gusset part | FIG. 29 |
| 409 | Direction of travel of top pleating bar | FIG. 29 |
| 410 | 90° rotation of both pleating bars | FIG. 30 |
| 411 | Second 90° rotation of both pleating bars | FIG. 31 |
| 412 | Direction of travel of pleated gusset | FIG. 32 |
| 413 | Gusset guide | FIG. 32 |
| 414 | Gusset guide | FIG. 32 |
| 415 | Top nip roll | FIG. 32 |
| 416 | Bottom nip roll | FIG. 32 |
| 417 | Direction of travel both pleating bars | FIG. 32 |
| 418 | Finished bottom pleated gusset | FIG. 32 |
| 420 | Transfer roller | FIG. 34 |
| 421 | Groove in transfer roll | FIG. 34 |
| 422 | Groove in transfer roll | FIG. 34 |
| 423 | Vacuum port | FIG. 34 |
| 424 | Vacuum port | FIG. 34 |
| 430 | Supply of manifold carbonless forms | FIG. 35 |
| 431 | Nip roll | FIG. 35 |
| 432 | Nip roll | FIG. 35 |
| 433 | Die | FIG. 35 |
| 434 | Blade on die | FIG. 35 |
| 435 | Anvil roller | FIG. 35 |
| 436 | Cut section of multipart form | FIG. 35 |
| 437 | Staging platform | FIG. 36 |
| 438 | Engagement roller assembly | FIG. 36 |
| 439 | Engagement solenoid | FIG. 36 |
| 440 | Staging platform pivot | FIG. 36 |
| 441 | Staging platform cutouts | FIG. 27 |
| 442 | Staging platform cutouts | FIG. 27 |
| 443 | Multipart form on staging platform | FIG. 27 |
| 445 | Pivot point of staging platform | FIG. 27 |
| 450 | Follower arm-feed roll | FIG. 1A |
| 451 | Follower wheel-feed roll | FIG. 1A |
| 452 | Core-feed roll | FIG. 1A |
| 453 | Feed roll | FIG. 1A |
| 454 | Web guide | FIG. 1A |
| 455 | Web guide | FIG. 1A |
| 456 | Web | FIG. 1A |
| 457 | Meter roll | FIG. 1A |
| 458 | Meter roll | FIG. 1A |

-continued

Figure 37:
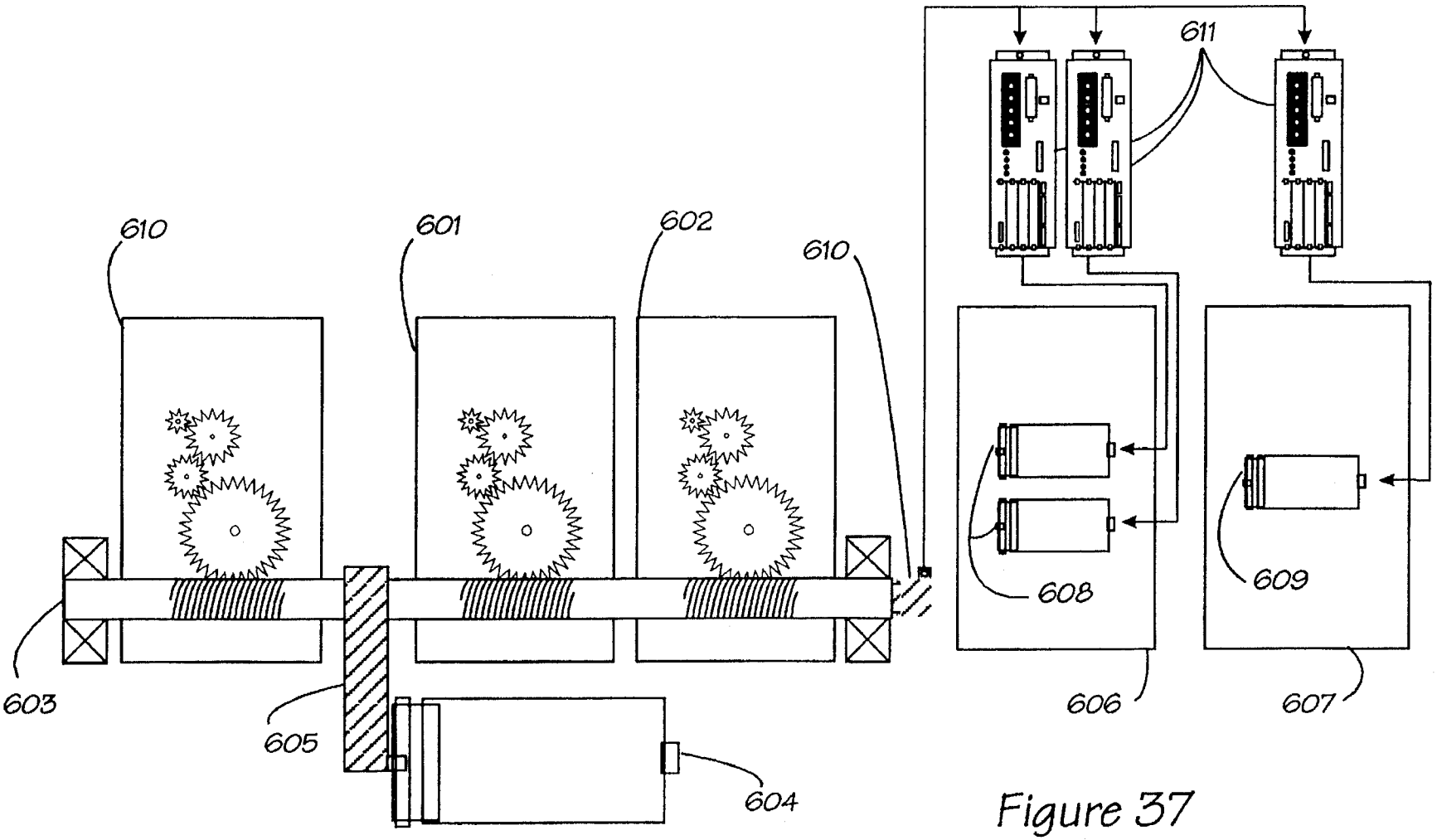
FIG. 37 is a line art reproduction of FIG. 2 from sales brochure no. IAE 74180 Revision A 09/93 from The Rexroth Corporation, Indramat Division, 255 Mittel Drive, Wood Dale, Ill., 60191.
Figure 38:
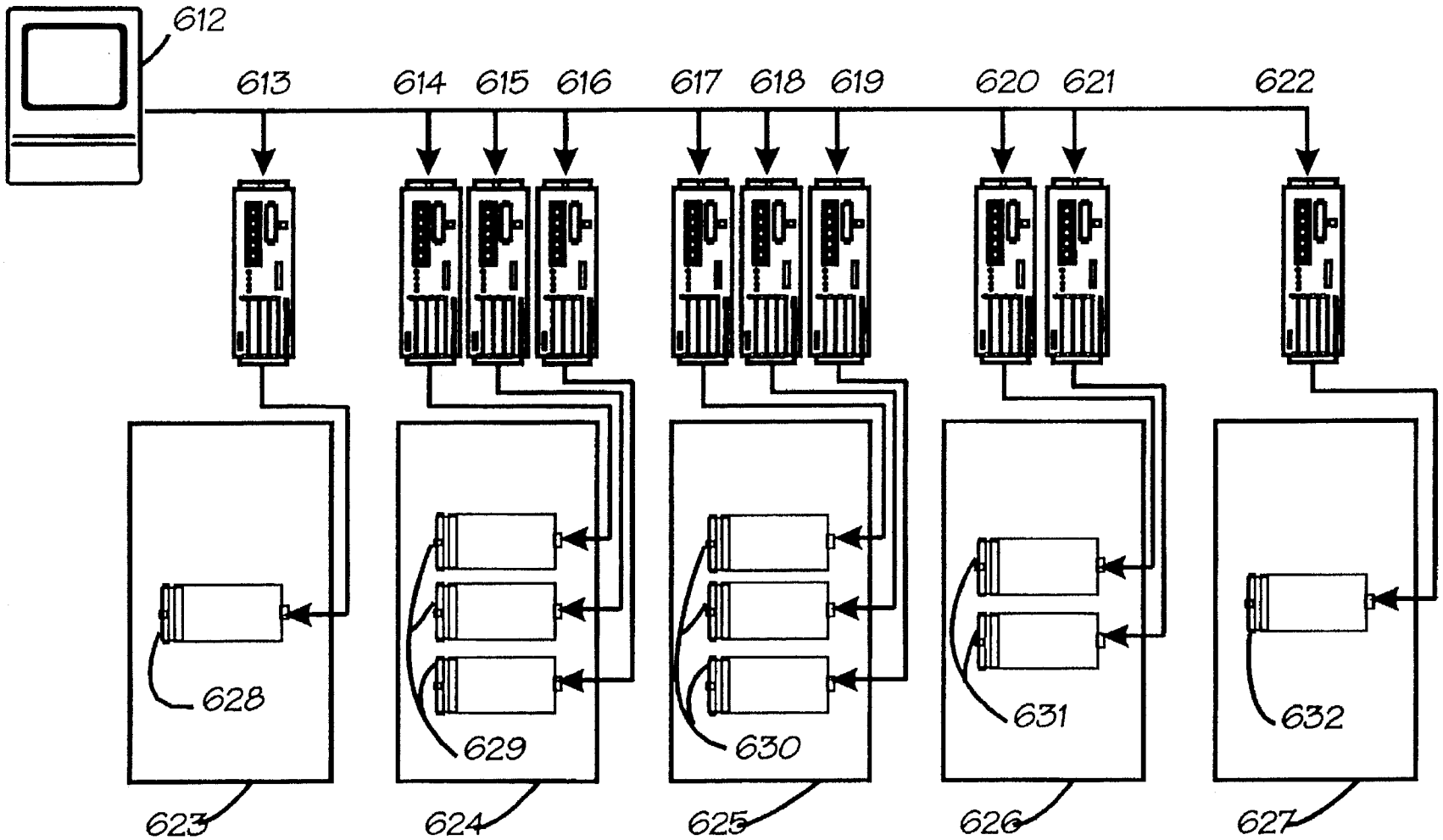
FIG. 38 is a line art reproduction of FIG. 3 from sales brochure no. IAE 74180 Revision A 09/93 from The Rexroth Corporation, Indramat Division, 255 Mittel Drive, Wood Dale, Ill., 60191.

| | | |
|---|---|---|
| 459 | Caliper gauge | FIG. 1A |
| 460 | Gauging roller | FIG. 1A |
| 461 | Transducer tension detector | FIG. 1A |
| 462 | Plate #1 & plate cylinder | FIG. 1A |
| 463 | Impression cylinder | FIG. 1A |
| 464 | Dryer #1 | FIG. 1A |
| 465 | Dryer #2 | FIG. 1A |
| 466 | Dryer #3 | FIG. 1A |
| 467 | Dryer #4 | FIG. 1A |
| 468 | Temperature sensor | FIG. 1A |
| 469 | Temperature sensor | FIG. 1A |
| 470 | Temperature sensor | FIG. 1A |
| 471 | Temperature sensor | FIG. IA |
| 472 | Moisture sensor | FIG. 1A |
| 473 | Moisture sensor | FIG. 1A |
| 474 | Moisture sensor | FIG. 1A |
| 475 | Moisture sensor | FIG. 1A |
| 476 | Idler roll with rubber band | FIG. 1A |
| 477 | Star wheel #1 | FIG. 1A |
| 478 | Idler roll with rubber band | FIG. 1A |
| 479 | Star wheel #2 | FIG. 1A |
| 480 | Idler roll with rubber band | FIG. 1A |
| 481 | Star wheel #3 | FIG. 1A |
| 482 | Idler roll with rubber band | FIG. 1A |
| 483 | Star wheel #4 | FIG. 1A |
| 484 | Impression cylinder | FIG. 1A |
| 485 | Plate #2 & print cylinder | FIG. 1A |
| 486 | Impression cylinder | FIG. 1A |
| 487 | Plate #3 & print cylinder | FIG. 1A |
| 488 | Impression cylinder | FIG. 1A |
| 489 | Plate #4 & print cylinder | FIG. 1A |
| 490 | Die | FIG. 1A |
| 491 | Anvil roll | FIG. 1A |
| 492 | Die | FIG. 1A |
| 493 | Anvil roll | FIG. 1A |
| 494 | Die | FIG. 1A |
| 495 | Anvil roll | FIG. 1A |
| 496 | Caliper gauge | FIG. 1A |
| 497 | Gauging cylinder | FIG. 1A |
| 498 | Meter roll | FIG. 1A |
| 499 | Meter roll | FIG. 1A |
| 500 | Follower arm | FIG. 1A |
| 501 | Follower roller | FIG. 1A |
| 502 | Rewind roll | FIG. 1A |
| 503 | Core of rewind roll | FIG. 1A |
| 504 | Pivot point rewind follower arm | FIG. 1A |
| 505 | Pivot point feed roll follower arm | FIG. 1A |
| 506 | Idler roller | FIG. 1A |
| 507 | Idler roller | FIG. 1A |
| 600 | Infeed station, Indramat sales brochure | FIG. 37 |
| 601 | Print station #1, Indramat sales brochure | FIG. 37 |
| 602 | Print station #2, Indramat sales brochure | FIG. 37 |
| 603 | Main drive shaft, Indramat sales brochure | FIG. 37 |
| 604 | Drive motor, Indramat sales brochure | FIG. 37 |
| 605 | Drive belt, Indramat sales brochure | FIG. 37 |
| 606 | Die cut station, Indramat sales brochure | FIG. 37 |
| 607 | Folding station, Indramat sales brochure | FIG. 37 |
| 608 | Die cut servo motor, Indramat sales brochure | FIG. 37 |
| 609 | Folder servo motor, Indramat sales brochure | FIG. 37 |
| 610 | Position sensor, Indramat sales brochure | FIG. 37 |
| 611 | Motion control logic, Indramat sales brochure | FIG. 37 |
| 612 | Main computer, Indramat sales brochure | FIG. 38 |
| 613 | Motion control logic, Indramat sales brochure | FIG. 38 |
| 614 | Motion control logic, Indramat sales brochure | FIG. 38 |
| 615 | Motion control logic, Indramat sales brochure | FIG. 38 |
| 616 | Motion control logic, Indramat sales brochure | FIG. 38 |
| 617 | Motion control logic, Indramat sales brochure | FIG. 38 |
| 618 | Motion control logic, Indramat sales brochure | FIG. 38 |
| 618 | Motion control logic, Indramat sales brochure | FIG. 38 |
| 620 | Motion control logic, Indramat Bales brochure | FIG. 38 |
| 621 | Motion control logic, Indramat sales brochure | FIG. 38 |
| 622 | Motion control logic, Indramat sales brochure | FIG. 38 |
| 623 | Infeed station, Indramat sales brochure | FIG. 38 |
| 624 | Print station #1, Indramat sales brochure | FIG. 38 |
| 625 | Print station #2, Indramat sales brochure | FIG. 38 |
| 626 | Die cut station, Indramat sales brochure | FIG. 38 |
| 627 | Folder station, Indramat sales brochure | FIG. 38 |
| 628 | Infeed servo motor, Indramat sales brochure | FIG. 38 |
| 629 | Print #1 servo motor, Indramat sales brochure | FIG. 38 |
| 630 | Print #2 servo motor, Indramat sales brochure | FIG. 38 |

-continued

| | | |
|---|---|---|
| 631 | Die cut servo motor, Indramat sales brochure | FIG. 38 |
| 632 | Folder servo motor, Indramat sales brochure | FIG. 38 |
| 700 | Web | FIG. 39 |
| 701 | Print cylinder #1 for printing on top side of web 700 | FIG. 39 |
| 702 | Impression cylinder for 701 | FIG. 39 |
| 703 | Dryer #1 | FIG. 39 |
| 704 | Temperature sensor | FIG. 39 |
| 705 | Moisture sensor | FIG. 39 |
| 706 | Idler roller | FIG. 39 |
| 707 | Position sensor | FIG. 39 |
| 708 | Print cylinder #1 for printing on reverse side of web 700 | FIG. 39 |
| 709 | Impression cylinder for 708 | FIG. 39 |
| 710 | Dryer #2 | FIG. 39 |
| 711 | Temperature sensor | FIG. 39 |
| 712 | Moisture sensor | FIG. 39 |
| 713 | Idler roller | FIG. 39 |
| 714 | Position sensor | FIG. 39 |
| 715 | Idler roller | FIG. 39 |
| 716 | Print cylinder #2 for printing on top side of web 700 | FIG. 39 |
| 717 | Impression cylinder for 716 | FIG. 39 |
| 718 | Dryer #3 | FIG. 39 |
| 719 | Temperature sensor | FIG. 39 |
| 720 | Moisture sensor | FIG. 39 |
| 721 | Idler roller | FIG. 39 |
| 722 | Position sensor | FIG. 39 |
| 723 | Print cylinder #2 for printing on reverse side of web 700 | FIG. 39 |
| 724 | Impression cylinder for 723 | FIG. 39 |
| 725 | Dryer #4 | FIG. 39 |
| 726 | Temperature sensor | FIG. 39 |
| 727 | Moisture sensor | FIG. 39 |
| 728 | Idler roller | FIG. 39 |
| 729 | Position sensor | FIG. 39 |
| 730 | Idler roller | FIG. 39 |
| 731 | Print cylinder #3 for printing on top side of web 700 | FIG. 39 |
| 732 | Impression cylinder for 731 | FIG. 39 |
| 733 | Dryer #5 | FIG. 39 |
| 734 | Temperature sensor | FIG. 39 |
| 735 | Moisture sensor | FIG. 39 |
| 736 | Idler roller | FIG. 39 |
| 737 | Position sensor | FIG. 39 |
| 738 | Print cylinder #3 for printing on reverse side of web 700 | FIG. 39 |
| 739 | Impression cylinder for 738 | FIG. 39 |
| 740 | Dryer #6 | FIG. 39 |
| 741 | Temperature sensor | FIG. 39 |
| 742 | Moisture sensor | FIG. 39 |
| 743 | Idler roller | FIG. 39 |
| 744 | Position sensor | FIG. 39 |
| 901 | Remoisenable adhesive on flap of envelope 4 | FIG. 1 |
| 902 | Cut-away of U shaped adhesive on finished envelope 4 | FIG. 1 |
| 903 | Flap of envelope 4 | FIG. 1 |
| 904 | Vacuum port on anvil roller 43 | FIG. 1 |
| 905 | Adhesive application unit for U shaped adhesive | FIG. 1 |
| 906 | Web reverse unit-generally | FIG. 1 |
| 907 | U shaped pattern of adhesive before placement gusset part 45 | FIG. 1 |
| 908 | Leading edge of part 45 | FIG. 1 |

The invention is susceptible to various modifications and alternative constructions, and it is to be understood that the invention is not limited to the specific forms above disclosed, but covers all modifications, variations, alternative constructions and equivalents reasonably falling within the meaning, purview and range of equivalents of this disclosure.

I claim:

1. An apparatus for producing an envelope containing printed matter, comprising:

(a) a first sheet like material;

(b) a second sheet like material:

(c) a cutting mechanism, the cutting mechanism being adapted to cut at least a first region of the first sheet so as to create a planform of an envelope having a flap;

(d) a conveying system, the conveying system transporting the first and second sheet like materials so as to occupy an abutting, layered orientation; and (e) an insertion mechanism, the insertion mechanism being adapted to urge a second region of the first sheet like material into an interposed relationship between the first region of the first sheet like material and the second sheet like material.

2. The apparatus of claim 1, wherein the first sheet like material is stored on a first spool, the first sheet like material being continuously unwound from the first spool at a first rate.

3. The apparatus of claim 2, wherein the second sheet like material is stored on a second spool, the second sheet like material being continuously unwound from the second spool at a variable rate.

4. The apparatus of claim 3, further comprising a printer, the printer being adapted to print at least some information on the first region of the first sheet like material which is individually associated with at least some information which the printer prints on the second region of the first sheet like material.

5. The apparatus of claim 4, further comprising an adhesive, the adhesive bonding the first region of the first sheet like material to an underlying region of the second sheet like material, thereby forming a first envelope having a flap.

6. The apparatus of claim 5, wherein the second region of the first sheet like material remains integrally interconnected to the first region of the first sheet like material after the first envelope is formed.

7. The apparatus of claim 6, wherein a third region of the first sheet like material is adhered to an underlying region of the second sheet like material, the third region being a subset of the second region.

8. The apparatus of claim 7, further comprising a die cutter, the die cutter being adapted to separate joined first and second regions of the first sheet like material from adjacent joined first and second regions of the first sheet like material.

9. The apparatus of claim 8, wherein a second envelope is formed, the second envelope serving as a return envelope, the return envelope being imprinted with a machine readable code such that the first envelope may be uniquely associated with the second envelope when the first and second envelope are physically separated.

* * * * *